United States Patent [19]

Sahajdak

[11] 4,271,475

[45] Jun. 2, 1981

[54] APPARATUS FOR MEASURING THE FALL HEIGHT OF A PILE DRIVER RAM

[75] Inventor: Steven L. Sahajdak, Brunswick, Ohio

[73] Assignee: Pileco, Inc., Houston, Tex.

[21] Appl. No.: 36,713

[22] Filed: May 7, 1979

[51] Int. Cl.[3] ..... G06F 15/20

[52] U.S. Cl. ..... 364/506; 73/11; 73/12

[58] Field of Search ..... 364/506; 367/40, 31; 73/11, 12

[56] References Cited

U.S. PATENT DOCUMENTS

| | | | |
|---|---|---|---|
| 2,580,299 | 12/1951 | Hunicke | 73/84 |
| 3,340,501 | 9/1967 | Georgi et al. | 340/18 |
| 3,498,388 | 3/1970 | Jovis | 173/2 |
| 3,504,370 | 3/1970 | Rebilly | 346/33 |
| 3,526,874 | 9/1970 | Schwartz | 340/15.5 |
| 3,759,085 | 9/1973 | Wilson et al. | 73/12 |
| 3,838,428 | 9/1974 | Benson et al. | 346/33 R |
| 3,900,826 | 8/1975 | Dowling et al. | 340/15.5 |
| 3,930,248 | 12/1975 | Keller | 364/506 X |

*Primary Examiner*—Edward J. Wise

*Attorney, Agent, or Firm*—David M. Ostfeld

[57] ABSTRACT

An apparatus for automatically calculating the fall height of the ram of a pile driver is disclosed. The apparatus includes a device for converting the sound created by each blow of the pile driver ram into an electrical signal, a first circuit for converting signal into a pulse and a second circuit for converting the time elapsed between the pulses for consecutive blows into a digital output representing the fall height of the ram for the blow corresponding to the latter pulse. The digital electronic circuit may also include circuitry for counting the number of blows in a sequence of blows and circuitry for determining the average fall height for the blows occurring during the sequence.

11 Claims, 26 Drawing Figures

VCC

CLOCK A
CLOCK B
CLOCK C
DIVIDER OUT
747
745
DIVIDING
743
741
CLOCK
MODE
CALCULATION OUT
519

BLOW PULSE (T)
BLOW PULSE (NT)
DELAYED MODE
625
627
631
629
630
MODE
509
INV. BLOW PULSE-1
CLOCK
AVERAGE COMMAND
MAX. BLOW COUNT

525
ERROR RESET
BLOW PULSE (T)
STROKE PRESET
751
STROKE Ø
753
INV. CLOCK
RESET 3
749
BLOW PULSE (NT)
CLOCK

INV. CLOCK
CLOCK
501
539
545
541
537
543
535

INV. RESET 3
RESET 3
575
VCC
580
582
579
577
RESET 1
BLOW PULSE 1
RESET 2
INV. BLOW PULSE 1
503
INV. CLOCK
ACCUMULATOR Ø
CLOCK
573

521
703
SC-100
INV. SC-100
STROKE COUNT
707
STROKE 99/0
SC-10
SC-1
701
639
STROKE PRESET
705
AVERAGE COMPLETE
CLOCK A
STROKE COUNT DIRECTION

511
MODE
739
ERROR DETECTED
INV. DIVIDING
DIVIDING
735
737
ERROR CORRECTED
BLOW PULSE (T)
INV. RESET 3

527
LATCH COMMAND
761
LIMIT LATCH
757
LIMIT ENABLE
756
INV. RESET 3
759
ACCUMULATOR Ø
BLOW PULSE NT
"A" ON
758
CLOCK
AVERAGE COMMAND
752
RESET 2
751
RESET 3
INV. CLOCK
753
RESET 2
INV. CLOCK
760
BLOW PULSE 2
754
762
RESET 1
755
763
764
764A
765
765A
766
766A
VCC

APPARATUS FOR MEASURING THE FALL HEIGHT OF A PILE DRIVER RAM

TECHNICAL FIELD

The present invention relates generally to instruments and methods for metering the operation of pile driving rams and more specifically to instruments and methods for determining the distance through which the ram of an open end diesel hammer falls when driving a pile by using the sound of the impact of the ram against the pile.

BACKGROUND ART

A pile driver is used to drive long slender columns, referred to as "piles", into the ground so that the pile can be used to support a vertical load. Such driving is accomplished by repeatedly striking the top of the pile with a downwardly-moving device, referred to as a "ram". Each time the ram strikes the pile, a substantial portion of the energy of the ram is imparted to the pile whereby the pile moves downwardly into the ground. Knowledge of the energy possessed by the ram at the time it strikes the pile provides substantial useful information regarding the dynamics of the pile in the ground and the ability of the pile to support a load. For example, as set forth in U.S. Pat. Nos. 3,498,388, issued to Jovis on Mar. 3, 1970, and 2,580,299, issued to Hunicke on Dec. 25, 1951, the knowledge of such energy is useful in determining the safe bearing capacity of the pile in accordance with the partly empirical Engineering News formula.

The energy delivered by a hammer for each blow, i.e., for each time the ram of the hammer strikes the pile, is a function of various parameters such as piston weight, blow rate, i.e., the number of blows per unit time, and stroke, i.e., the distance through which the piston falls for each blow. For some types of hammers, the stroke and the piston weight is constant for a particular hammer model of a manufacturer. For such hammer types, the energy delivered on each blow can be determined from the blow rate in accordance with a table prepared by the manufacturer. See Jovis, col. 3, lines 6–33. For open-ended diesel hammers, however, the stroke is not constant. Therefore, in order to determine the energy delivered for each blow by an open-ended diesel hammer, the stroke of the blow must be determined.

In the prior art, devices used for measuring the variable parameters related to the dynamics of pile driving hammers, such as blow rate and stroke, have included mechanisms attached to the hammer itself or to the site being driven by the hammer. In view of the substantial force delivered by the hammer, such devices are subject to rapid wear and tear and to damage. Furthermore, such devices are costly to install and may interfere with the pile driving operation by requiring attachment to and detachment from each pile prior to and after driving and by requiring cables running to and from the hammer and/or pile. In addition, such devices do not provide information by which the stroke is determined for open-end diesel hammers and the blow rate is determinable for other types of hammers.

DISCLOSURE OF THE INVENTION

The apparatus of the present invention calculates the stroke of an open-ended diesel hammer without mechanical or electrical connection either to the hammer itself or to the pile being driven by the hammer. Furthermore, the information provided by the apparatus of the invention can be used for determining the blow rate of other types of hammers.

The device includes a transducer for converting the sound of the environment of an operating hammer, including the sound resulting from the blows of the hammer, into an electrical signal, a first circuit for converting such signal into a series of electrical pulses, each pulse being substantially time coincident with a blow delivered by the hammer and a second circuit for converting the time elapsed between the pulses for consecutive blows into a signal corresponding to the stroke of the second of the consecutive blows.

The second circuitry may include additional circuitry for counting the number of blows in a sequence of blows, for determining the average stroke of a sequence of blows, for preventing the calculation of invalid strokes and for indicating that the strokes of consecutive blows differ by an excessive amount.

BRIEF DESCRIPTION OF THE DRAWINGS

For a further understanding of the nature and objects of the present invention, reference should be made to the following detailed description, taken in conjunction with the accompanying drawings, in which like parts are given like reference numerals and wherein.

BEST MODE FOR CARRYING OUT THE INVENTION

1. Introduction

Figures 1, 2, 4, 5, 6, 7, 8, 10:
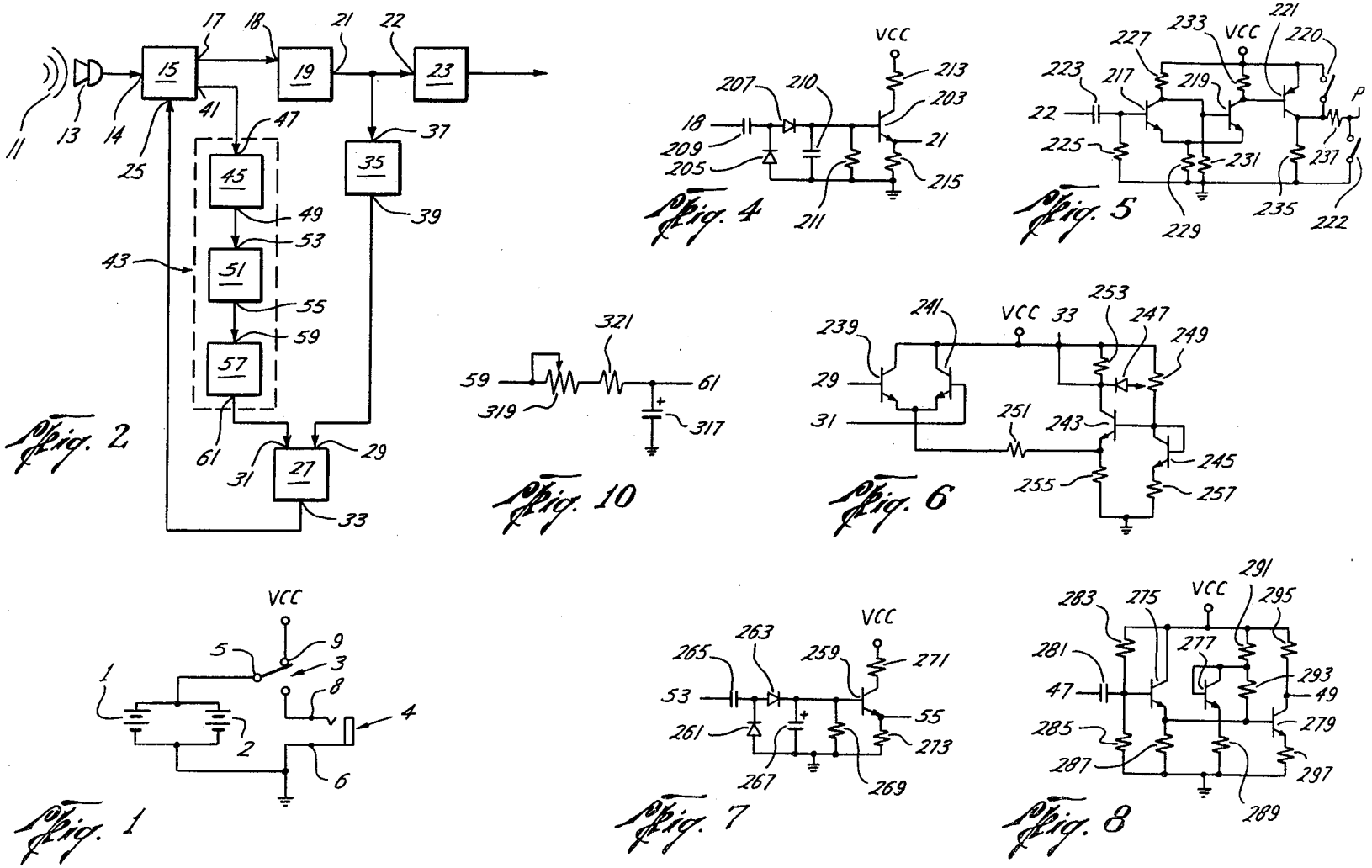
FIG. 1 is an electrical schematic diagram of the power supply for the preferred embodiment of the apparatus of the invention.
FIG. 2 is a schematic block diagram of the detection circuit of the preferred embodiment of the apparatus of the invention.
FIG. 4 is an electronic schematic diagram of the triggering envelope detector circuit of the detection circuit of the preferred embodiment of the apparatus of the invention.
FIG. 5 is an electronic schematic diagram of the pulse generation circuit of the detection circuit of the preferred embodiment of the apparatus of the invention.
FIG. 6 is an electronic schematic diagram of the AGC amplifier circuit of the detection circuit of the preferred embodiment of the apparatus of the invention.
FIG. 7 is an electronic schematic diagram of the limiting envelope detector circuit of the detection circuit of the preferred embodiment of the apparatus of the invention.
FIG. 8 is an electronic schematic diagram of the limiting amplifier circuit of the detection circuit of the preferred embodiment of the apparatus of the invention.
FIG. 10 is an electrical schematic diagram of the averaging circuit of the detection circuit of the preferred embodiment of the apparatus of the invention.

The primary function of the apparatus of the present invention is to provide a digital indication of the fall height, hereinafter referred to as the "stroke", of the ram of an open-ended pile driving hammer. The apparatus accomplishes this function in accordance with the equation $$S=4.01(\Delta T)^2-0.30$$

where S is the stroke for a particular blow of the pile driving hammer in feet and $\Delta T$ is the time differential between such blow and the immediately preceding blow in seconds. This formula was derived from both field observation and laboratory analysis and is based on a free fall assumption with some correction for friction and precompression. Comparison with field results indicates that the equation is accurate at least within $\pm 0.3$ feet.

Thus, in order to provide a digital indication of the stroke of a blow, the apparatus of the invention must include (1) means for detecting the occurrence of such blow and the immediately preceding blow and providing indications of the occurrences of such blows, the time differential between such indications having a substantially fixed relationship to the time differential between such blows, and (2) means for calculating the stroke of such blow in accordance with the above equation using the time differential between the indication of such blow and the indication of the immediately preceding blow as provided by the detection means and for providing a digital indication of such stroke. In the preferred embodiment of the apparatus, such means are provided by two electronic circuits powered by a single power supply: (1) a detection circuit for detecting and indicating the occurrence of the blows and (2) a computing circuit for calculating and indicating the stroke of the blows.

2. Power Supply

In the preferred embodiment of the invention, power for both the detection circuit and the computing circuit is provided by a rechargeable battery supply. Thus, referring to FIG. 1, the preferred power supply includes batteries 1, 2, transfer switch 3 and recharge jack 4. Batteries 1, 2 are rechargeable 9-volt transistor batteries. The positive sides of batteries 1, 2 are both connected to common terminal 5 of switch 3. The negative sides of batteries 1, 2 are connected together and to ring terminal 6 of jack 4 and constitute circuit ground. Arm terminal 7 of transfer switch 3 is connected to locking contact terminal 8 of jack 4. Arm terminal 9 of switch 3 constitutes $V_{cc}$ for the circuitry.

According to the operation of the power supply circuit of FIG. 1, transfer switch 3 operates as the power switch for the apparatus, power being "ON" when the arm of switch 3 shorts arm terminal 9 to common terminal 5, and power being "OFF" when the arm shorts arm terminal 7 to common terminal 5. Furthermore, when power is OFF, batteries 1, 2 may be charged by connecting a battery charging supply to the batteries through jack 4.

3. Detection Circuit

In the analog circuit of the preferred embodiment of the invention, the blows of the pile driving hammer are detected by means of the sound generated by the impact of the ram of the pile driving hammer against a pile and the occurrence of the blows are indicated by a digital pulse.

In performing its function of detecting the occurrence of a blow of the pile driver hammer, the detection circuit of the preferred embodiment of the apparatus of the invention converts the sounds in the environment of the pile driving hammer into an electrical signal, discriminates the component of the signal corresponding to the sound created by the impact of the pile driving hammer from the remainder of the signal, i.e., the components of the signal corresponding to other sounds in the environment of the pile driving hammer ("background noises"), and uses such impact component to trigger a pulse generation circuit.

Thus, referring to the functional block diagram of the preferred embodiment of the invention shown in FIG. 2, sound waves 11 existing in the environment of a pile driving hammer are received by sound detection circuit 13 which includes a transducer for converting the audio signal of sound waves into an electrical signal. Assuming the transducer has a frequency response covering substantially all audible frequencies, the electrical signal produced by receiving circuit 13 will include a component for substantially all the audible sounds incident on the transducer, the voltage amplitude of each such component directly corresponding to the loudness of the sound to which the component corresponds.

The electrical signal produced by sound receiving circuit 13 is fed into input 14 of bandpass amplifier 15. The center frequency of amplifier 15 is the frequency of a characteristic sound created by the pile driving hammer being analyzed and rolling off gradually above and below such frequency. Because such frequency has been found generally to be in the range of 1 kHz, the center frequency of the preferred embodiment of bandpass amplifier 15 is 1 kHz. (In some instances, a different center frequency may be desirable depending on the hammer being used or the type of pile being driven). Thus, the signal at output 17 of amplifier 15 will resemble an amplitude modulated wave having a frequency concentrated in the range of 1 kHz and an amplitude corresponding to the loudness of the sounds in the environment of the pile driving hammer, including those from the pile driving hammer having a frequency in the range of 1 kHz.

The signal at output 17 of amplifier 15 is fed into input 18 of triggering envelope detector 19 which produces a signal at detector output 21 that corresponds to the envelope of the signal at output 17. In this regard, the metallic impact of a pile driving hammer ordinarily produces a ringing sound having an amplitude substantially greater than other sounds in the environment of the pile driving hammer and having a 1 kHz frequency. Such amplitude rises to maximum value from the time of impact in about 5 milliseconds, is fairly constant for about 20 to 50 milliseconds and decays irregularly thereafter. Thus, the occurrence of a blow of the hammer being analyzed will be represented in the signal at output 21 of envelope detector 19 as a pulse having a rise time of about 5 milliseconds, a constant amplitude for about 20 to 50 milliseconds and an irregular decay.

The signal at output 21 of envelope detector 19 is fed into input 22 of pulse generation circuit 23. Circuit 23 is triggered, i.e., produces a digital pulse at output P, for each positive-going transition of the signal at output 21 of envelope detector 19 through a particular voltage level, referred to hereinafter as the "triggering voltage".

In accordance with the overall function of the detection circuit, i.e., to produce a single digital pulse for each hammer blow, sound detection circuit 13, bandpass amplifier 15, envelope detector 19 and pulse generation circuit 23 should be interrelatedly designed such that only the sound of a blow by the hammer being analyzed will result in such a positive-going transition through the triggering voltage. In this latter regard, the actual amplitude of the pulse produced at output 21 of detector 19 will vary in accordance with the actual loudness of the sound of the hammer blow and the distance of the transducer of sound receiving circuit 13 from the point of impact of the ram of the hammer against the pile being driven. Thus, the potential for a blow to produce a digital pulse at P also will vary in accordance with such factors. Similarly, the chance that background noise will produce signals at output 21 of detector 19 of sufficient amplitude to produce a digital pulse at P will vary in accordance with the frequencies and loudness of other sounds present in the environment of the hammer being analyzed and the position of the transducer of sound detection circuit 13 with respect to the sources of such other sounds. If the gain of amplifier 15 and the triggering voltage of circuit 23 are fixed with respect to one another, the position of the transducer and the nature of the background noises becomes extremely critical in each application of the apparatus rendering proper positioning of the apparatus extremely difficult. Furthermore, even after apparently properly positioning the apparatus, conditions, such as the nature and location of background noises, may change thus creating erroneous results. In addition, if the gain of amplifier 15 and the triggering voltage of circuit 23 remain fixed with respect to one another, the irregular decay of the sound created by a hammer blow may result in multiple positive-going transitions through the triggering voltage at the input of circuit 23 thus resulting in one or more spurious pulses at P.

In view of the foregoing problems, the detection circuit of the preferred embodiment of the invention includes adjustment means for adjusting the gain of amplifier 15 with respect to the triggering voltage of circuit 23. Such adjustment means includes (1) automatic gain control ("AGC") circuitry incorporated into bandpass amplifier 15, such circuitry being controllable through AGC input 25, and (2) AGC amplifier 27 having inputs 29, 31 and output 33. Output 33 is connected to AGC input 25 such that as the voltage at output 33 increases, the gain of amplifier 15 decreases in proportion thereto. AGC amplifier 25 preferably has a minimum threshold level (the output of amplifier 25 is zero volts unless the voltage at one or both of inputs 29, 31 is greater than a threshold voltage) and a high gain. If the voltages at inputs 29, 31 both exceed the threshold voltage, the output voltage of amplifier 25 should be proportional to the greater of the voltages at inputs 29, 31.

Input 29 of amplifier 27 is connected to output 21 of detector 19 through first AGC control network 35 having input 37 and output 39. Control network 35 provides a signal at output 39 that follows the peak of the signal at output 21 of detection 19 and discharges slowly. This causes the gain of bandpass amplifier to be reduced substantially at the occurrence of a pulse at output 21 resulting from a hammer blow thereby effectively disabling amplifier 15 for a period of time after the occurrence of such a pulse. Such effective disablement will, in turn, temporarily prevent the occurrence of any positive-going transitions of the signal at input 22 of pulse generation circuit 23 through the triggering voltage of circuit 23. The period of effective disablement will depend on the discharge rate of control network 35. The period of effective disablement should be made as long as possible so as to prevent spurious pulses, but not so long as to disable amplifier 15 at the time of the next hammer blow. Therefore, preferably, control network 35 should include rate adjustment means for controlling the rate of discharge so that the period of disablement can be adjusted in accordance with the approximate rate of the hammer blows.

In order to be certain that amplifier 15 is not prematurely disabled, the triggering level of circuit 23 should be less than the threshold voltage of AGC amplifier 27. Preferably, such triggering level is about one-half of the threshold voltage.

Input 31 of AGC amplifier 27 is connected to output 41 of bandpass amplifier 15 through second AGC control network 43. Output 41 of bandpass amplifier 15 may be the same as output 17 of bandpass amplifier or, as in the preferred embodiment, be a lower power output of bandpass amplifier 17. Network 43 provides a signal at input 31 of AGC amplifier 27 corresponding to the average level of the signal at output 41 of bandpass amplifier 15 exclusive of impulsive changes in such signal. In this way, the gain of amplifier 15 is reduced for a high level of background noise so that the level of the signal at input 22 of circuit 23 corresponding to such background noise is maintained below the triggering level of circuit 23. As a result, only impulsive changes in the signal at output 41 of bandpass amplifier 15, such as that occurring as the result of a hammer blow, can trigger circuit 23.

As shown in FIG. 2, network 39 includes limiting amplifier 45 having input 47 and output 49, limiting envelope detector 51 having input 53 and output 55 and averaging circuit 57 having input 59 and output 61. Amplifier 45, which has a preferred gain of 30 db, limits at a level slightly greater than the maximum steady signal level at output 49 of amplifier 45 in order to prevent short, high-amplitude signals occurring at output 41 of amplifier 15, such as those corresponding to a hammer blow, from being averaged into the signal at AGC amplifier input 31. Detector 51 provides a signal that follows the envelope of the signal at output 49 of amplifier 51. Averaging circuit 57 provides a signal at output 61 corresponding substantially to the average signal level at output 49 of amplifier 45.

The functional elements of the detection circuit of the preferred embodiment of the invention as shown in FIG. 2 and described with respect thereto may include any of a wide variety of specific component arrangements. Certain component arrangements, however, have been found to provide especially efficient and desirable results. Such arrangements are shown in FIGS. 3 through 10 and will be described hereinafter in terms of specific component interconnections and specific component values and types. It will be appreciated, however, that the specific interconnection and/or component values or types can be varied somewhat without departing from the spirit of the particularly desirable component arrangement set forth.

Figures 3, 9:
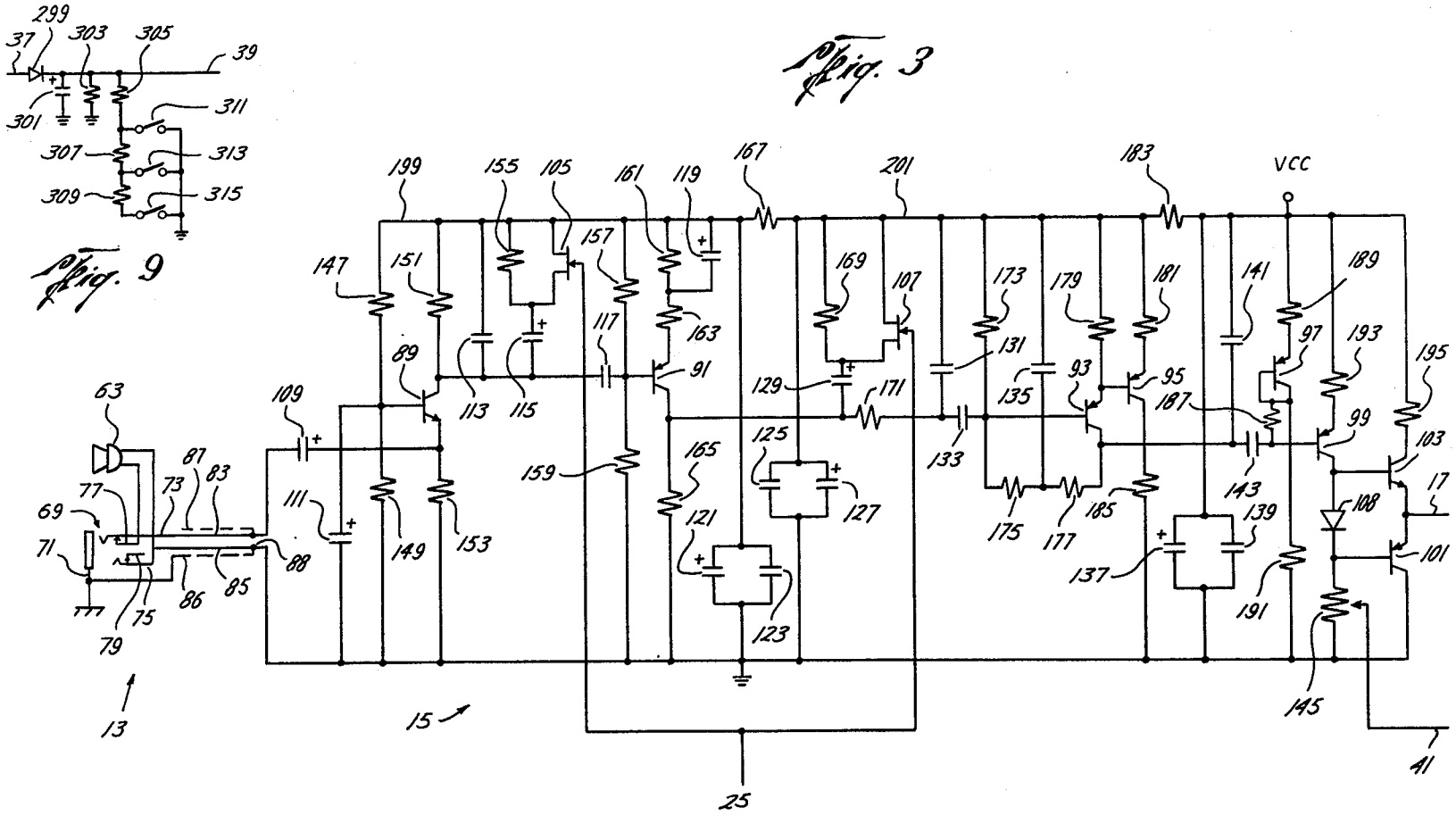
FIG. 3 is an electronic schematic diagram of the sound receiving circuit and the bandpass amplifier of the detection circuit of the preferred embodiment of the apparatus of the invention.
FIG. 9 is an electrical schematic diagram of the first AGC control network of the detection circuit of the preferred embodiment of the apparatus of the invention.

Referring to FIG. 3, sound receiving circuit 11 of the preferred embodiment includes (1) dynamic microphone 63 having output terminals 65, 67; (2) 3-conductor closed-circuit phone jack 69 having ring terminal 71, first locking contact terminal 73, second locking contact terminal 75, first closed-circuit terminal 77 and second closed-circuit terminal 79; and (3) 2-conductor shielded cable 81 having first conductor 83, second conductor 85, and shield 87. Output terminal 65 of microphone 63 and second locking contact terminal 75 of jack 69 are both connected to second conductor 85 at end 86 of cable 81. Output terminal 67 of microphone 63 is connected to first closed-circuit contact 77 of jack 69. First locking contact terminal 73 is connected to first conductor 83 at end 86 of cable 81. Ring terminal 71 of jack 69 is connected to chassis ground and to shield 87 at end 86 of cable 81. Second conductor 85 and shield 87 are both connected to circuit ground at end 88 of cable 81.

In accordance with the operation of sound receiving circuit 11 as shown in FIG. 3, microphone 63 normally constitutes the transducer of sound detection circuit 11. Jack 69 provides means for connecting an external transducer, such as a remote microphone, to sound detection circuit 11 while simultaneously disconnecting microphone 63 in which case such external transducer constitutes the transducer of sound receiving circuit 11. The electrical signal created by sound receiving circuit 11 is provided at end 88 of cable 81 between first conductor 83 and circuit ground.

With further reference to FIG. 3, bandpass amplifier 15 of the preferred embodiment includes the following components:

| Component Name | Reference No. | Preferred Type or Value |
|---|---|---|
| NPN Transistor | 89 | 2N5172 |
| PNP Transistor | 91 | 2N4125 |
| PNP Transistor | 93 | 2N4125 |
| PNP Transistor | 95 | 2N4125 |
| PNP Transistor | 97 | 2N4125 |
| PNP Transistor | 99 | 2N4125 |
| PNP Transistor | 101 | 2N4125 |
| NPN Transistor | 103 | 2N5172 |
| Field-Effect Transistor ("FET") | 105 | 2N5639 |
| FET | 107 | 2N5639 |
| Diode | 108 | 1N914 |
| Electrolytic Capacitor | 109 | 4.7 mfd. |
| Electrolytic Capacitor | 111 | 1 mfd. |
| Capacitor | 113 | .01 mfd. |
| Electrolytic Capacitor | 115 | 0.22 mfd. |
| Capacitor | 117 | 0.05 mfd. |
| Electrolytic Capacitor | 119 | 10 mfd. |
| Electrolytic Capacitor | 121 | 100 mfd. |
| Capacitor | 123 | .05 mfd. |
| Capacitor | 125 | .05 mfd. |
| Electrolytic Capacitor | 127 | 100 mfd. |
| Electrolytic Capacitor | 129 | 22 mfd. |
| Capacitor | 131 | 2200 pfd. |
| Capacitor | 133 | .01 mfd. |
| Electrolytic Capacitor | 135 | 1 mfd. |
| Electrolytic Capacitor | 137 | 100 mfd. |
| Capacitor | 139 | .05 mfd. |
| Capacitor | 141 | 2200 pfd. |
| Capacitor | 143 | .05 mfd. |
| Potentiometer | 145 | 10 Kohm |
| Resistor | 147 | 680 Kohm |
| Resistor | 149 | 270 Kohm |
| Resistor | 151 | 10 Kohm |
| Resistor | 153 | 22 ohm |
| Resistor | 155 | 10 Kohm |
| Resistor | 157 | 100 Kohm |
| Resistor | 159 | 220 Kohm |
| Resistor | 161 | 10 Kohm |
| Resistor | 163 | 100 ohm |
| Resistor | 165 | 15 Kohm |
| Resistor | 167 | 100 ohm |
| Resistor | 169 | 100 Kohm |
| Resistor | 171 | 22 Kohm |
| Resistor | 173 | 220 Kohm |
| Resistor | 175 | 100 Kohm |
| Resistor | 177 | 100 Kohm |
| Resistor | 179 | 100 Kohm |
| Resistor | 181 | 100 ohm |
| Resistor | 183 | 100 ohm |
| Resistor | 185 | 22 Kohm |
| Resistor | 187 | 10 Kohm |
| Resistor | 189 | 2.2 Kohm |
| Resistor | 191 | 39 Kohm |
| Resistor | 193 | 1 Kohm |
| Resistor | 195 | 1 Kohm |

All resistors are $\frac{1}{4}$ watt. Bandpass amplifier 15 of the preferred embodiment also includes voltage buses 199, 201.

The components and buses of bandpass amplifier 15 of FIG. 3 are connected as follows: The positive side of capacitor 111, one end of resistor 147 and the end of resistor 149 are all connected to the base of transistor 89. The other end of capacitor 111 and the other end of resistor 149 are connected to circuit ground. The other end of resistor 147 is connected to bus 199. The positive side of electrolytic capacitor 109 and one end of resistor 153 are connected to the emitter of NPN transistor 89.

The other end of resistor 153 is connected to circuit ground. The other end of capacitor 109 constitutes input 14 of bandpass amplifier 15. One end of resistor 151, one end of capacitor 113, the negative side of capacitor 115 and one side of capacitor 117 are all connected to the collector of NPN transistor 89. The other end of resistor 151 and the other end of capacitor 113 are connected to bus 199. The positive side of capacitor 115 is connected to the drain of FET 105 and to one end of resistor 155. The source of FET 105 and the other end of resistor 155 are connected to bus 199. The other side of capacitor 117, one end of resistor 157 and one end of resistor 159 are connected to the base of PNP transistor 91. The other end of resistor 157 is connected to bus 199. The other end of resistor 159 is connected to circuit ground. The emitter of PNP transistor 91 is connected to one end of resistor 163. The other end of resistor 163 is connected to one end of resistor 161 and to the negative side of capacitor 119. The other end of resistor 161 and the positive side of capacitor 119 are connected to bus 199. The collector of PNP transistor 91 is connected to one end of resistor 165, one end of resistor 171 and the negative side of capacitor 129. The other end of resistor 165 is connected to circuit ground. The positive side of capacitor 129 is connected to one end of resistor 169 and to the drain of FET 107. The other end of resistor 169 and the source of FET 107 are connected to bus 201. The other end of resistor 171 and one side of capacitor 131 are connected to one side of capacitor 133. The other side of capacitor 131 is connected to bus 201. The other side of capacitor 133, one end of resistor 173 and one end of resistor 175 are connected to the base of PNP transistor 93. The other end of resistor 173 is connected to bus 201. The other end of resistor 175 and one end of resistor 177 are connected to one side of capacitor 135. The other side of capacitor 135 is connected to bus 201. The emitter of PNP transistor 93 is connected to the base of transistor 95 and to one end of resistor 179. The other end of resistor 179 is connected to bus 201. The collector of transistor 93, the other end of resistor 177, the collector of PNP transistor 95, one end of resistor 185, and one side of capacitor 141 are connected to one side of capacitor 143. The other side of resistor 185 is connected to circuit ground. The other side of capacitor 141 is connected to $V_{cc}$. The emitter of PNP transistor 95 is connected to one end of resistor 181. The other end of resistor 181 is connected to bus 201. The other side of capacitor 143 and one end of resistor 187 are connected to the base of PNP transistor 99. The other end of resistor 187, the base of PNP transistor 97, and one end of resistor 191 are connected to the collector of PNP transistor 97. The other end of resistor 191 is connected to circuit ground. The emitter of PNP transistor 97 is connected to one end of resistor 189. The other end of resistor 189 is connected to $V_{cc}$. The emitter of PNP transistor 99 is connected to one end of resistor 193. The other end of resistor 193 is connected to $V_{cc}$. The collector of PNP transistor 99 and the base of NPN transistor 103 are connected to the cathode of diode 108. The anode of diode 108 and one end of potentiometer 145 are connected to the base of PNP transistor 101. The other end of potentiometer 145 is connected to circuit ground. The arm of potentiometer 145 constitutes output 41 of bandpass amplifier 15. The collector of NPN transistor 103 is connected to one end of resistor 195. The other end of resistor 195 is connected to $V_{cc}$. The emitter of NPN transistor 103 and the emitter of PNP transistor 101 are connected together and constitute output 17 of bandpass amplifier 15. The collector of PNP transistor 101 is connected to circuit ground. The gate of FET 105 and the gate of FET 107 are connected together and constitute AGC input 25 of bandpass amplifier 15.

Bus 201 is connected to $V_{cc}$ through resistor 183. Bus 199 is connected to bus 201 through resistor 167. Capacitors 121, 123 are connected in parallel between bus 199 and circuit ground, with the positive side of capacitor 121 facing toward bus 199. Capacitors 125, 127 are connected in parallel between bus 201 and circuit ground with the positive side of capacitor 127 facing toward bus 201. Capacitors 137, 139 are connected in parallel between $V_{cc}$ and circuit ground, the positive side of capacitor 137 facing toward $V_{cc}$.

In accordance with the operation of bandpass amplifier 15 as just described, NPN transistor 89 is a common base input stage for amplifier 15 which is well-suited for use with a dynamic microphone. The output of the transistor 89 stage is shunted by FET 105 which constitutes part of AGC circuitry of bandpass amplifier 15. The output of NPN transistor 89 is then fed through capacitor 117 into transistor 91 which provides common emitter amplification to the signal. The output of the transistor 91 stage is shunted by FET 107 whereby a wider range of AGC is obtained. The output of the transistor 91 stage is then fed through capacitor 133 into a Darlington common emitter amplifier including transistors 93, 95. Temperature compensation is provided to the output of the Darlington amplifier by PNP transistor 97. Large-signal amplification is then provided by PNP transistor 99. Power amplification is then provided to the output of the large-signal amplifier by transistors 103, 101. Potentiometer 145 provides fine adjustment for output 41 so as to permit calibration of the gain of bandpass amplifier 15 with respect to limiting amplifier 45.

Referring to FIG. 4, of triggering bandpass amplifier 15 of the preferred embodiment includes the following components:

| Component Name | Reference Number | Preferred Type or Value |
|---|---|---|
| NPN Transistor | 203 | 2N5172 |
| Diode | 205 | 1N914 |
| Diode | 207 | 1N914 |
| Capacitor | 209 | 0.05 mfd. |
| Capacitor | 210 | 0.05 mfd. |
| Resistor | 211 | 1 Mohm |
| Resistor | 213 | 1 Kohm |
| Resistor | 215 | 10 Mohm |
| All resistors are ¼ watt. | | |

The components of triggering envelope detector 19 of FIG. 4 are connected together as follows: One side of capacitor 209 and the anode of diode 205 are connected to the cathode of diode 207. The other side of capacitor 209 constitutes input 18 of triggering envelope detector 19. The cathode of diode 205 is connected to circuit ground. The anode of diode 207, one side of capacitor 210 and one end of resistor 211 are connected to the base of NPN transistor 203. The other side of capacitor 210 and the other end of resistor 211 are connected to circuit ground. The collector of NPN transistor 203 is connected to one end of resistor 213. The other end of resistor 213 is connected to $V_{cc}$. The emitter of NPN transistor 203 is connected to one end of resistor 215 and constitutes output 21 of triggering envelope detector 19. The other end of resistor 215 is connected to circuit ground.

According to the operation of triggering envelope detector 19 as shown in FIG. 4, capacitor 209 blocks any dc component of the signal transmitted to envelope detector 19 from bandpass amplifier 15. Diodes 205, 207 perform half-wave rectification on the signal provided at input 18. The ac component of the halfwave is filtered to some extent by capacitor 210. NPN transistor 203 provides a common emitter output stage for envelope detector 19.

Referring to FIG. 5, pulse generation circuit 23 of the preferred embodiment includes the following components:

| Component Name | Reference Number | Preferred Type or Value |
|---|---|---|
| NPN Transistor | 217 | 2N5172 |
| NPN Transistor | 219 | 2N5172 |
| PNP Transistor | 221 | 2N4125 |
| Capacitor | 223 | 0.047 mfd. |
| Resistor | 225 | 100 Kohm |
| Resistor | 227 | 100 Kohm |
| Resistor | 229 | 4.7 Kohm |
| Resistor | 231 | 22 Kohm |
| Resistor | 233 | 22 Kohm |
| Resistor | 235 | 47 Kohm |
| Resistor | 237 | 47 Kohm |
| All resistors are ¼ watt. | | |

The components of pulse generation circuit 23 of FIG. 5 are connected as follows: One side of capacitor 223 and one end of resistor 225 are connected to the base of NPN transistor 217. The other side of capacitor 223 constitutes input 22 of pulse generation circuit 23. The other end of resistor 225 is connected to circuit ground. The collector of NPN transistor 217, one end of resistor 227 and one end of resistor 231 are connected to the base of NPN transistor 219. The other end of resistor 227 is connected to $V_{cc}$. The other end of resistor 231 is connected to circuit ground. The emitter of NPN transistor 217 and the emitter of NPN transistor 219 are connected to one end of resistor 229. The other end of resistor 229 is connected to circuit ground. The collector of NPN transistor 219 and one end of resistor 233 are connected to the base of PNP transistor 221. The other end of resistor 233 and the emitter of PNP transistor 221 are connected to $V_{cc}$. The collector of PNP transistor 221 and one end of resistor 235 are connected to one end of resistor 237. The other end of resistor 235 is connected to circuit ground. The other end of resistor 237 constitutes output P of pulse generation circuit 23.

According to the operation of pulse generation circuit 23 as shown in FIG. 5, NPN transistors 217, 219, operate as a Schmitt trigger circuit for providing a pulse at the collector of transistor 219 on a positive-going transistion of a signal applied at input 22. Transistor 221 provides common emitter amplification for the output of the Schmitt trigger circuit. When the Schmitt trigger circuit is quiescent, transistor 217 will be OFF, transistor 219 will be ON and transistor 221 will be saturated whereby output P will be high. Thus, the pulse provided by pulse generation circuit 23 will be a negative-going pulse.

Pulse generation circuit 23 of the preferred embodiment may include means for manually generating pulses. Referring to FIG. 5, such manual pulse generation means includes switch 220 connected between $V_{cc}$ and the collector of transistor 221 and momentary switch 222 connected between output P and circuit ground. Thus, by closing switch 220, output P is held high regardless of the sound received by sound receiving circuit 13, but negative-going pulses can be generated manually by closing switch 222. Such a feature enables generation of pulses when no distinct hammer sound can trigger the pulse generation circuit properly; e.g., when the hammer is visible but the blows are inaudible, or when background noises are excessive.

Referring to FIG. 6, AGC amplifier 27 of the preferred embodiment includes the following components:

| Component Name | Reference Number | Preferred Type or Value |
|---|---|---|
| NPN Transistor | 239 | 2N5172 |
| Transistor | 241 | 2N5172 |
| NPN Transistor | 243 | 2N5172 |
| NPN Transistor | 245 | 2N5172 |
| Diode | 247 | 1N914 |
| Potentiometer | 249 | 100 Kohm |
| Resistor | 251 | 100 Kohm |
| Resistor | 253 | 470 Kohm |
| Resistor | 255 | 33 Kohm |
| Resistor | 257 | 33 Kohm |
| All resistors are ¼ watt. | | |

The components of AGC amplifier 27 of FIG. 6 are connected together as follows: The collectors of NPN transistors 239, 241 are connected to $V_{cc}$. The bases of transistors 239, 241 constitute inputs 29, 31, respectively, of AGC amplifier 27. The emitter of transistors 239, 241 are connected to one end of resistor 251. The other end of resistor 251 and one end of resistor 255 are connected to the emitter of transistor 243. The other end of resistor 255 is connected to circuit ground. The base of transistor 243, the base of transistor 245 and the emitter of transistor 245 are connected to one end of potentiometer 249. The other end of potentiometer 249 is connected to $V_{cc}$. The arm of potentiometer 249 is connected to the cathode of diode 247. The anode of diode 247 and the collector of transistor 243 are connected to one end of resistor 253 and constitute output 33 of AGC amplifier 27. The emitter of transistor 245 is connected to one end of resistor 257. The other end of resistor 257 is connected to circuit ground.

In accordance with the operation of AGC amplifier 27 as shown in FIG. 6, transistors 239, 241 constitute the input for transistor 243 which constitutes the amplification stage for AGC amplifier 243. The AGC amplifier output will follow the greater of the signals supplied at inputs 29, 31. Transistor 243 is biased for saturation when there is no input from neither transistor 239 nor transistor 241. As a result, FETs 105, 107, which constitute the AGC circuitry in bandpass amplifier 15, will be cut off. When either or both transistors 239, 241 apply a voltage across resistor 251, additional current will flow through resistor 255 causing the collector voltage of transistor 243 to increase. Such increase in the collector voltage of transistor 243 will cause FETs 105, 107 of bandpass amplifier 15 to turn on and reduce the gain of bandpass amplifier 15. Transistor 245 provides temperature compensation for AGC amplifier 27. Diode 247 clamps the collector voltage of transistor 243 thus limiting the maximum gain of AGC amplifier 27.

Referring to FIG. 7, limiting envelope detector 51 of the preferred embodiment includes the following components:

| Component Name | Reference Number | Preferred Type or Value |
|---|---|---|
| NPN Transistor | 259 | 2N5172 |
| Diode | 261 | 1N914 |
| Diode | 263 | 1N914 |
| Capacitor | 265 | 0.05 mfd. |
| Electrolytic Capacitor | 267 | 0.05 mfd. |
| Resistor | 269 | 1 Mohm |
| Resistor | 271 | 1 Kohm |
| Resistor | 273 | 10 Kohm |
| All resistors are ¼ watt. | | |

The components of limiting envelope detector circuit 51 of FIG. 7 are connected together as follows: One side of capacitor 265 and the anode of diode 261 are connected to the cathode of diode 263. The other side of capacitor 265 constitutes input 53 of limiting envelope detector 51. The cathode of diode 261 is connected to circuit ground. The anode of capacitor 263, the positive side of capacitor 267 and one end of resistor 269 are connected to the base of transistor 259. The negative side of capacitor 267 and the other end of resistor 269 are connected to circuit ground. The collector of transistor 259 is connected to one end of resistor 271. The other end of resistor 271 is connected to $V_{cc}$. The emitter of transistor 259 is connected to one end of resistor 273 and constitutes output 55 of limiting envelope detector 51. The other side of resistor 273 is connected to circuit ground.

The configuration of limiting envelope detector 51 as shown in FIG. 7 operates in the same fashion as triggering envelope detector 19.

Referring to FIG. 8, limiting amplifier 45 of the preferred embodiment includes the following components:

| Component Name | Reference Number | Preferred Type or value |
|---|---|---|
| NPN Transistor | 275 | 2N5172 |
| NPN Transistor | 277 | 2N5172 |
| NPN Transistor | 279 | 2N5172 |
| Capacitor | 281 | 0.22 mfd. |
| Resistor | 283 | 220 Kohm |
| Resistor | 285 | 220 Kohm |
| Resistor | 287 | 10 Kohm |
| Resistor | 289 | 2.2 Kohm |
| Resistor | 291 | 39 Kohm |
| Resistor | 293 | 10 Kohm |
| Resistor | 295 | 10 Kohm |
| Resistor | 297 | 1 Kohm |
| All resistors are ¼ watt. | | |

The components of limiting amplifier 45 of FIG. 8 are connected as follows: One side of capacitor 281, one end of resistor 283 and one end of resistor 285 are connected to the base of transistor 275. The other side of capacitor 281 constitutes input 47 of limiting amplifier 45. The other end of resistor 283 is connected to $V_{cc}$. The other end of resistor 285 is connected to circuit ground. The collector of transistor 275 is connected to $V_{cc}$. The emitter of transistor 275, one end of resistor 287 and one end of resistor 293 are connected to the base of transistor 279. The other end of resistor 287 is connected to circuit ground. The other end of resistor 293, one end of resistor 291 and the collector of transistor 277 are connected to the base transistor 277. The other end of resistor 291 is connected to $V_{cc}$. The emitter of transistor 277 is connected to one end of resistor 289. The other end of resistor 289 is connected to circuit ground. The collector of transistor 279 is connected to one end of resistor 295 and constitutes output 49 of limiting amplifier 45. The other end of resistor 295 is connected to $V_{cc}$. The emitter of transistor 279 is connected to one end of resistor 297. The other end of resistor 297 is connected to circuit ground.

According to the operation of limting amplifier 45 as shown in FIG. 8, capacitor 281 blocks the dc component of the signal provided at input 47. Transistor 275 provides a common emitter input stage for amplifier 45 and transistor 279 provides a common collector output stage for amplifier 45. The limiting function of amplifier 45 is provided by transistor 277.

Referring to FIG. 9, first AGC control network 35 of the preferred embodiment includes the following components:

| Component Name | Reference Number | Preferred Type or Value |
|---|---|---|
| Diode | 299 | 1N914 |
| Capacitor | 301 | 22 mfd. |
| Resistor | 303 | 22 Mohm |
| Resistor | 305 | 680 Kohm |
| Resistor | 307 | 1.2 Mohm |
| Resistor | 309 | 8.2 Mohm |

All resistors are ¼ watt. Network 35 also includes single-pole, single-throw slide switches 311, 313, 315.

The components of first AGC control network 35 of FIG. 9 are connected together as follows. The cathode of diode 299 constitutes input 37 of first AGC control network 35. The anode of diode 299, the positive side of capacitor 301 and one end of resistor 303 are connected to one end of resistor 305 and constitute output 39 of first AGC control network 35. The negative side of capacitor 301 and the other end of resistor 303 are connected to circuit ground. The other end of resistor 305 is connected to one terminal of switch 311 and to one end of resistor 307. The other end of resistor 307 is connected to one terminal of switch 313 and to one end of resistor 309. The other end of resistor 309 is connected to one terminal of switch 315. The other terminals of switches 311, 313, 315 are all connected to circuit ground.

According to the operation of first AGC control network 35 as shown in FIG. 9, if switches 311, 313, 315 are all open, capacitor 301 will charge to the peak value of the signal at input 37 as such signal increases and will discharge slowly through resistor 303 as the signal at input 37 decreases. The rate of discharge can be increased by closing switch 315, can be further increased by closing switch 313, and can be even further increased by closing switch 311. Such rate of discharge of capacitor 301 constitutes the discharge rate of control network 35.

Referring to FIG. 10, averaging circuit 57 of the preferred embodiment includes the following components:

| Component Name | Reference Number | Preferred Type or Value |
|---|---|---|
| Electrolytic Capacitor | 317 | 0.047 mfd. |
| Potentiometer | 319 | 1 Mohm |
| Resistor | 321 | 47 Kohm |
| All resistors are ¼ watt. | | |

The components of averaging circuit 57 as shown in FIG. 10 are connected together as follows: The arm of potentiometer 319 is connected to one end of potentiometer 319 and constitutes input 59 of averaging circuit 57. The other end of potentiometer 319 is connected to one end of resistor 321. The other end of resistor 321 is connected to the positive side of capacitor 317 and constitutes output 61 of averaging circuit 57. The negative side of capacitor 317 is connected to circuit ground.

According to the operation of averaging circuit 57 as shown in FIG. 10, capacitor 317 will charge to the average signal level at input 59 through resistor 321 and the resistance between the other end of potentiometer 319.

4. Computing Circuit a. General Functional Description

In accordance with the operation of the detection circuit of the preferred embodiment of the apparatus of the invention as described supra, when the apparatus is properly positioned with respect to a pile driving hammer, the power is turned on, i.e., switch 3 is closed, and switches 311, 313, 315 are properly adjusted, a positive-going pulse will be produced at P substantially simultaneously with the occurrence of each blow delivered by the hammer. Oridinarily, such a hammer will deliver blows continuously over a period of several hours with a period of more than 0.8 seconds and less than 2.25 seconds between each blow. Thus, the detection circuit will produce a continuous train of positive-going pulses, hereinafter referred to as "blow pulses", at P. Because each of such blow pulses is produced substantially simultaneously with the occurrence of a blow delivered by the hammer, the time differential between consecutive blow pulses will be substantially the same as the time differential between the blows corresponding to such blow pulses. Thus, in accordance with the equation set forth in the Introduction to this Detailed Description, the stroke of a blow in feet may be approximated as:

$$4.01t^2-0.3$$

where t is the time between the blow pulse corresponding to such blow and the blow pulse corresponding to the immediately preceding blow.

Thus, using the blow pulses provided at P by the detection circuit, the computing circuit calculates the stroke for a blow. In the computing circuit of the preferred embodiment of the invention, such calculation is accomplished by generating a quantity of squaring pulses after a blow pulse ("BP1"), the number of squaring pulses generated at time $t_a$ after BP1 being approximately equal to $40.1t_a^2$ where $t_a$ is measured in seconds. As they are generated, these pulses are used to clock up a stroke counter, preferably having a BCD count output, preset to a count of minus 3 at about the time of BP1. Thus, at time $t_a$, the count of the stroke counter will be $40.1t_a^2-3$. At the time of the next blow pulse ("BP2"), $t_a$ equals the time t in seconds between BP1 and BP2. Thus, at the time of BP2, the count of the stroke counter will be $40.1t^2-3$ which is approximately equal to the stroke of the blow corresponding to BP2 in units of tenths of feet. A digital indication of such stroke, therefore, is provided at the BCD count output of the stroke counter. By latching the count of the stroke counter at the time of BP2 into a digital display, a readout of the approximate stroke of a blow can be provided almost simultaneously with the occurrence of such blow. By properly positioning a decimal point on such a display, the readout will provide the stroke in units of feet, e.g., where the count output of the stroke counter is 100, representing the stroke in tenths of feet, the decimal point on the display can be positioned to the left of the least significant digit thus providing a readout of 10.0, representing the stroke of the blow corresponding to BP2 in units of feet.

In the preferred embodiment of the invention, the computing circuit calculates the stroke for each blow of a series of consecutive blows in the manner set forth generally in the preceding paragraph and calculates the average stroke for the blows of such series in accordance with a blow sequence. The computing circuit operates in a continuous chain of blow sequences each of which includes three operation modes:

(1) a reset mode during which various counters and flip-flops of the computing circuit are cleared or otherwise preset to a desired state or count in preparation of the remaining modes of the blow sequence;

(2) a B mode during which the stroke for each blow occurring during such B mode is calculated and a digital indication of such stroke is provided, such digital indication being provided momentarily approximately simultaneously with the provision of the blow pulse corresponding to such blow by the detection circuit; and (3) an A mode during which the average stroke for all the blows for which the stroke was calculated during the immediately preceding B mode is calculated and a digital indication of such average stroke is provided, such digital indication being provided momentarily at the end of the calculation of such average stroke.

A reset mode of a calculation sequence is initiated automatically (1) when the power is turned on, i.e., when switch 3 is closed, and (2) immediately after the completion of an average stroke calculation; and ends automatically slightly after the first blow pulse provided at P by the detection circuit after the reset period is initiated. Such blow pulse in essence initiates calculation by the computing circuit and, therefore, will sometimes hereinafter be referred to as the initiating blow pulse.

Immediately after the end of each reset mode, i.e., after each initiating blow pulse, a B mode will begin by presetting the stroke counter to a count of minus 3. The computing circuit will then generate a quantity of squaring pulses, the number of such squaring pulses generated at time $t_a$ after the initiating blow pulse ("PBϕ") and before the first blow pulse during the B mode ("BP1") being approximately equal to $40.1t_a^2$. As such squaring pulses are generated, they are used to clock up the stroke counter. Thus, at time $t_a$ after BPϕ, the count of the stroke counter will be $40.1t_a^2-3$; and at the time of BP1, the count of the stroke counter will be $40.1t_1^2-3$ where $t_1$ is the time interval between BPϕ and BP1. In accordance with the discussion supra, the count $40.1t_1^2-3$ will be approximately equal to the stroke of the blow corresponding to BP1 in units of tenths of feet.

Unless BP1 terminates the B mode as described infra, in which case BP1 would be a "terminating blow pulse", the stroke counter will again be set to a count of minus 3 immediately after BP1 and a quantity of squaring pulses will be generated, the number of such squaring pulses generated at time $t_b$ after BP1 being approximately equal to $40.1\ t_b^2$. Such squaring pulses clock up the stroke counter as they are generated. Thus, at the time of the next blow pulse ("BP2"), the count of the stroke counter will be $40.1t_2^2-3$ where $t_2$ is the time interval between BP1 and BP2. This count will be approximately equal to the stroke of the blow corresponding to BP2 in units of tenths of feet.

This sequence will be followed until such B mode is terminated. Thus, at the time of BPn, where BPn is the nth blow pulse after the initiating blow pulse of the immediately preceding reset mode, the count of the stroke counter will be $40.1t_n^2-3$ where $t_n$ is the time between the nth blow pulse and the immediately preceding blow pulse. As a result, the approximate stroke of each blow producing a blow pulse during a B mode will be calculated by the computing circuit and a digital indication thereof will be provided at the time of the blow pulse corresponding to such blow. It should be noted that such indication is provided only momentarily at the time of the blow pulse corresponding to such blow.

In order to store the stroke values of the blows occurring during a "B" mode so that an average stroke can be computed during the subsequent A mode, the squaring pulses generated during a B mode clock up an accumulating counter which is reset during the reset mode and, therefore, at the beginning of each B mode, has a count equal to zero. Thus, at the time of BPn, the count of the accumulating counter is approximately equal to:

$$\sum_{i=1}^{i=n} 40.1t_i^2$$

and at time $t_z$ after BPn and prior to BPn+1, the count of the accumulating counter is approximately equal to:

$$[\sum_{i=1}^{i=n} 40.1t_i^2] + 40.1t_z^2$$

Furthermore, in order to provide a divisor for such average stroke computation, each blow pulse occuring during a B mode clocks up a blow counter which is reset during the reset mode and, therefore, has a count of zero at the beginning of each B mode. Thus, at the time of BPn, the count of the blow counter will be n.

A B mode will be terminated upon one of three events: (1) the occurrence of the $m^{th}$ blow pulse (the "normal terminating blow pulse") during such B mode, i.e., when n=m, m being a predetermined number manufactured into the computing circuit (in the preferred embodiment m=999); (2) the occurrence of the first blow pulse (the "manual terminating blow pulse") after the delivery of an "average command", such command being delivered by manually operating a switch during such B mode; and (3) when the count of the stroke counter becomes equal to a predetermined value referred to as $S_{max}$ (in the preferred embodiment, $S_{max}=199$).

With regard to the third B mode terminating event set forth in the preceding paragraph, it should be noted that when the count of the stroke counter is equal to $S_{max}$, the time $t_{max}$ that has passed since the last blow pulse is approximately equal to:

$$\sqrt{\frac{S_{max}+3}{40.1}}$$

Thus, where $S_{max}=199$, $t_{max}\sim=2.25$, which, as indicated supra, ordinarily is greater than the maximum time between consecutive blows for a pile driving hammer. As a result, a count of 199, which may result from shutting the hammer down or a failure of the detection circuit to provide a blow pulse for a blow, ordinarily will be invalid. Where such a count appears in the stroke counter during a B mode, such B mode will be terminated so that the invalid count will not be included in the average computation of the subsequent A mode. Therefore, the third B mode terminating event set forth in the preceding paragraph will be referred to as an "error detection".

Immediately after one of the B mode terminating events, an A mode will begin. During each A mode, the average stroke for the blows occurring during the immediately preceding B mode will be approximated by dividing the count of the accumulating counter at the time of the last blow pulse of the immediately preceding B mode, such count referred to as the "dividend count", by the number of blow pulses occurring during such B mode, such count referred to as the "sequence blow count", and subtracting three from the quotient. In this regard, it should be noted that since the stroke in units of tenths of feet for a blow can be approximated as:

$$40.1t^2-3$$

where t is the time between the blow pulse corresponding to such blow and the blow pulse corresponding to the immediately preceding blow, the average stroke for a series of p blows can be approximated as:

$$[\sum_{i=1}^{i=p} 40.1t_i^2 - 3]/p$$

which can be restated as $$[[\sum_{i=1}^{i=p} 40.1t_i^2]/p] - 3$$

where $t_i$ is the time between the blow pulse corresponding to the $i^{th}$ blow of the series and the blow pulse corresponding to the immediately preceding blow. As indicated supra, the count of the accumulating counter at the time of the $n^{th}$ blow pulse, i.e., $BP_n$, during a B mode is:

$$\sum_{i=1}^{i=n} 40.1t_i^2$$

Thus, the dividend count of a B mode during which p blows occurred will be:

$$\sum_{i=1}^{i=p} 40.1t_i^2$$

The result of dividing this count by the sequence blow count, which will be the number of blows occurring during such B mode, i.e., and subtracting three from the quotient is:

$$[[\sum_{i=1}^{i=p} 40.1t_i^2]/p] - 3$$

which, as noted above, is an approximation of the average stroke of the blows occurring during the B mode.

In order to calculate the average stroke of a B mode in accordance with this method, the dividend count of such B mode must be provided. Where such B mode was terminated by a terminating pulse, no time passes between the last blow pulse of such B mode and the beginning of the A mode. As a result, the count of the accumulating counter at the beginning of an A mode following a B mode terminated by a terminating pulse will be the dividend count. Thus, the dividend count is provided by the accumulating counter at the beginning of such A mode.

Where such B mode was terminated by an error detection, however, time $t_{max}$ will have passed between the last blow pulse and the beginning of the A mode whereby the count of the accumulating counter will be:

$$[\sum_{i=1}^{i=p} 40.1t_i^2] + 40.1t_{max}^2$$

In such a case, the dividend count can be provided by subtracting an amount equal to t 40.1 $t_{max}2$ from the accumulating counter. Because at the time of an error detection the count of the stroke counter will be:

$$S_{max}=40.1t_{max}2-3$$

the dividend count is provided in the preferred embodiment by subtracting the count in the stroke counter from the count in the accumulating counter, and then subtracting the constant 3 from the accumulating counter. After such subtraction, the count of the accumulating counter will be:

$$[\sum_{i=1}^{i=m} 40.1t_1^2] + 40.1t_{max}^2 - [40.1t_{max}^2 - 3] - 3 = \sum_{i=1}^{i=m} 40.1t_i^2$$

which is the dividend count.

Such subtraction is accomplished in the computing circuit of the preferred embodiment of the apparatus of the invention by simultaneously clocking down the accumulating counter and the stroke counter using the same clock signal until the count of the accumulating counter reaches zero, at which time 40.1 $t_{max}2-3$ will have been subtracted from the accumulating counter and the count of the accumulating counter will be:

$$[\sum_{i=1}^{i=m} 40.1t_i^2] + 3$$

The stroke counter is then loaded with a count of minus three and the accumulating counter is clocked down while the stroke counter is clocked up, the clocking of both counters being provided by the same clock signal, until the count of the stroke counter equals zero. At such time, the count of the accumulating counter will be:

$$\sum_{i=1}^{i=m} 40.1t_i^2$$

which is the dividend count. The procedure of subtracting from the count of the accumulating counter in order to provide the dividend will only occur during an A mode if the preceding B mode was terminated by an error detection and such procedure will be referred to as the "error correcting" phase of the A mode.

Once the count of the accumulating counter becomes equal to the dividend count, whether at the beginning of the A mode or after an error correcting phase, the "dividing phase" of the A mode will begin. At the beginning of such dividing phase, a dividing counter will be loaded with a count equal to the sequence blow counter and the stroke counter will be loaded with a count of 3. The accumulating counter and the dividing counter will then be clocked down simultaneously by the pulses of a clock signal until the count of the accumulating counter equals zero, at which time the dividing phase will end. Whenever, during such dividing phase, the count of the dividing counter becomes zero, a divider pulse will be produced, the dividing counter will be reloaded with the sequence blow count, and the clocking down will continue. Thus, during the dividing phase, there will be a divider pulse for every p pulses of the clock signal where p equals the sequence blow count. Because, during the dividing phase, the accumulating counter will count down from the dividend count to zero, the number of pulses of the clock signal during a dividing phase will be equal to the dividend count. Thus, the number of divider pulses produced during the dividing phase will be equal to the dividend count divided by the sequence blow count, i.e.:

$$[\sum_{i=1}^{i=p} 40.1t_i^2]/p$$

During the dividing phase, the divider pulses are used to stock up the stroke counter whereby at the end of such dividing phase, i.e., when the count of the accumulating counter becomes zero, the count of the stroke counter will be:

$$[[\sum_{i=1}^{i=m} 40.1t_i^2]/m] - 3$$

which is the approximation of the average stroke for all the blows occurring during the B mode of the blow sequence.

Thus, when the count of the accumulating counter becomes equal to zero, a digital indication of an average stroke will be provided and, immediately thereafter, the reset mode of a new blow sequence will begin.

In accordance with the foregoing description of the blow sequence, it can be seen that if no average command is delivered by an operator by manually operating a switch and if the count of the stroke counter does not become $S_{max}$, the computing circuit will perform a continuous chain of blow sequences each including a reset mode followed by a B mode during which m blows occur and the stroke for each of such blows is calculated. After the $m^{th}$ blow, an A mode begins during which the average stroke for the m blows occurring during the preceding B mode is calculated. Such A mode includes only a dividing phase, i.e., there is no error correcting phase during such A mode.

If, however, during some B mode, the operator wishes to calculate a stroke average before m blows have occurred, the operator may deliver an average command. As a result of such command, the computing circuit will begin an A mode after the blow pulse immediately following such command and an average stroke will be calculated for the blows occurring during the shortened B mode. It should be noted that unless the blow following the average command is the $m^{th}$ blow of the B mode, the number of strokes averaged into such average stroke will be less than m. The A mode following an average command will include only a dividing phase.

Furthermore, if during a B mode, the count of the stroke counter becomes $S_{max}$, the computing circuit will switch automatically to the A mode during which there will be an error correcting phase followed by a dividing phase. The average stroke calculated during such A mode will include the strokes for each of the blows occurring during the preceding B mode.

After an average is calculated, the reset mode of a new blow sequence will begin regardless of the event terminating the B mode prior to such average calculation.

The computing circuit of the preferred embodiment of the invention includes two displays: (1) a blow count display and (2) a stroke display. The count of the blow counter will be latched into the blow count display and the count of the stroke counter will be latched into the stroke display whenever a latch command is delivered by the computing circuit. The stroke display has a decimal point that is positioned to the left of the least significant digit so that the value shown on the display will be one-tenth the count latched into such display.

Latch commands are delivered in accordance with a latching format only when the computing circuit is in a display mode. A display mode may be initiated only by the operator either by (1) turning the power on or (2) operating a display command switch. In the preferred embodiment, there are two display command switches: a B switch and an A switch. The only effect of the B switch is to initiate a display mode. The B switch is capable of initiating a display mode at essentially any time during a blow sequence. The A switch not only initiates a display mode, but also simultaneously delivers an average command. The A switch is capable of initiating a display mode only during the B mode or A mode of a blow sequence and is ineffective, i.e., can neither initiate a display period nor deliver an average command, during a reset mode.

Regardless of the manner in which a display mode was initiated, it will always terminate automatically at the beginning of the next reset mode after such initiation. Once a display mode is terminated, a new display mode can be initiated only in one of the manners set forth above.

Thus, it can be seen that a display mode may begin either concurrently with a blow sequence or at some time during a blow sequence and will terminate at the same time such blow sequence terminates.

If a display mode is initiated concurrently with or during the reset mode of a blow sequence, latch commands will be delivered periodically from the initiation of such display mode until the end of such reset mode. In the preferred embodiment, the counts of the blow counter and the stroke counter are set and held at zero and minus 3, respectively, during the reset mode. Thus, if a display mode begins concurrently with or during the reset mode of a blow sequence, the blow count display will read zero and the stroke display will read minus 0.3 from the initiation of such display mode at least until the end of such reset mode.

If a display mode is initiated during a blow sequence and prior to, concurrently with or during the B mode of such blow sequence, a latch command will be delivered substantially concurrently with every nonterminating blow pulse produced during such B mode and after the initiation of such display mode. Thus, the stroke, in feet, of each blow producing a non-terminating blow pulse during such B mode and after the initiation of such display mode, together with the sequential number of such blow in the B mode of such blow sequence, will be displayed substantially simultaneously with the occurrence of such blow.

If a display mode is initiated during a blow sequence and prior to, concurrently with or during the A mode of such blow sequence, a latch command will be delivered at the end of the dividing phase of such A mode, i.e., when the count of the accumulating counter becomes zero at the end of such A mode. Thus, the average stroke of the blows occurring during the B mode of the blow sequence of such A mode, together with the number of blows occurring during such B mode, will be displayed. Because the display mode will end immediately after such average stroke is displayed, i.e., at the beginning of the subsequent reset period, and because no further latch commands can be delivered until a new display mode is initiated, such average stroke will remain displayed until a new display mode is initiated by action of the operator. This will enable the operator to log such average stroke.

In accordance with the foregoing, when the power is turned on, the computing circuit will be in the reset mode of a blow sequence and in the display mode. Thus, the stroke display will provide a reading of minus 3 and the blow count display will read zero. Prior to the first blow after the power is turned on, operation of either switch A or switch B will have no effect.

Immediately after the first blow after the power is turned on, the computing circuit will be in the "B" mode of a blow sequence and, because no average stroke has been calculated, will still be in the display mode. Prior to the second blow, the stroke display will continue to read minus 3 and the blow count display will continue to read zero. At about the time of the second blow, the stroke display will provide a reading representing the approximate stroke of such second blow in feet and the blow count display will read one, representing the sequential number of the second blow in the B mode. For each blow occurring while the computing circuit remains in such B mode, the computing circuit will display the approximate stroke in feet for such blow substantially as it occurs on the stroke display while simultaneously displaying the sequential number of such blow on the blow count display, provided such blow is not the $m^{th}$ blow of such B mode or the first blow after operation of the A switch.

If at some time during such B mode the A switch is operated, the readings of the displays will be retained until some time after the first blow following such operation of the A switch, at which time the stroke display will display the approximate average stroke for all the blows occurring during the last B mode, including the blow after such operation of the A switch, together with the number of blows occurring during such B mode, i.e., the sequence blow count.

If, however, prior to operation of the A switch, the $m^{th}$ blow of such B mode occurs, the readings of the displays immediately prior to the $m^{th}$ blow will be retained until sometime after such $m^{th}$ blow, at which time the stroke display will display the average stroke for all m blows of the B mode and the blow count display will display the number in representing the number of blows occurring during such B mode, i.e., the sequence blow count.

If, prior to such operation of the A switch or such occurrence of the $m^{th}$ blow, the time $t_{max}$ has passed since the most recent blow resulting in an error detection, the readings of the displays immediately prior to such error detection and corresponding to the stroke and sequential number of such last blow will be retained until some time after such error detection, at which time the stroke display will display the average stroke for all the blows occurring during the B mode through the last blow before the error detection and the blow count display will display the sequential number of the last blow before the error detection which represents the number of blows occurring during such B mode, i.e., the sequence blow count.

When, as a result of one of the events of the preceding three paragraphs, an average stroke is displayed in the stroke display, such average stroke, together with the corresponding blow count, will continue to be displayed (assuming the power remains on) until either the A switch or the B switch is operated, the effect of such operation depending to some extent on the mode of a blow sequence within which the computing circuit is operating at the time the switch is operated. If the B switch is operated during a reset mode, the displays will provide readings in the same manner as provided when the power is turned on as described in the preceding four paragraphs. If the B switch is operated during a B mode, the displays will display the stroke and sequential number of each blow as it occurs until the occurrence of one of the events of the preceding three paragraphs, at which time the displays will display an average stroke and sequence blow count as indicated in those paragraphs. If the B switch is operated during an A mode, the readings of the displays prior to operation of the B switch will be retained until the end of such A mode, at which time the average stroke calculated during such A mode will be displayed along with the corresponding sequence blow count. If the A switch is operated during a reset mode, no change in the displays will result. If the A switch is operated during a B mode, the readings of the displays at the time of such operation of the A switch will be retained until some time after the first blow after such operation of the A switch, at which time the stroke display will display the approximate average stroke for all the blows occurring during such B mode, including the blow after such operation of the A switch, together with the sequence blow count of such B mode. If the A switch is operated during an A mode, the result will be the same as if the B switch had been operated.

Furthermore, it should be apparent that when the power is on and the computing circuit is not in a display mode, an average stroke will be displayed in the stroke display and the corresponding sequence blow count will be displayed in the blow count display even though blow pulses are being provided by the detection and the strokes for the blows corresponding to such blow pulses are being calculated by the computing circuit. In order to apprise the operator that the stroke display is showing an average stroke for a prior blow sequence rather than the strokes of the individual blows, the computing circuit of the preferred embodiment includes an indication that the stroke display shows an average stroke, such indication being a display of the letter "A" adjacent the display of the average stroke. Such indication will blink off momentarily as blow pulses are provided by the detection circuit in order to show that the blows are being properly detected by the detection circuit.

In addition to calculating and displaying strokes, average strokes and blow counts, the computing circuit also provides an indication that the stroke of one blow (the "latter blow") differs from that of the immediately preceding blow by at least a predetermined amount x, such indication referred to hereinafter as the "limit warning". Because the strokes of consecutive blows of a hammer ordinarily will vary only slightly, such an indication serves to advise the operator of possible (1) undesirable erratic operation of the hammer and/or (2) failure of the detection circuit, due to sudden and/or excessive background noise, to provide a blow pulse corresponding to a blow. In the preferred embodiment, the limit warning is provided (1) simultaneously with the display of the stroke of the latter blow if such stroke is displayed, i.e., if the computing circuit is in the display mode at the time of the blow pulse corresponding to such latter blow and (2) simultaneously with the display of the average stroke for the "B" mode during which such consecutive blows occurred if such average stroke is displayed, i.e., if the computing circuit is in the display mode at the end of the calculation of such average stroke. By providing the indication with the average stroke display, the computing circuit advises the operator of the possibility that an invalid stroke is included in the average.

In the preferred embodiment of the apparatus of the invention, the limit warning is provided by circuitry that does not affect the operation of the circuitry used in calculating and displaying strokes and stroke averages. For this reason, the general functional operation and the specific component configuration of the circuitry used in providing such indication will be set forth in a separate section at the end of this description.

b. Specific Component Configuration

The specific component configuration of the computing circuit of the preferred embodiment of the invention provides for high efficiency in terms of both speed of computation and cost of components. As a result, such computing circuit operates in a highly integrated fashion with many functions being accomplished simultaneously and many components performing multiple functions. Such integrated operation renders any functional breakdown of such configuration computing circuit somewhat superficial since any number of functional breakdowns are possible. For the purposes of this description and in order to facilitate an understanding of the operation of the complete circuit of the preferred embodiment of the invention, such circuit has been broken down into a variety of functional circuits that are illustrated separately in FIGS. 11 through 26. In so doing, such circuits are given functional names. Such names are intended only as a guide for understanding the operation of the complete circuit. In some cases, one or more of the components involved in performing a particular function may be described as part of a circuit identified as performing a different function. Conversely, one or more components included as part of a circuit identified by a particular functional name may not actually take part in performing such a function. In addition, in order to facilitate an understanding of the overall operation of the computing circuit, interconnections among the various circuits are identified as signals or pulses, each generated by one circuit and supplied to one or more circuits. It should be understood that a signal or pulse is supplied to a point of a circuit by connecting such point to the point of another circuit where such signal or pulse is provided. Furthermore, such signals and pulses are given functional names. Such names, in themselves, are not meant to limit the nature of the signals or pulses provided in any fashion.

Figures 11, 12, 15, 20, 23:
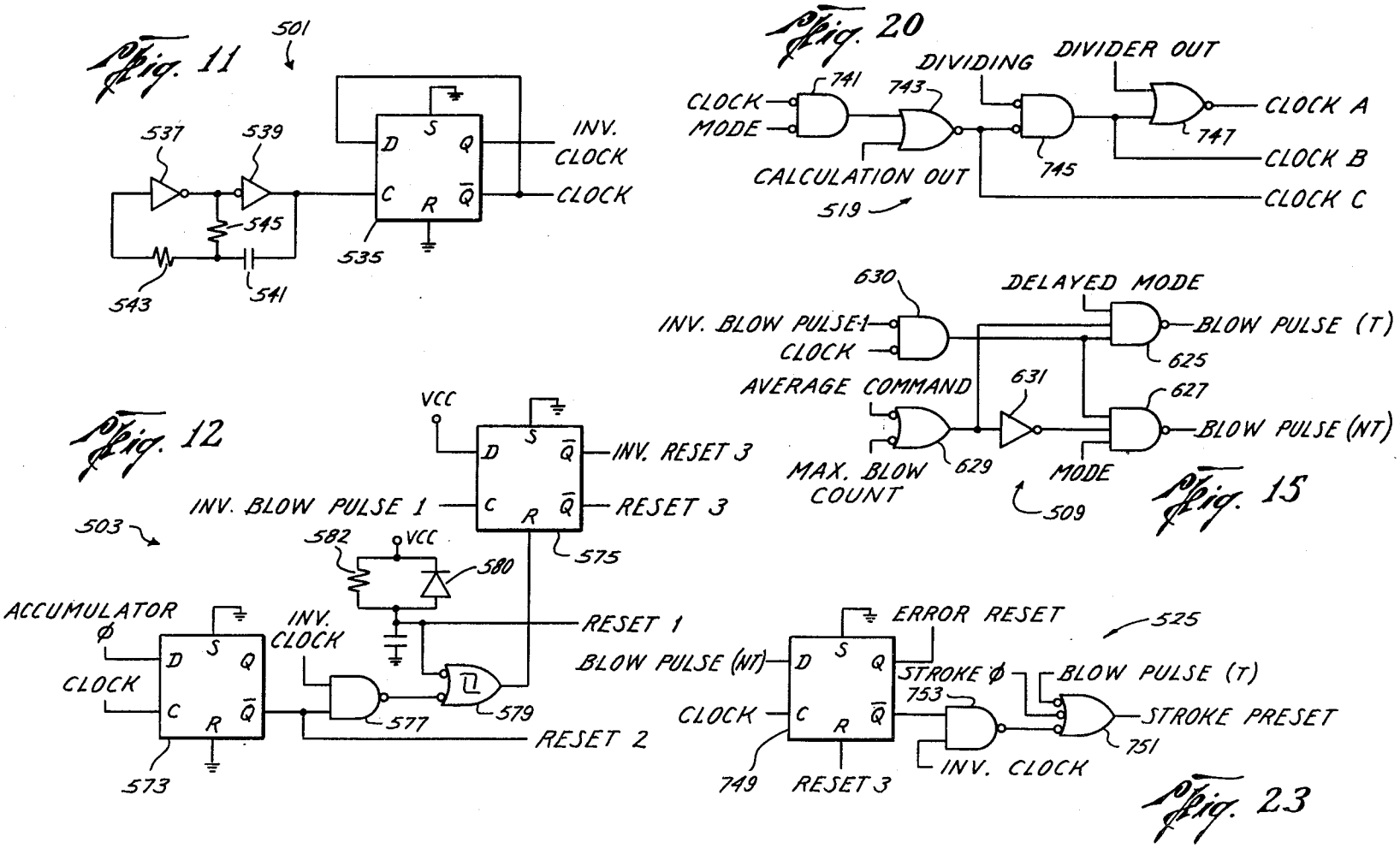
FIG. 11 is an electronic schematic diagram of the clock circuit of the computing circuit of the preferred embodiment of the apparatus of the invention.
FIG. 12 is an electronic schematic diagram of the reset circuit of the computing circuit of the preferred embodiment of the apparatus of the invention.
FIG. 15 is an electronic schematic diagram of the blow pulse gating circuit of the computing circuit of the preferred embodiment of the apparatus of the invention.
FIG. 20 is an electronic schematic diagram of the clock gating circuit of the computing circuit of the preferred embodiment of the apparatus of the invention.
FIG. 23 is an electronic schematic diagram of the stroke counter load circuit of the computing circuit of the preferred embodiment of the invention.
Figure 25:
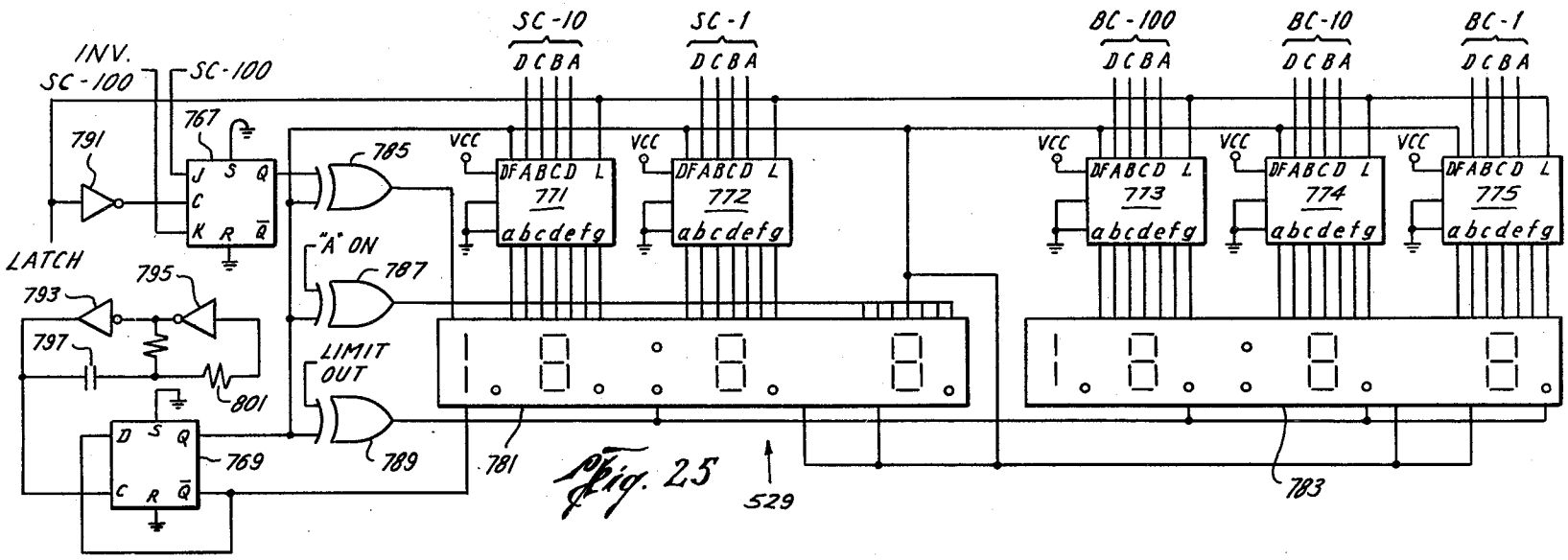
FIG. 25 is an electronic schematic diagram of the display circuit of the computing circuit of the preferred embodiment of the apparatus of the invention.
Figure 13:
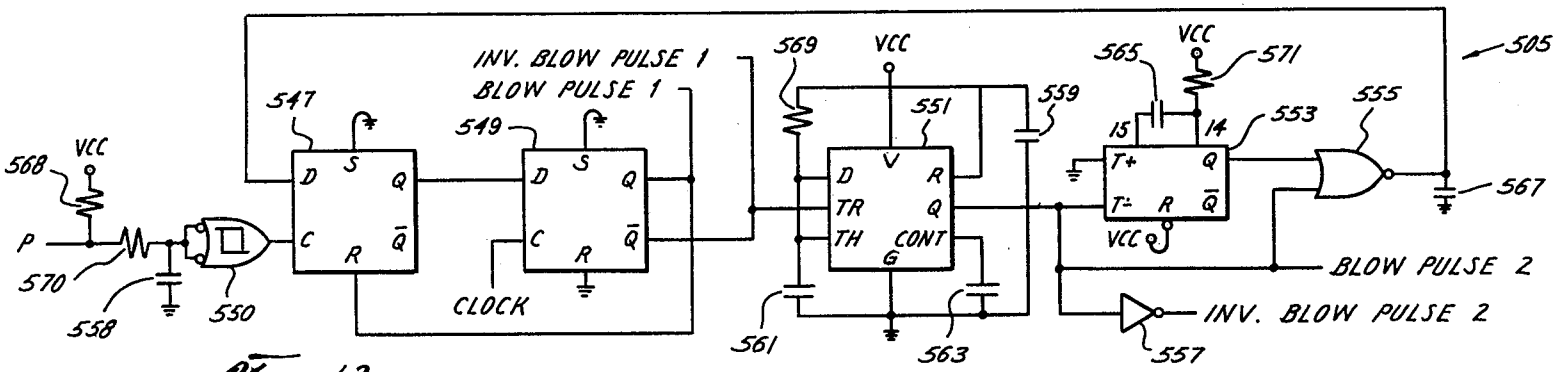
FIG. 13 is an electronic schematic diagram of the pulse input circuit of the computing circuit of the preferred embodiment of the apparatus of the invention.
Figure 18:
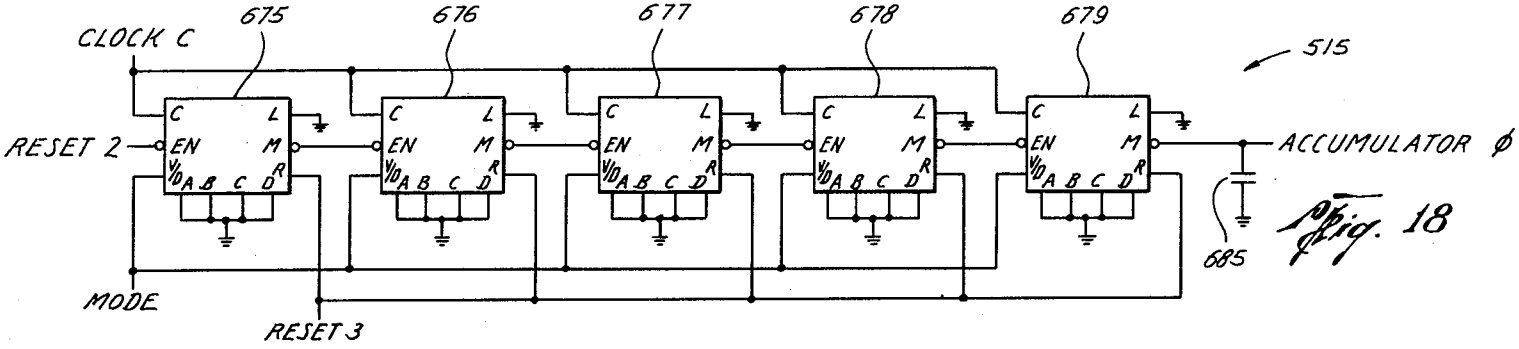
FIG. 18 is an electronic schematic diagram of the accumulator circuit of the computing circuit of the preferred embodiment of the apparatus of the invention.
Figure 14:
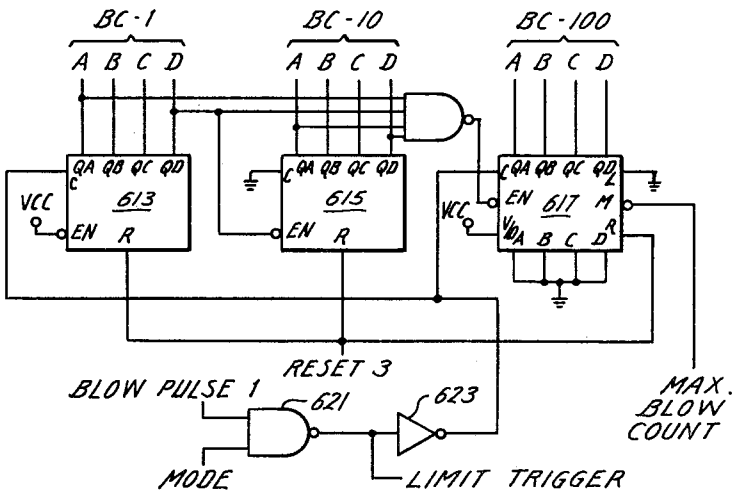
FIG. 14 is an electronic schematic diagram of the blow count circuit of the computing circuit of the preferred embodiment of the apparatus of the invention.
Figure 19:
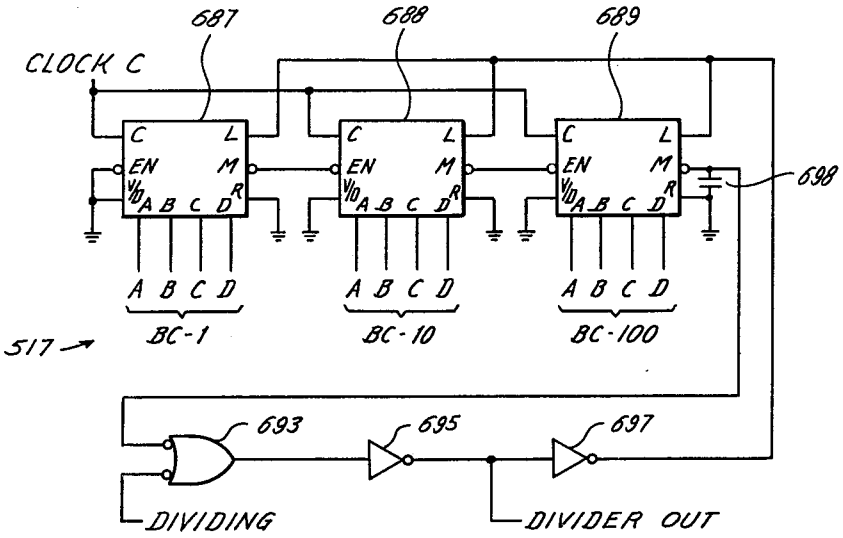
FIG. 19 is an electronic schematic diagram of the divider circuit of the computing circuit of the preferred embodiment of the apparatus of the invention.
Figures 16, 21, 24:
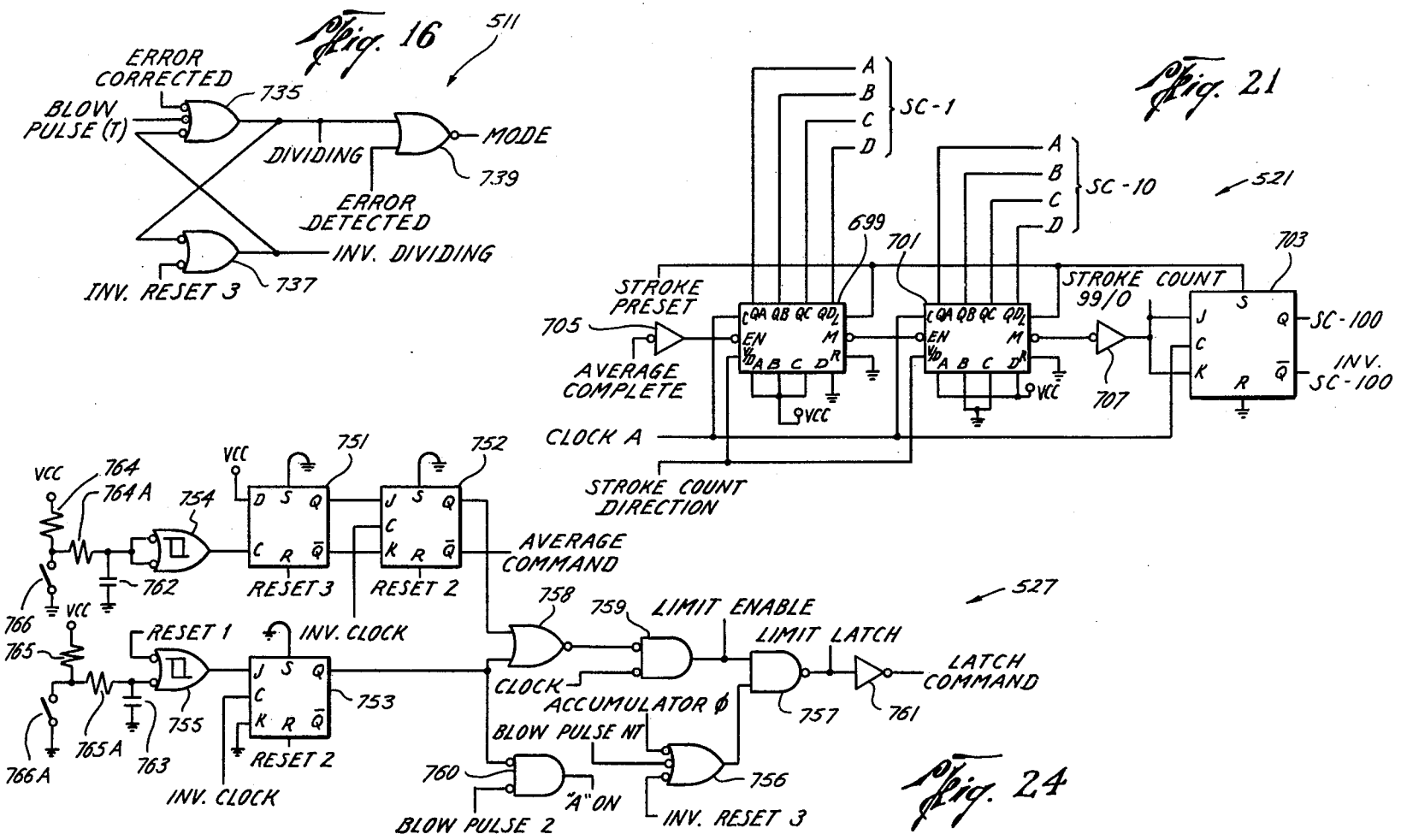
FIG. 16 is an electronic schematic diagram of the mode signalling circuit of the computing circuit of the preferred embodiment of the apparatus of the invention.
FIG. 21 is an electronic schematic diagram of the stroke count circuit of the computing circuit of the preferred embodiment of the apparatus of the invention.
FIG. 24 is an electronic schematic diagram of the display control circuit of the computing circuit of the preferred embodiment of the apparatus of the invention.
Figure 17:
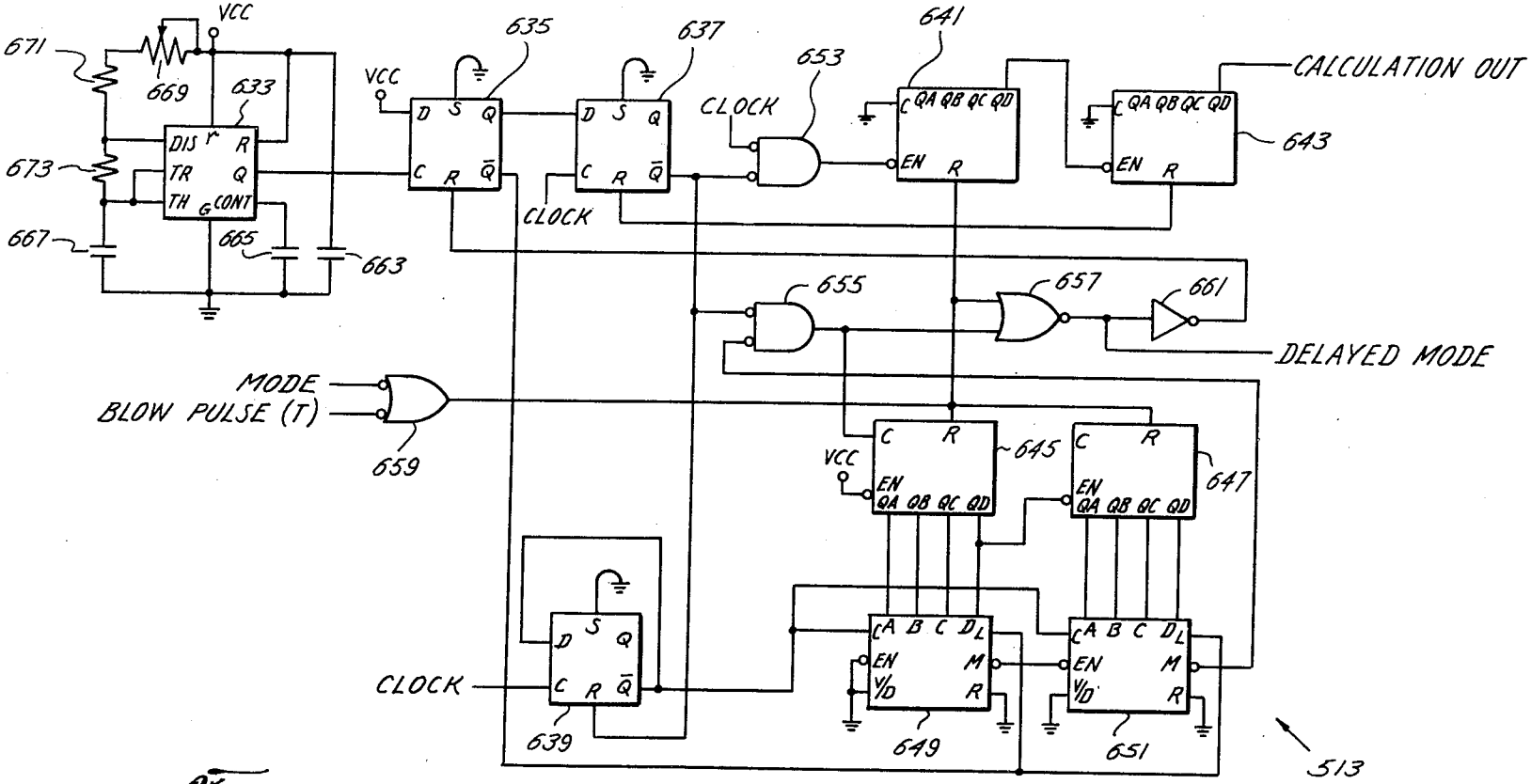
FIG. 17 is an electronic schematic diagram of the calculation circuit of the computing circuit of the preferred embodiment of the apparatus of the invention.
Figure 22:
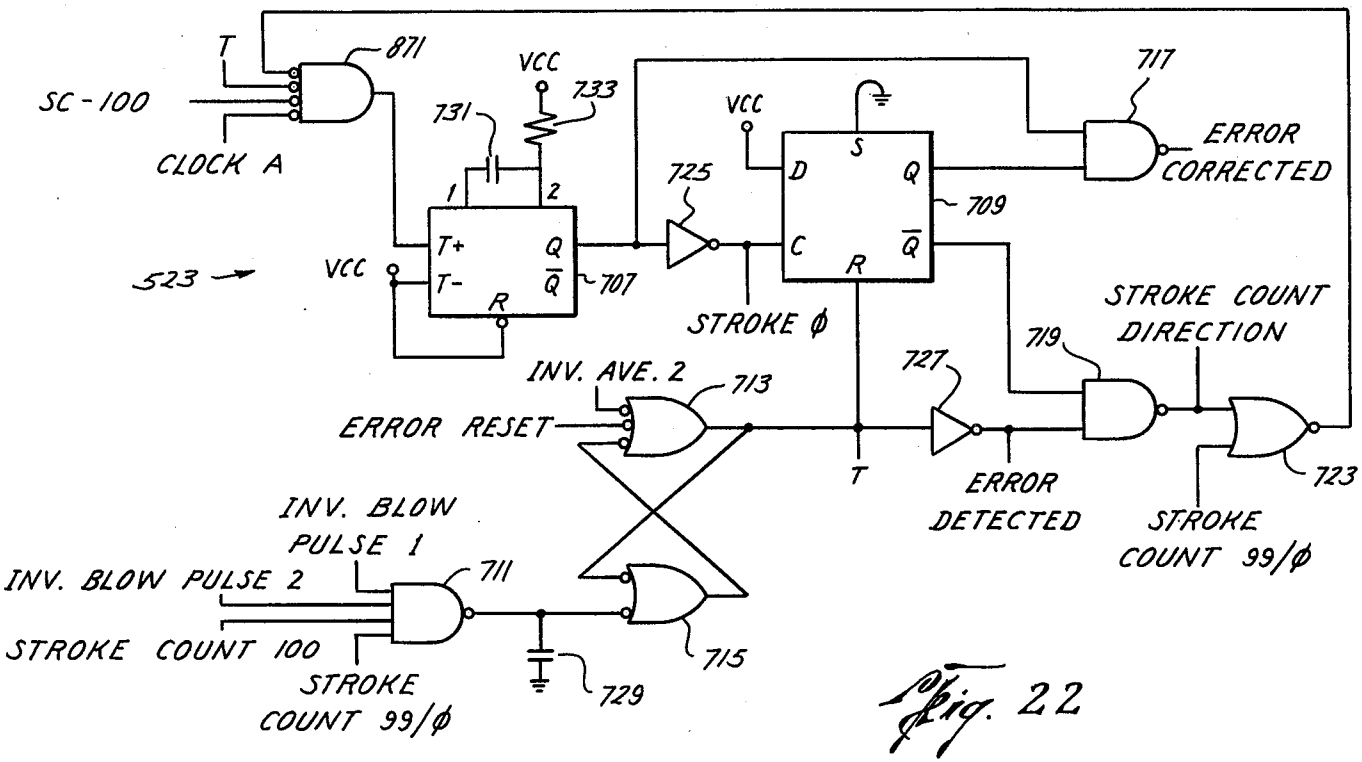
FIG. 22 is an electronic schematic diagram of the error correction circuit of the computing circuit of the preferred embodiment of the invention.
Figure 26:
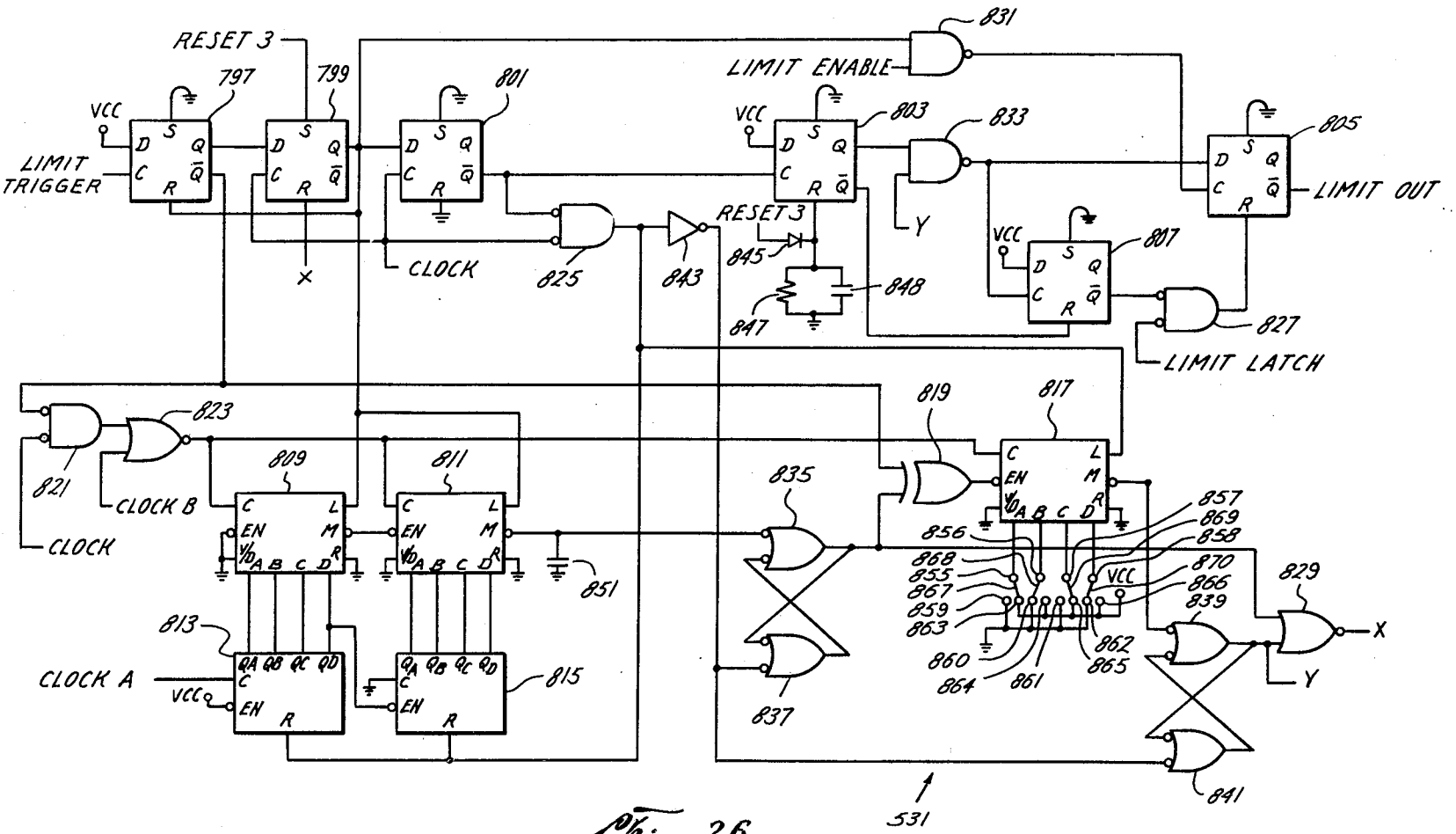
FIG. 26 is an electronic schematic diagram of the limit circuit of the computing circuit of the preferred embodiment of the apparatus of the invention.

In accordance with the foregoing, the computing circuit has been broken down into clock circuit 501 shown in FIG. 11, reset circuit 503 shown in FIG. 12, pulse input circuit 505 shown in FIG. 13, blow count circuit 507 shown in FIG. 14, blow pulse gating circuit 509 shown in FIG. 15, mode signalling circuit 511 shown in FIG. 16, calculation circuit 513 shown in FIG. 17, accumulator circuit 515 shown in FIG. 18, divider circuit 517 shown in FIG. 19, clock gating circuit 519 shown in FIG. 20, stroke count circuit 521 shown in FIG. 21, error correction circuit 523 shown in FIG. 22, stroke counter load circuit 525 shown in FIG. 23, display control circuit 527 shown in FIG. 24, display circuit 529 shown in FIG. 25 and limit circuit 531 shown in FIG. 26.

These circuits are shown and will be described hereinafter in terms of particular component arrangements comprising particular component types and values. It will be appreciated that while many component arrangements and component types and values may be used to accomplish the same functions as performed by the subcircuits as described, the particular arrangements set forth have been found to provide especially efficient and desirable results.

Furthermore, many of the specific preferred embodiments include all or part of various integrated circuit types. It will be understood that the power terminals of each of such integrated circuits will be appropriately connected between $V_{cc}$ and circuit ground according to manufacturer's specifications.

(1) Clock Circuit

Clock circuit 501 provides two continuous trains of clock pulses, referred to as a CLOCK signal and an INV. CLOCK signal, the INV. CLOCK signal being substantially the inverse of the CLOCK signal but having transitions slightly leading those of the CLOCK signal. Such clock pulses are for synchronizing various events of the remainder of the computing circuit and for clocking various counters of the remainder of the computing circuit at various times.

Referring to FIG. 11, clock circuit 501 of the preferred embodiment includes the following components:

| Component Name | Reference Number | Preferred Type or Value |
|---|---|---|
| D-Type Flip-Flop | 535 | ½ 4013 |
| Inverter | 537 | 1/6 4069 |
| Inverter | 539 | 1/6 4069 |
| Capacitor | 541 | 47 pfd. |
| Resistor | 43 | 22 Kohm |
| Resistor | 545 | 10 Kohm |

The components of circuit clock 501 are connected as follows: The output of inverter 537 is connected to the input of inverter 539 and to one end of resistor 545. The other end of resistor 545 is connected to one side of capacitor 541 and to one end of resistor 543. The other end of resistor 543 is connected to the input of inverter 537. The other side of capacitor 541 is connected to the Q output of inverter 539 and to the clock input ("C") of flip-flop 535. The data input ("D") of flip-flop 535 is connected to the inverted output ("Q") of flip-flop 535. The set ("S") and reset ("R") inputs of flip-flop 535 are connected to circuit ground.

The CLOCK and the INV. CLOCK signals are provided at the inverted output and the output, respectively, of flip-flop 535. When power is supplied to clock circuit 501 through the integrated circuits, the portion of clock circuit 501 comprising inverters 537, 539, capacitor 541 and resistors 543, 545 operate as a standard astable multivibrator with the output of inverter 539 constituting the output of the multivibrator. Thus, when power is supplied to inverters 537, 539, a train of digital pulses, each a little more than one microsecond apart, will be spontaneously generated at the output of inverter 539 and fed to the clock of flip-flop 535. Flip-flop 535 operates as a divide-by-two counter and will provide digital square waves, each having a period greater than two microseconds, at the output and the inverted output of flip-flop 535. The wave form at the output of flip-flop 535, i.e., the INV. CLOCK signal, will be substantially the inverse of the wave form at the inverted output of flip-flop 535, i.e., the CLOCK signal. Due to inherent delays in flip-flop 535, however, the transitions of the wave forms at the output of flip-flop 535 will lead the transitions of the wave form at the inverted output of flip-flop 535.

(2) Reset Circuit

Reset circuit 503 provides a first signal, hereinafter referred to as the RESET 1 signal, for indicating that the power has been turned on; a second signal, hereinafter referred to as the RESET 2 signal, for indicating that an average calculation has been completed; and a third signal, hereinafter referred to as the RESET 3 signal, for indicating that the calculating circuit is in the reset mode of a blow sequence.

Referring to FIG. 12, reset circuit 503 of the preferred embodiment includes the following components:

| Component Name | Reference No. | Preferred Type or Value |
|---|---|---|
| D-Type Flip-Flop | 573 | ½ 4013 |
| D-Type Flip-Flop | 575 | ½ 4013 |
| Two-Input NAND Gate | 577 | ¼ 4011 |
| Two-Input NAND Schmitt Trigger Circuit | 579 | ¼ 4093 |
| Diode | 580 | 1N914 |
| Capacitor | 581 | 0.05 mfd. |

-continued

| Component Name | Reference No. | Preferred Type or Value |
|---|---|---|
| Resistor | 582 | 1 Mohm |

Although gate 579 is a NAND gate, it is shown in the drawing as an OR gate with active-low inputs. This convention, which includes showing some NOR gates as AND gates with active-low inputs, is used in this description where it will facilitate an understanding of the operation of the computing circuit.

The components of reset circuit 505 are interconnected as follows: The set input of flip-flop 573 and reset input of flip-flop 573 are connected to circuit ground. The inverted output of flip-flop 573 is connected to one input of gate 577. The output of gate 577 is connected to one input of trigger 579. The other input of trigger 579 is connected to one side of capacitor 581, to one end of resistor 582 and to the cathode of diode 580. The other side of capacitor 581 is connected to circuit ground. The other end of resistor 582 and the anode of diode 581 are connected to $V_{cc}$. The output of trigger 579 is connected to the reset input of flip-flop 575. The data input of flip-flop 575 is connected to $V_{cc}$ and the set input of flip-flop 575 is connected to circuit ground.

External signals are supplied to reset circuit 503 as follows: The CLOCK signal is supplied to the clock input of flip-flop 573. The INV. CLOCK signal is supplied to the remaining input of gate 577. An INV. BLOW PULSE 1 signal, which is provided by pulse input circuit 505 as described infra, is supplied to the clock input of flip-flop 575. Such INV. BLOW PULSE 1 signal includes a negative-going pulse for substantially every blow pulse provided by the detection circuit, each such pulse having a leading edge substantially corresponding to the leading edge of a blow pulse and a trailing edge following such leading edge by one period of the CLOCK signal. An ACCUMULATOR $\phi$ signal, which is provided by accumulator circuit 515 as described infra, is supplied to the data input of flip-flop 573. The ACCUMULATOR $\phi$ signal is LOW for a short period at the end of the dividing phase of the A mode of a blow sequence when the count of the accumulating counter becomes zero, and is HIGH at all other times.

The RESET 1 signal is provided at the interconnection point of capacitor 581, resistor 582 and diode 580. Thus, when the power is turned off, capacitor 581 will discharge rapidly through the low resistance of the entire circuit across $V_{cc}$ by way of diode 580. As a result, when the apparatus is turned on, the RESET 1 signal will initially be LOW. As long as the apparatus stays on, capacitor 581 will be charged through resistor 582 and the RESET 1 signal will move toward a HIGH state. Once capacitor 581 is charged sufficiently so that the RESET 1 signal is HIGH, such signal will remain HIGH as long as the apparatus stays on because capacitor 581 cannot discharge as long as $V_{cc}$ continues to be applied to the circuit. Thus, the RESET 1 signal indicates that the power has been turned on by providing a LOW level during a short period immediately after the power is turned on and a HIGH level for all times thereafter that the power remains on.

The RESET 2 signal is provided at the inverted output of flip-flop 573. Because the ACCUMULATOR $\phi$ signal is HIGH during the largest part of each blow sequence and flip-flop 573 is continuously clocked by the CLOCK signal, the RESET 2 signal is LOW during the largest part of each blow sequence. When the count of the accumulating counter goes to zero, the ACCUMULATOR $\phi$ signal will go LOW whereby, on the next positive-going transition of the CLOCK signal, the RESET 2 signal will go HIGH. As set forth infra in the description of accumulator circuit 515, the ACCUMULATOR $\phi$ signal will be HIGH by the time of the next positive-going transition of the CLOCK signal whereby, at such time, the RESET 2 signal will go LOW and remain LOW until the end of the next dividing phase. Thus, because the end of a dividing phase corresponds substantially with the completion of an average calculation, the RESET 2 signal provides a positive-going pulse having a width of one period of the CLOCK signal at the end of each average calculation.

The RESET 3 signal is provided at the inverted output of flip-flop 575. The RESET 1 signal is connected to the reset of flip-flop 575 through trigger 579 such that flip-flop 575 will be reset, i.e., the RESET 3 signal will go HIGH, when the power is turned on. The RESET 2 signal is connected to the reset of flip-flop 575 through gate 577 and trigger 579 such that the flip-flop 575 will be reset, i.e., the RESET 3 signal will go HIGH, approximately one-half period of the CLOCK signal after the leading edge of the pulse of the RESET 2 signal, i.e., slightly after the completion of an average calculation. After being reset, flip-flop 575 will be set, i.e., the RESET 3 signal will go LOW, on the next positive-going transition of the INV. BLOW PULSE 1 signal, such transition occurring slightly after a blow pulse provided by the detection circuit. As a result, the RESET 3 signal will be HIGH from approximately the time either (1) the power is turned on or (2) an average stroke calculation is completed until a time slightly after the first blow pulse after such RESET 3 signal goes HIGH, and will be LOW at all other times. Thus, the RESET 3 signal will be HIGH substantially throughout the reset mode of each blow sequence and will be LOW at all other times and thereby will provide an indication that the computing circuit is in the reset mode of a blow sequence.

Reset circuit 503 also provides the inverse of the RESET 3 signal, hereinafter referred to as the INV. RESET 3 signal, at the output of flip-flop 575.

(3) Pulse Input Circuit

Pulse input circuit 505 provides positive-going and negative-going pulses synchronized to the CLOCK signal and corresponding to the asynchronous blow pulses provided by the detection circuit. Pulse input circuit 505 further includes disablement means for preventing the production of any such synchronous pulses corresponding to a blow pulse provided by the detection circuit less than time $t_{min}$ after a blow pulse provided by the detection circuit and for which corresponding synchronous pulses were produced. The time $t_{min}$ is approximately equal to the minimum time between valid blows of a hammer. Thus, in the preferred embodiment, $t_{min}$ is approximately equal to 0.8 seconds. In this regard, it should be noted that any blow pulse following a valid blow pulse by less than $t_{min}$ will be spurious. Thus, the disablement means prevents the production of synchronous pulses corresponding to spurious blow pulses.

Referring to FIG. 13, pulse input circuit 505 of the preferred embodiment includes the following components:

| Component Name | Reference Number | Preferred Type or Value |
|---|---|---|
| D-Type Flip-Flop | 547 | ½ 4013 |
| D-Type Flip-Flop | 549 | ½ 4013 |
| 2-Input NAND Schmitt Trigger | 550 | ¼ 4093 |
| Timer | 551 | LM 555 |
| Monostable Multivibrator | 553 | ½ 4098 |
| 2-Input NOR Gate | 555 | ¼ 4001 |
| Inverter | 557 | 1/6 4069 |
| Capacitor | 558 | 0.05 mfd. |
| Capacitor | 559 | 0.05 mfd. |
| Capacitor | 561 | 0.47 mfd. |
| Capacitor | 563 | 0.05 mfd. |
| Capacitor | 565 | 1000 pfd. |
| Capacitor | 567 | 2200 pfd |
| Resistor | 568 | 10 Kohm |
| Resistor | 569 | 1.5 Mohm (1%) |
| Resistor | 570 | 1 Mohm |
| Resistor | 571 | 4.7 Mohm |

The components of pulse input circuit 505 are interconnected as follows: One end of resistor 568 is connected to $V_{cc}$. The other end of resistor 568 is connected to output P of the detection circuit and to one end of resistor 570. The other end of resistor 570 is connected to both inputs of Schmitt trigger 550 and to one side of capacitor 558. The other side of capacitor 558 is connected to circuit ground. The output of Schmitt trigger 550 is connected to the clock input of flip-flop 547. The set input of flip-flop 547, the set input of flip-flop 549 and the reset input of flip-flop 549 are connected to circuit ground. The output of flip-flop 547 is connected to the data input of flip-flop 549. The clock input of flip-flop 549 is connected to the CLOCK. The output of flip-flop 549 is connected to the reset input of flip-flop 547. The inverted output of flip-flop 549 is connected to the trigger input ("TR") of timer 551. The discharge input ("D") of timer 551 is connected to one end of resistor 569, to one side of capacitor 561, and to the threshold input ("TH") of timer 551. The other end of resistor 569 is connected to $V_{cc}$. The other side of capacitor 561 is connected to circuit ground. The reset input ("R") of timer 551 is connected to $V_{cc}$ and the control voltage input ("CONT") of timer 551 is connected to circuit ground. Capacitor 559 is connected between $V_{cc}$ and circuit ground adjacent timer 551. The output ("Q") of timer 551 is connected to one input of NOR gate 555, to the negative trigger input ("T−") of multivibrator 553, and to the input of inverter 557. The positive trigger input ("T+") of multivibrator 553 is connected to circuit ground. The reet input ("R") of multivibrator 553 is connected to $V_{cc}$. One side of capacitor 565 is connected to pin 15 of multivibrator 553 and the other side of capacitor 565 is connected to pin 14 of multivibrator 553 and one end of resistor 571. The other end of resistor 571 is connected to $V_{cc}$. The output ("Q") of multivibrator 553 is connected to the other input of NOR gate 555. The output of NOR gate 555 is connected to one side of capacitor 567 and to the data input of flip-flop 547. The other side of capacitor 567 is connected to circuit ground.

In accordance with the operation of pulse input circuit 503 as shown in FIG. 13, four output pulses are produced when a blow pulse is received by circuit 503 from the detection circuit. The first pulse, referenced in the drawings and hereinafter referred to as "BLOW PULSE 1", is provided at the output of flip-flop 549. BLOW PULSE 1 is positive-going with its leading edge substantially synchronous with the leading edge of the first positive-going transition of the CLOCK signal after the leading edge of the blow pulse received at the clock input of flip-flop 547 and with its trailing edge substantially synchronous with the leading edge of the next consecutive positive-going transition of the CLOCK signal. The second pulse, referenced in the drawings and hereinafter referred to as "INV. BLOW PULSE 1", is provided at the inverted output of flip-flop 547 and is the inverse of BLOW PULSE 1, i.e., INV. BLOW PULSE 1 is negative-going with its leading and trailing edges substantially aligned with the leading and trailing edges, respectively, of BLOW PULSE 1. The third pulse, referenced in the drawings and hereinafter referred to as "BLOW PULSE 2", is provided at the output of timer 551. BLOW PULSE 2 is positive-going with its leading edge substantially aligned with the leading edge of BLOW PULSE 1 and with a width of 0.78 seconds. The fourth pulse, referenced in the drawings and hereinafter referred to as "INV. BLOW PULSE 2", is provided at the output of inverter 557. INV. BLOW PULSE 2 is the inverse of BLOW PULSE 2.

It should be apparent that the four described pulses produced by pulse input circuit 503 as shown in FIG. 13 are all CLOCK synchronized pulses corresponding to a blow pulse delivered by the detection circuit which, in turn, corresponds to a blow delivered by the pile driving hammer being analyzed. The major difference between BLOW PULSE 1 and INV. BLOW PULSE 1, on the one hand, and BLOW PULSE 2 and INV. BLOW PULSE 2, on the other hand, is pulse width, the pulse width of the former pulses being substantially equal to the period of the clock and the pulse width of the latter pulses being 0.78 seconds.

The above-described pulses will be produced by circuit 503 only if the data input of flip-flop 549 is HIGH when the CLOCK goes HIGH. Such data input, in turn, will be HIGH only when flip-flop 547 is set. Flip-flop 547, however, is reset by the occurrence of BLOW PULSE 1 and the data input of flip-flop substantially simultaneously goes LOW by the occurrence of BLOW PULSE 2 acting through NOR gate 555. Thus, flip-flop 547 cannot be set again until at least the end of BLOW PULSE 2. At the end of BLOW PULSE 2, however, multivibrator 553 will be triggered whereby the data input of flip-flop 547 will continue to be held LOW during the unstable condition of multivibrator 553. This condition will exist for approximately 500 microseconds as set by capacitor 565 and resistor 571. Capacitor 567 operates to prevent the data input of flip-flop 547 from going HIGH due to trigger delays of multivibrator 553. Thus, flip-flop 547 cannot be set for a period after the start of BLOW PULSE 1 equal to the width of BLOW PULSE 2 plus a short time thereafter, i.e., for approximately 0.8 seconds. Thus, pulse input circuit 505 will produce no pulses corresponding to a blow pulse provided by the detection circuit less than 0.8 seconds after a blow pulse for which circuit 505 produced such pulses.

(4) Blow Count Circuit

Blow count circuit 507 includes the blow counter of the computing circuit and provides a digital indication, in BCD format, of the number of blow pulses that have occurred during the B mode of the current blow sequence and that correspond to valid blows. Blow count circuit 507 further provides a "LIMIT TRIGGER" signal indicating the occurrence of each initiating blow pulse and of each blow pulse occurring while the apparatus is operating in the B mode and a "MAXIMUM BLOW COUNT" signal indicating the occurrence of a normal terminating blow pulse as defined supra.

Referring to FIG. 14, blow count circuit 507 of the preferred embodiment includes the following components:

| Component Name | Reference No. | Preferred Type or Value |
|---|---|---|
| BCD Counter | 613 | ½ 4518 |
| BCD Counter | 615 | ½ 4518 |
| BCD Up/Down Counter | 617 | 4510 |
| 4-Input NAND Gate | 619 | ½ 4012 |
| 2-Input NAND Gate | 621 | ¼ 4011 |
| Inverter | 623 | 1/6 4069 |

The components of blow count circuit 507 are interconnected as follows: The output of gate 621 is connected to the input of inverter 623. The output of inverter 623 is connected to the clock ("C") inputs of counters 613, 617. The clock input of counter 615 is connected to circuit ground. The enable input ("EN") of counter 613 is connected to $V_{cc}$. The A output ("QA") of counter 613 is connected to one input to gate 619. The D output ("QD") of counter 613 is connected to one of the inputs of gate 619 and to the enable input of counter 615. The A output and the D output of counter 615 are connected to separate inputs of gate 619. The output of gate 619 is connected to the enable input of counter 617. The up/down input ("U/D") of counter 617 is connected to $V_{cc}$. The load input ("L") of counter 617 is connected to circuit ground. The A, B, C, D inputs ("A", "B", "C", "D", respectively) of counter 617 are all connected to circuit ground.

External signals are provided to blow count circuit 507 as follows: The RESET 3 signal is supplied to the reset ("R") input of counters 613, 615, 617. BLOW PULSE 1 is supplied to one input of gate 621. A "MODE" signal, which is provided by mode signalling circuit 511 as described infra, is supplied to the remaining input of gate 621. The MODE signal is LOW during substantially all of the "A" mode of each blow sequence and is HIGH at all other times.

The LIMIT TRIGGER signal is provided at the output of gate 621. Gate 621 is enabled only when the MODE signal is HIGH, i.e., during the reset and B modes. Thus, gate 621 will be enabled for each BLOW PULSE 1 corresponding to an initiating blow pulse and for each BLOW PULSE 1 corresponding to a blow pulse occurring while the computing circuit is in the B mode of a blow sequence. Thus, the output of gate 621 and the LIMIT TRIGGER signal will include a negative-going pulse for every initiating blow pulse and for every blow pulse occurring while the computing circuit is operating in the B mode.

Counters 613, 615, 617 constitute the blow counter which provides the blow count in three-decade BCD format. The output of counter 613 represents the least significant digit ("BC-1") of the blow count, the output of counter 617 represents the most significant digit ("BC-100") of the blow count and the output of counter 615 represents the intermediate digit ("BC-10") of the blow count. In accordance with standard convention, the A output represents the least significant bit of counter output and the D output represents the most significant bit of a counter output. This standard convention is followed for all counters throughout the remainder of this description.

The count of the blow counter will increment on every positive-going transition of the output of inverter 623. Because the output of inverter 623 is the inverse of the LIMIT TRIGGER signal, there will be a positive-going transition of the output of inverter 623 corresponding to each initiating blow pulse and to each blow pulse occurring during the B mode of a blow sequence. Counters 613, 615, 617, however, are held reset during the reset period by the RESET 3 signal whereby the positive-going transition at the output of inverter 623 corresponding to an initiating blow pulse, i.e., that caused by the leading edge of the BLOW PULSE 1 corresponding to an initiating blow pulse, will not increment the blow counter. At the end of such an initiating BLOW PULSE 1, the reset period will end and counters 613, 615, 617 will no longer be held in reset. Thus, the blow counter will increment for each blow pulse occurring while the apparatus is operating in the B mode and the count of the blow counter 615, will correspond to the number of blows that have occurred during the B mode of the current blow sequence.

It should be noted that while during the A mode of a blow sequence, gate 621 is disabled by the MODE signal whereby counters 613, 615, 617 cannot be clocked. Furthermore, counters 613, 615, 617 are not reset by the RESET 3 signal until the reset mode of the next blow sequence. Thus, during the A mode of a blow sequence, the count of the blow counter will represent the total number of blow pulses that occurred during the B mode of such blow sequence, i.e., the sequence blow count.

The MAXIMUM BLOW COUNT signal is provided at the master output of counter 617. In accordance with the logic of such an output, the MAXIMUM BLOW COUNT signal (1) will be LOW when the enable input of counter 617 is LOW, i.e., when the count outputs of counters 613, 615 are both nine, and the count output of counter 617 is nine and (2) will be HIGH for all other conditions. Thus, the MAXIMUM BLOW COUNT signal will indicate the occurrence of the 999th blow pulse occurring during the "B" mode of a blow sequence by going LOW upon the occurrence of such a blow. In this regard, it should be noted that the negative-going transition of the MAXIMUM BLOW COUNT signal will only slightly trail the leading edge of the BLOW PULSE 1 corresponding to such 999th blow pulse. It should be further noted that such 999th blow pulse is the normal terminating blow pulse of the preferred embodiment of the apparatus of the invention, i.e., m=999, although a different predetermined number may be used in other embodiments by using appropriate decoding.

(5) Blow Pulse Gating Circuit

Blow pulse gating circuit 509 provides a BLOW PULSE (T) signal which includes a pulse corresponding to each terminating blow pulse and a BLOW PULSE (NT) signal which includes a pulse corresponding to each initiating blow pulse and each blow pulse occurring during the B mode of a blow sequence, i.e., each "B mode blow pulse." In this way, the terminating blow pulses can be properly routed, as described infra, to terminate a B mode and begin an A mode by triggering an average stroke calculation and the initiating and B mode can be properly routed, as described infra, to trigger calculation of the stroke for the blow following the blow to which such initiating blow pulse or B mode blow pulse corresponds.

Referring to FIG. 15, blow pulse gating circuit 509 of the preferred embodiment includes the following components:

| Component Name | Reference No. | Preferred Type or Value |
|---|---|---|
| 3-Input NAND Gate | 625 | ⅓ 4023 |
| 3-Input NAND Gate | 627 | ⅓ 4023 |
| 2-Input NAND Gate | 629 | ¼ 4011 |
| 2-Input NOR Gate | 630 | ¼ 4001 |
| Inverter | 631 | 1/6 4069 |

The components of blow pulse gating circuit 509 are interconnected as follows: The output of gate 629 is connected to one input of gate 625 and to the input of inverter 631. The output of inverter 631 is connected to one input of gate 627. The output of gate 630 is connected to one input of gate 625 and to one input of gate 627.

External signals are provided to blow pulse gating circuit 509 as follows: An AVERAGE COMMAND signal, which is provided by display mode control circuit 529 as described infra, is supplied to one input of gate 629. The AVERAGE COMMAND signal is LOW from a time slightly after operation of the A switch, as set forth infra in the description of display mode control circuit 529, during the "B" mode or the A mode of a blow sequence until the end of such blow sequence, i.e., until the completion of an average stroke calculation, and is HIGH at all other times. The MAXIMUM BLOW COUNT signal is supplied to the other input of gate 629. INV. BLOW PULSE 1 and the CLOCK signal are supplied to the inputs of gate 630. The MODE signal, which, as indicated supra, is LOW during substantially all of the A mode of each blow sequence and is HIGH at all other times, is supplied to the remaining input of gate 627. A DELAYED MODE signal, which is provided by calculation circuit 513 as described infra, is supplied to the remaining input of gate 625. The DELAYED MODE is substantially identical to the MODE signal, but has transitions trailing those of the MODE signal by two gate delays in order to avoid a race condition.

According to the operation of blow pulse gating circuit 509, the BLOW PULSE (T) signal is provided at the output of gate 625 and the BLOW PULSE (NT) is provided at the output of gate 627. For each BLOW PULSE 1, a positive-going pulse having a leading edge corresponding to the negative-going transition of the CLOCK signal that trails the leading edge of such BLOW PULSE 1 is provided at one input of each of gates 625, 627. Thus, the BLOW PULSE (T) signal will include a negative-going pulse for each BLOW PULSE 1 occurring while gate 625 is enabled and the BLOW PULSE (NT) signal will include a negative-going pulse for each BLOW PULSE 1 occurring while gate 627 is enabled.

Because the MODE and DELAYED MODE signals are both LOW during substantially all of the A mode, gates 625, 627 will both be disabled during the A mode of each blow sequence and neither the BLOW PULSE (T) signal nor the BLOW PULSE (NT) signal will include any pulses during the A mode of a blow sequence. During the reset and B modes of each blow sequence, however, gate 625 will be enabled when the output of gate 629 is HIGH and gate 627 will be enabled when the output of gate 627 is LOW. Thus, during the reset and B modes of each blow sequence, the BLOW PULSE (T) signal will include a pulse for each BLOW PULSE 1 occurring when either the AVERAGE COMMAND signal on the MAXIMUM BLOW COUNT signal is LOW and the BLOW PULSE (NT) signal will include a pulse for each BLOW PULSE 1 occurring when both the AVERAGE COMMAND signal and the MAXIMUM BLOW COUNT signal are HIGH. In view of the nature of the AVERAGE COMMAND and MAXIMUM BLOW COUNT signals, the BLOW PULSE (NT) signal will include a pulse for each BLOW PULSE 1 corresponding to either (1) the first blow pulse after operation of the A switch or (2) the $m^{th}$ or $999^{th}$ blow pulse of the B mode of a blow sequence; and the BLOW PULSE (NT) signal will include a pulse for each BLOW PULSE 1 corresponding to all other blow pulses occurring during the reset and B modes of a blow sequence. Thus, the pulses of the BLOW PULSE (T) signal will correspond to terminating blow pulses and the pulses of the BLOW PULSE (NT) signal will correspond to initiating and B mode blow pulses.

(5) Mode Signalling Circuit

Mode signalling circuit 511 provides the MODE signal for indicating that the computing circuit is in the A mode of a blow sequence and DIVIDING signal and an INV. DIVIDING signal for indicating that the apparatus is in the dividing phase of the A mode of a blow sequence.

Referring to FIG. 16, mode signalling circuit 511 includes the following components:

| Component Name | Reference No. | Preferred Type or Value |
|---|---|---|
| 3-Input NAND Gate | 583 | ⅓ 4023 |
| 2-Input NAND Gate | 584 | ¼ 4012 |
| 2-Input NOR Gate | 585 | ¼ 4001 |

The components of mode signalling circuit 523 are interconnected as follows: The output of gate 584 is connected to one of the inputs of gate 583. The output of gate 583 is connected to an input of gate 584 and to one input of gate 585.

External signals are supplied to mode signalling circuit 511 as follows: An ERROR DETECTED signal, which is provided by error correction circuit 523 as described infra, is supplied to the remaining input of gate 585. The ERROR DETECTED signal is HIGH during the error correcting phase, if any, of the A mode of a blow sequence and is LOW at all other times. An ERROR CORRECTED signal, also provided by error correction circuit 523 as described infra, is supplied to one of the inputs of gate 583. The ERROR CORRECTED signal includes a negative-going pulse at the end of the error correcting phase of the A mode of a blow sequence and is HIGH at all other times. The BLOW PULSE (T) signal is supplied to the remaining input of gate 583. The INV. RESET 3 signal is supplied to the remaining input of gate 584.

In accordance with the operation of mode signalling circuit 511 as shown in FIG. 23, gates 583, 584 constitute a set-reset flip-flop having an output at the output of gate 583 and an inverted output at the output of gate 584. The flip-flop of gates 583, 584 will be set by a negative-going pulse in either the BLOW PULSE (T) signal or the ERROR CORRECTED signal. Because such a pulse in the BLOW PULSE (T) signal corresponds to a terminating blow pulse which, as indicated supra, terminates the B mode of a blow sequence and begins the dividing phase of the A mode of a blow sequence and because such a pulse in the ERROR CORRECTED signal corresponds to the end of an error correcting phase of the A mode of a blow sequence and the beginning of the dividing phase of the A mode of a blow sequence, the flip-flop of gates 583, 584 will beset at the beginning of the dividing phase of the A mode of a blow sequence. The flip-flop of gates 583, 584 will be reset by a LOW in the INV. RESET 3 signal. Because the INV. RESET 3 signal will go LOW at the end of the dividing phase of the A mode of a blow sequence, the flip-flop of gates 583, 584 will be reset at the end of the dividing phase of the A mode of a blow sequence. As a result, the flip-flop of gates 583, 584 will be set during the dividing phase of the A mode of each blow sequence and will be reset at all times. Thus, the DIVIDING signal and INV. DIVIDING signal and provided at the outputs of gates 583, 584, respectively.

The output of gate 585 will be LOW if the DIVIDING signal or the ERROR DETECTED signal is HIGH and will be HIGH at all other times. Because the DIVIDING signal will be HIGH during the dividing phase of the A mode of a blow sequence and will be LOW at all other times and because the ERROR DETECTED signal will be HIGH during the error correcting phase of the A mode of a blow sequence and will be LOW at all other times, the output of gate 585 will be LOW during the entirety of the A mode of each blow sequence and will be HIGH at all other times. Thus, the output of gate 585 provides the MODE signal.

(7) Calculation Circuit

Calculation circuit 513 generates the squaring pulses used in calculating the strokes of the individual blows. More specifically, for each BLOW PULSE (NT), calculation circuit produces, during the interval between such BLOW PULSE (NT) and time $t_z$ in seconds after such BLOW PULSE (NT) and before the next BLOW PULSE (NT), BLOW PULSE (T) or error detection, whichever occurs first after such BLOW PULSE (NT), approximately 40.1 $tz_2$ negative-going transitions at a CALCULATION OUT signal. Calculation circuit 511 accomplishes this function by (1) generating a continuous train of reference pulses at a frequency having a constant and known period $t_1$, (2) generating a quantity of dividend pulses substantially equal to the square of the number of reference pulses generated since the last BLOW PULSE (NT), and (3) using such dividend pulses to clock a divide-by-k counter where k is substantially equal to $1/(40.1)(t_1)^2$, the output of the divide-by-k counter providing the CALCULATION OUT signal. Thus, the number of negative-going transitions of the CALCULATION OUT signal produced during the period between a BLOW PULSE (NT) ("BPNT 1") and the next following BLOW PULSE (NT) ("BPNT 2") or BLOW PULSE (T) ("BPT"), whichever occurs first, will be approximately equal to the number of dividend pulses produced during such period divided by k. Where the time of such period, expressed in the same units as $t_1$, is t, the number of reference pulses produced during such period is $t/t_1$, and the number of dividend pulses produced during such period is $(t/t_1)^2$ or $t^2/t_12$. Thus, the number of negative-going transitions of the CALCULATION OUT signal during such period is approximately $(t^2/t_1^2)/(1/40.1t_1^2)$ which equals $40.1t^2$.

The actual value of k or $t_1$ for a particular embodiment is not critical to the performance of the apparatus in accordance with the invention. Preferably, however, k should be an integer so that a conventional binary divider counter may be implemented. Furthermore, k should be large, preferably greater than 100, so as to provide reasonable resolution. In all cases, k should be substantially equal to $1/(40.1)(t_1)^2$. In the preferred embodiment, k is set at 256, so that a standard 8-bit binary counter can be used as a divide-by-k counter, and $t_1$ is set at approximately 1 millisecond. Such values for k and $t_1$ have been found to provide especially desirable results in terms of cost of manufacturing the apparatus and accuracy of stroke and stroke averages computed by the apparatus.

Furthermore, in the preferred embodiment of calculation circuit 513, dividend pulses are generated upon the occurrence of each reference pulse following a BLOW PULSE (NT) in accordance with the following equation:

$$n^2 = \sum_{i=0}^{i=n-1} 2i + 1$$

Thus, for each reference pulse produced after a BLOW PULSE (NT), 2i+1 squaring pulses will be produced where i is the sequential number of the reference pulse, the sequence beginning after such BLOW PULSE (NT), minus one. For example, the first reference pulse after the a BLOW PULSE (NT) (i=0) will produce one squaring pulse; the next reference pulse (i=1) will produce three squaring pulses. Thus, after the occurrence of the second reference pulse, four squaring pulses will have been produced, four being equal to the square of the number of reference pulses occurring after the BLOW PULSE (NT).

Referring to FIG. 17, calculation circuit 513 of the preferred embodiment includes the following components:

| Component Name | Reference No. | Preferred Type or Value |
|---|---|---|
| Timer | 633 | LM 555 |
| D-Type Flip-Flop | 635 | ½ 4013 |
| D-Type Flip-Flop | 637 | ½ 4013 |
| D-Type Flip-Flop | 639 | ½ 4013 |
| Binary Counter | 641 | ½ 4520 |
| Binary Counter | 643 | ½ 4520 |
| Binary Counter | 645 | ½ 4520 |
| Binary Counter | 647 | ½ 4520 |
| Binary UP/DOWN Counter | 649 | 4516 |
| Binary UP/DOWN Counter | 651 | 4516 |
| 2-Input NOR Gate | 653 | ¼ 4001 |
| 2-Input NOR Gate | 655 | ¼ 4001 |
| 2-Input NOR Gate | 657 | ¼ 4001 |
| 2-Input NAND Gate | 659 | ¼ 4011 |
| Inverter | 661 | 1/6 4069 |
| Capacitor | 663 | 0.05 mfd. |
| Capacitor | 665 | 0.05 mfd. |
| Capacitor | 667 | 0.22 mfd. |
| Potentiometer | 669 | 10 Kohm |
| Resistor | 671 | 20 Kohm (1%) |
| Resistor | 673 | 20 Kohm (1%) |

The components of calculation circuit 513 are interconnected as follows: One end of potentiometer 669 is connected to the arm of potentiometer 669 and to $V_{cc}$. The other end of potentiometer 669 is connected to one end of resistor 671. The other end of resistor 671 is connected to the discharge input of timer 663 and to one end of resistor 673. The other end of resistor 673 is connected to the trigger input of timer 663, the threshold input of timer 663 and to one side of capacitor 667. The other side of capacitor 667 is connected to circuit ground. The reset input of timer 663 and one side of capacitor 663 are connected to $V_{cc}$. The other side of capacitor 663 is connected to circuit ground. One side of capacitor 665 is connected to the control voltage input of timer 633. The other side of capacitor 665 is connected to circuit ground. The output of timer 633 is connected to the clock input of flip-flop 635. The data input of flip-flop 635 is connected to $V_{cc}$. The set input of flip-flop 635 is connected to circuit ground. The output of flip-flop 635 is connected to the data input of flip-flop 637. The inverted output of flip-flop 635 is connected to the load input of counter 649 and to the load input of counter 651. The set input of flip-flop 637 is connected to circuit ground. The inverted output of flip-flop 637 is connected to one input of gate 653, to one input of gate 655 and to the reset input of flip-flop 639. The output of gate 653 is connected to the enable ("EN") input of counter 641. The clock input of counter 641 is connected to circuit ground. The D output ("QD") of counter 641 is connected to the enable input of counter 643. The clock input of counter 643 is connected to circuit ground. The output of gate 655 is connected to one input of gate 657 and to the clock input of counter 645. The output of gate 657 is connected to the input of inverter 661. The output of inverter 661 is connected to the reset input of flip-flop 635. The enable input of counter 645 is connected to $V_{cc}$. The A, B, C, D outputs of counter 645 are connected in parallel to the A, B, C, D inputs of counter 649. The D output of counter 645 is also connected to the enable input of counter 647. The clock input of counter 647 is connected to circuit ground. The A, B, C, D outputs of counter 647 are connected in parallel to the A, B, C, D inputs of counter 651. The inverted output of flip-flop 639 is connected to the data input of flip-flop 639 and to the clock inputs of counters 649, 651. The set input of flip-flop 639 is connected to circuit ground. The enable input, UP/DOWN input and reset input of counter 649 and the UP/DOWN input and reset input of counter 651 are all connected to circuit ground. The main output ("N") of counter 649 is connected to the enable input of counter 651. The main output of counter 651 is connected to one input of gate 655. The output of gate 659 is connected to the reset inputs of flip-flop 637, counter 641, counter 643, counter 645 and counter 647 and to one input of gate 657.

External signals are supplied to calculation circuit 513 as follows: The CLOCK signal is connected to the clock input of flip-flop 637, to the clock input of flip-flop 639 and to one input of gate 653. The BLOW PULSE (NT) signal is supplied to one input of gate 659. The MODE signal is supplied to the other input of gate 659.

Calculation circuit 513 of FIG. 18 operates as follows: timer 633 is wired as an astable multivibrator that produces reference pulses at its output at a constant frequency of approximately 1 khz whereby a reference pulse, including a positive-going transition, is provided every 1 millisecond to the clock input of flip-flop 635. Counters 641, 643 are wired to operate as an 8-bit binary counter ("dividing counter") that increments by one on every negative-going transition at the output of gate 653. Thus, there will be a negative-going transition of the signal at output QD of counter 643, which provides the CALCULATION OUT signal, for every 256 negative-going transitions at the output of gate 653; i.e., the number of negative-going transitions of the CALCULATION OUT signal will be equal to the number of negative-going transitions at the output of gate 653 divided by 256. Counters 645, 647 are wired as an 8-bit binary counter ("incrementing counter") that increments by one on every positive-going transition at the output of gate 655. Counters 649, 651 are wired as an 8-bit binary counter ("multiplying counter") that counts down by one on every positive-going transition at the inverted output of flip-flop 639. The multiplying counter is loaded with the count of the incrementing counter whenever the inverted output of flip-flop 635 is HIGH. Flip-flop 639 is wired as a 1-bit binary counter and will produce a single positive-going transition at its inverted output for every other positive-going transition of the CLOCK signal after flip-flop 639 is released from reset.

When a BLOW PULSE (NT) ("BPNT 1") is provided to gate 659, the output of gate 659 will go HIGH whereby the dividing and incrementing counters and flip-flop 637 will be reset. Flip-flop 635 will also be reset through gate 657 and inverter 661. Thus, the inverted output of flip-flop will be HIGH, gate 653 will be disabled and flip-flop 635 will be held in reset. As a result, none of the counters will be clocked as long as flip-flop 637 remains reset. Furthermore, because flip-flop 635 is reset, the inverted output of flip-flop 635 will be loaded with the count output of the incrementing counter, i.e., zero. As a result, the master output of the multiplying counter will be LOW and gate 655 will be enabled.

On the first reference pulse ("R1") after such BPNT 1, flip-flop 635 will be set whereby the data input of flip-flop 637 will go HIGH. On the first positive-going transition of the CLOCK signal after R1, flip-flop 637 will be set, gate 653 will be enabled and flip-flop 639 will be released from reset. In addition, because gate 655 was previously enabled by the master output of the multiplying counter, the incrementing counter will be incremented by one and flip-flop 635 will be reset. As a result, the incrementing counter will have a count of one which will be loaded into the multiplying counter because the inverted output of flip-flop 635 will be HIGH. The non-zero count in the multiplying counter will cause the master output of such counter to go HIGH whereby gate 655 will be disabled and the reset input of flip-flop 635 will go LOW.

On the subsequent negative-going transition of the CLOCK signal, the output of gate 653, which provides the dividend pulses, will go HIGH and the dividing counter will be incremented by one. On the next positive-going transition of the CLOCK signal, flip-flop 637 will be set and gate 653 and flip-flop 639 will again be disabled. The calculation circuit will then await a second reference pulse ("R2") before producing any additional dividend pulses. Thus, for the first reference pulse, $1^2=1$ dividend pulse is produced.

On the next reference pulse, i.e., R2, flip-flop 655 will again be set, the load input of the multiplying counter will go LOW and the data input of flip-flop 637 will go HIGH. The next positive-going transition of the CLOCK signal will set flip-flop 653 thus enabling gates 653, 655 and flip-flop 639. As a result, on the following negative-going transition of the CLOCK signal, there will be a negative-going transition at the output of gate 653 and the divider will be incremented by one. On the following positive-going transition of the CLOCK signal flip-flop 639 will be clocked and the inverted output of flip-flop 639 will go LOW. On the next negative-going transition of the CLOCK signal, the divider counter will again be incremented.

The following positive-going transition of the CLOCK signal will be the second positive-going transition of the CLOCK signal since flip-flop 639 was released from reset and a positive-going transition will be provided at the inverted output of flip-flop 639. As a result, the multiplying counter will count down by one making the count in multiplying counter zero and causing the master output of the multiplying counter to go HIGH. This will cause the output of gate 655 to go HIGH whereby the incrementing counter will be clocked and flip-flop 635 will be reset. The count of the incrementing counter will thereby be increased to two, such count will be loaded into the multiplying counter, the master output of the multiplying counter will go HIGH, gate 655 will be disabled and the reset will be removed from flip-flop 635.

On the next negative-going transition of the CLOCK signal, the divider will again be clocked whereby the count in the divider will be four (equal to the number of dividend pulses produced at the output of gate 653) which is equal to the square of the number of reference pulses produced since BPNT 1.

The next positive-going transition of the CLOCK signal will reset flip-flop 637 whereby gate 653 will be disabled and flip-flop 639 will be held in reset.

In accordance with the foregoing, it should be apparent that prior to the occurrence of a reference pulse, the incrementing counter is set at the value of i for such reference pulse, i being equal to the sequential number of such pulse since BPNT 1 minus one and such value is loaded into the multiplying counter. On the first positive-going transition of the CLOCK signal after the occurrence of such pulse, flip-flop 637 is set and remains set until the first positive-going transition of the CLOCK signal after flip-flop 637 is set and after the count in the multiplying register becomes zero. While flip-flop 637 is HIGH, a dividend pulse will be produced for each negative-going transition of the CLOCK signal and the multiplying counter will count down for every other positive-going transition of the CLOCK signal. Thus, by the time the multiplying counter has counted down from i to zero, 2i dividend pulses will have been produced all of which will have been counted by the dividing counter. Because in accordance with the connection of flip-flop 639 to the multiplier counter, the multiplier counter will count down to zero almost coincidentally with a positive-going transition of the CLOCK signal, there will be an additional negative-going transition of the CLOCK signal before flip-flop 637 is reset. As a result, an additional dividend pulse will be produced before flip-flop 637 is reset. Because flip-flop 637 can be set only once by a reference pulse, a total of $2i+1$ squaring pulses will be produced for each reference pulse after BPNT1.

In addition, after the multiplying counter has counted down to zero, the incrementing counter will be incremented by one to the next value of i, and such value if i is loaded into the multiplying counter in anticipation of the next reference pulse.

Thus, after BPNT1, $2i+1$ divided, pulses will be generated for each reference pulse generated before the incrementing counters, the dividing counter and flip-flops 635, 637 are reset by the next BLOW PULSE (NT) ("BPNT2") or a negative-going transition of the MODE signal. Where n reference pulses have occurred during the interval, the number of dividend pulses produced during such time will be:

$$\sum_{i=0}^{i=n-1} 2i+1$$

which, as indicated supra, equals $n^2$. Thus, $n^2/256$ negative-going transitions of the CALCULATION OUT signal will occur between each BLOW PULSE (NT) and the next following BLOW PULSE (NT) or negative-going transition of the MODE signal, whichever occurs first. In this regard, in accordance with the description of mode signalling circuit 511 supra, a negative-going transition of the MODE signal coincides with either a BLOW PULSE (T) or an error detection.

The foregoing sequence will follow every BLOW PULSe (NT) whereby during the interval between any BLOW PULSE (NT) and time tz before the next BLOW PULSE (NT), BLOW PULSE (T) or error detection, whichever occurs first, there will have been approximately 40.1 $tz^2$ transitions of the CALCULATION OUT signal. Whenever a BLOW PULSE (T) or an error detection occurs, however, the MODE signal will go LOW and remain LOW throughout the resulting A mode. Thus, the dividing counter will be held in reset and the CALCULATION OUT signal will be held LOW throughout the A mode of each blow sequence LOW. In this latter regard, when the average stroke calculation of an A mode is completed, the MODE signal will go HIGH and calculation circuit will begin to generate squaring pulses prior to the occurrence of a BLOW PULSE (NT). Such squaring pulses have no significance since they are not utilized by the remainder of the circuit.

In addition to the CALCULATION OUT signal, calculation circuit 513 also provides a DELAYED MODE signal at the output of gate 657 which will go LOW whenever there is a BLOW PULSE (NT), whenever the MODE signal is LOW and whenever the output of gate 655 in HIGH, and is HIGH for all other conditions. The only significance of the DELAYED MODE signal is that it provides negative-going transitions that trail the negative-going transitions of the MODE signal by the delay of gates 657, 659.

(8) Accumulator Circuit

Accumulator circuit 515 includes the accumulating counter of the computing circuit. In accordance with the functional description of the computing circuit, the accumulating counter counts the number of negative-going transitions of the CALCULATION OUT signal occurring during the B mode of a blow sequence in order to provide a dividend for calculating the average stroke for such blow sequence. Accumulator circuit 515 provides the ACCUMULATOR $\phi$ signal which indicates that the dividing phase of the A mode of a blow sequence has been completed.

Referring to FIG. 18, accumulator circuit 515 includes the following components:

| Component Name | Reference No. | Preferred Type or Value |
|---|---|---|
| Binary Up/Down Counter | 675 | 4516 |
| Binary Up/Down Counter | 676 | 4516 |
| Binary Up/Down Counter | 677 | 4516 |
| Binary Up/Down Counter | 678 | 4516 |
| Binary Up/Down Counter | 679 | 4516 |
| Capacitor | 685 | 4700 pfd. |

The components of accumulator circuit 515 are interconnected as follows: The load inputs of counters 675–679 are all connected to circuit ground. The A, B, C, D inputs of counters 675–679 are all connected to circuit ground. The master output of counter 675 is connected to the enable input of counter 676; the master output of counter 676 is connected to the enable input of counter 677; the master output of counter 677 is connected to the enable input of counter 678; and the master output of counter 678 is connected to the enable input of counter 679. The master output of counter 679 is connected to one side of capacitor 685. The other side of capacitor 685 is connected to circuit ground.

External signals are supplied to accumulator circuit 515 as follows: The RESET 2 signal is supplied to the enable input of counter 675. The MODE signal is supplied to the Up/Down inputs of counters 675–679. The RESET 3 signal is supplied to the reset inputs of counters 675–683. A CLOCK C signal, which is provided by the counter/clock control circuit as described infra, is supplied to the clock input of counters 675–679. During the reset and B modes of a blow sequence, the CLOCK C signal is the inverse of the CALCULATION OUT signal. During the A mode, the CLOCK C signal is the same as the CLOCK signal.

In accordance with the foregoing, counters 675–679 are wired as a 20-bit binary counter that constitutes the accumulating counter. The accumulating counter is clocked by the CLOCK C signal. The accumulating counter will count up during the B mode (MODE signal is HIGH) and will count down during the A mode (MODE signal is LOW). The accumulating counter is held in reset by the RESET 3 signal during the reset mode. Accumulator circuit 515 provides the ACCUMULATOR $\phi$ signal at the master output of counter 679 whereby the ACCUMULATOR $\phi$ signal is LOW during the A mode when the count of the accumulating counter is zero and during the B mode and reset modes when such count is 1,048,575 (an impossible condition in the preferred embodiment), and is HIGH for all other conditions.

In accordance with the foregoing, during each blow sequence, accumulating circuit 515 operates as follows:

(1) During the reset mode of the blow sequence, the count of the accumulating counter is held at zero by RESET 3. Because the MODE signal is HIGH during the reset mode, the master output of counter 679 and the ACCUMULATOR $\phi$ signal will be HIGH during such time.

(2) During the B mode, the accumulating counter will count up by one on every negative-going transition of the CALCULATION OUT signal. In accordance with the description of calculation circuit 513, supra, at the end of a B mode terminated by a terminating blow pulse, the count of the accumulating counter will be approximately $$\sum_{i=1}^{i=n} 40.1 t_i^2$$

where n is the number of B mode blow pulses of the blow sequence, i.e., the sequence blow count, and $t_i$ is the time differential between the $i^{th}$ B mode blow pulse of such blow sequence and the immediately preceding blow pulse. At the end of a "B" mode terminated by an error detection, the count of the accumulating counter will be approximately $$\sum_{i=1}^{i=m} 40.1 t_i^2 + 40.1 t_{max}^2$$

where $t_{max}$ is the predetermined amount of time since the last B mode blow that results in an error detection, i.e., the time differential between the error detection and the last B mode blow.

(3) During the A mode, the accumulating counter will count down by one on every positive-going transition of the CLOCK until the count of the accumulating counter reaches zero at which time the ACCUMULATOR $\phi$ signal will go LOW. As set forth in the description of reset circuit 503 and mode signalling circuit 511, supra, on the next positive-going transition of the CLOCK signal after the AVERAGE COMPLETE signal goes LOW, RESET 2 will go HIGH, RESET 3 will go HIGH, INV. RESET 3 will go LOW, the flip-flop of mode signalling circuit 511 will be reset and the MODE signal will go HIGH. Because both the MODE signal and the RESET 3 signal are HIGH, whereby the count of the accumulating counter is again held at zero, the ACCUMULATOR $\phi$ signal will go HIGH. Thus, on the first positive-transition of the CLOCK signal after the ACCUMULATOR $\phi$ signal goes LOW, the A mode of one blow sequence ends and the reset mode of a new blow sequence begins, and the sequential operation of accumulating circuit 515 will begin again.

It should be noted that the accumulating counter counts down continuously on every positive-going transition of the CLOCK during the A mode of every blow sequence regardless of whether the B mode was terminated by a terminating blow or an error detection. Where the B mode was terminated by a terminal blow, the dividing phase will begin immediately after the resulting BLOW PULSE (T) and all of such counting down by the accumulating counter will be part of the dividing phase of the resultant A mode. Where the B mode was terminated by an error detection, however, the accumulating counter will first count down by an amount equal to 4.01 $t_{max}2$ during the error correcting phase of the resultant A mode before beginning the dividing phase. In either case, the count of the accumulating counter at the beginning of the dividing phase will always be approximately $$\sum_{i=1}^{i=m} 40.1 t_i^2$$

i.e., the dividend count. Thus, during the dividing phase, the accumulating counter will count down from the dividend count to zero. Because such zero count marks the end of the dividing phase, the number of positive-going transitions of the CLOCK C signal during the dividing phase will be equal to the dividend count.

(9) Divider Circuit

Divider circuit 517 includes the dividing counter of the computing circuit and provides a "DIVIDER OUT" signal that includes a quantity of pulses, each having a negative-going transition, generated during the dividing phase of the "A" mode of a blow sequence, such quantity being substantially equal to the number of negative-going transitions provided by the CALCULATION OUT signal during the "B" mode of such blow sequence, i.e., the "dividend count" of the blow sequence, divided by the sequence blow count.

Referring to FIG. 19, divider circuit 517 includes the following components:

| Component Name | Reference No. | Preferred Type or Value |
|---|---|---|
| BCD Up/Down Counter | 687 | 4510 |
| BCD Up/Down Counter | 688 | 4510 |
| BCD Up/Down Counter | 689 | 4510 |
| 2-Input NAND Gate | 693 | ¼ 4011 |
| Inverter | 695 | 1/6 4069 |
| Inverter | 697 | 1/6 4069 |
| Capacitor | 698 | 4700 pfd. |

The components of divider circuit 517 are interconnected as follows: The Up/Down inputs and the reset inputs of counters 687–689 are all connected to circuit ground. The enable input of counter 687 is connected to circuit ground. The main output of counter 687 is connected to the enable input of counter 688. The main output of counter 688 is connected to the enable input of counter 689. The master output of counter 689 is connected to one input of gate 693. The output of gate 693 is connected to the input of inverter 695. The output of inverter 695 is connected to the input of inverter 697. The output of inverter 697 is connected to the load input of counters 687 through 689. Capacitor 698 is connected between the master output of counter 689 and circuit ground.

External signals are supplied to divider circuit 517 as follows: BC-1 is connected in parallel to the A, B, C, D inputs of counter 687. BC-10 is connected in parallel to the A, B, C, D inputs of counter 688. BC-100 is connected in parallel to the A, B, C, D inputs of counter 689. The DIVIDING signal is supplied to the remaining input of gate 693. The CLOCK C signal is supplied to the clock inputs of counters 687–689.

In accordance with the foregoing, counters 687–689 are wired as a 3-decade BCD counter that constitutes the dividing counter. The dividing counter is loaded with the count of the blow counter whenever the output of inverter 697 is HIGH and counts down by one on every positive-going transition of the CLOCK C signal whenever the output of inverter 697 is LOW. The output of inverter 697 is HIGH wherever the computing circuit is not in the dividing phase of the A mode of a blow sequence. During the dividing phase of the A mode of a blow sequence, the output of inverter is HIGH only when the master output of counter 689 is LOW, i.e., the count of the dividing counter is zero. The DIVIDER OUT signal is provided at the output of inverter 695 and will, at all times, be the inverse of the output of inverter 697.

During each blow sequence, divider circuit 517 will operate as follows:

(1) During the reset mode, the dividing counter will be loaded continuously with the count of the blow counter during the reset mode, e.g., zero.

(2) During the B mode, the dividing counter will be loaded continuously with the count of the blow counter. Thus, during the B mode, the count of the dividing counter will increment on every B mode blow pulse counted by the blow counter. Thus, at the end of the B mode, the count of the dividing counter will be the sequence blow count.

(3) During the error correction phase, if any, of the A mode, the count of the dividing counter will be held at the sequence blow count.

(4) Throughout the dividing phase of the A mode, the DIVIDING signal will be HIGH. Assuming the sequence blow count does not equal zero, the master output of counter 689 also will be HIGH. As a result, at the beginning of such dividing phase, the DIVIDER OUT signal will go HIGH and the dividing counter will count down by one on every positive-going transition of the CLOCK C signal. After n positive-going transitions of the CLOCK C signal, n being equal to the sequence blow count, the count of the dividing counter will go to zero, the master output of counter 689 will go LOW, the DIVIDER OUT signal will go LOW, the count of the dividing counter will be reset at the sequence blow count, the master output and the DIVIDER OUT signal will again both go HIGH and the dividing counter will begin counting down again. The sequence of the preceding sentence will be repeated after every n positive-going transitions of the CLOCK C signal. Thus, during the dividing phase, there will be a negative-going transition of the DIVIDER OUT signal for every n positive-going transitions of the CLOCK C signal. Because as set forth in the description of accumulator circuit 515; supra, the number of positive-going transitions of the CLOCK C signal during the dividing phase will be equal to the dividend count, the number of negative-going transitions of the DIVIDER OUT signal will be the dividend count divided by n, i.e., the dividend count divided by the sequence blow count. This number can be expressed as:

$$[\sum_{i=1}^{i=n} 40.1\, t_i^2]n$$

(10) Clock Gating Circuit

Clock gating circuit 519 gates various clocking type signals so that the appropriate clocking signal is provided to various of the counters of the computing circuit at the appropriate part of a blow sequence. In particular, clock gating circuit 519 gates the CLOCK signal, the CALCULATION OUT signal and the DIVIDER OUT signal to provide three gated clocking signals: a CLOCK A signal, a CLOCK B signal and a CLOCK C signal.

Referring to FIG. 20, clock gating circuit 519 includes the following components:

| Component Name | Reference No. | Preferred Type or Value |
|---|---|---|
| 2-Input NOR Gate | 741 | ¼ 4001 |

-continued

| Component Name | Reference No. | Preferred Type or Value |
|---|---|---|
| 2-Input NOR Gate | 743 | ¼ 4001 |
| 2-Input NOR Gate | 745 | ¼ 4001 |
| 2-Input NOR Gate | 747 | ¼ 4001 |

The components of counter/clock control circuit 519 are interconnected as follows: The output of gate 741 is connected to one input of gate 743. The output of gate 743 is connected to one input of gate 745. The output of gate 745 is connected to one input of gate 747.

External signals are supplied to counter/clock control circuit 525 as follows: The CLOCK signal is supplied to one input of gate 741. The MODE signal is supplied to the other input of gate 741. The CALCULATOR OUT signal is supplied to the remaining input of gate 743. The DIVIDING signal is supplied to the remaining input of gate 745. The DIVIDER OUT signal is supplied to the remaining input of gate 747.

During the blow sequence, counter/clock control circuit 525 as shown in FIG. 24 operates as follows:

(1) Throughout the reset mode, the MODE signal will be HIGH, the DIVIDING signal will be LOW and the DIVIDER OUT signal will be LOW. Thus, the output of gate 741 will be LOW and the output of gate 743, which provides the CLOCK C signal, will be the inverse of the CALCULATION OUT signal; the output of gate 745, which provides the CLOCK B signal, will be the CALCULATION OUT signal; and the output of gate 747, which provides the CLOCK A signal, will be the inverse of the CLOCK A signal.

(2) During the B mode, the MODE signal will remain HIGH and the DIVIDING and DIVIDER OUT signals will remain LOW whereby the CLOCK A, CLOCK B and CLOCK C signals will be the same as for the reset mode.

(3) During the error correcting phase, if any, of the A mode, the DIVIDING signal and the DIVIDER OUT signals will remain LOW, but the MODE signal will go LOW whereby the CALCULATION OUT signal will be held LOW. Thus, the output of gate 741 will be the inverse of the CLOCK signal and the CLOCK C signal will be the CLOCK signal; the CLOCK B signal will be the inverse of the CLOCK signal; and the CLOCK A signal will be the same as the CLOCK signal.

(4) During the dividing phase of the A mode, the MODE signal and the CALCULATION OUT signal will remain LOW as in the error correcting phase whereby the CLOCK C signal will still be the same as the CLOCK signal. The DIVIDING signal, however, will go HIGH whereby the CLOCK B signal will be LOW. As a result, the CLOCK A signal will be the inverse of the DIVIDER OUT signal which, during the dividing phase as described supra, will be producing pulses.

(11) Stroke Count Circuit

Stroke count circuit 521 includes the stroke counter of the computing circuit and provides in 2½ decade BCD format (1) the stroke in units of tenths of feet for each non-terminating B mode blow pulse, such stroke being provided momentarily at the time of the BLOW PULSE (NT) corresponding to such B mode blow pulse and (2) the average stroke in units of tenths of feet of the B mode blow pulses of a particular blow sequence immediately upon the completion of the computation of such average stroke, i.e., when the ACCUMULATOR $\phi$ signal goes LOW.

Referring to FIG. 21, stroke count circuit 521 includes the following components:

| Component Name | Reference Number | Preferred Type or Value |
|---|---|---|
| BCD Up/Down Counter | 699 | 4510 |
| BCD Up/Down Counter | 701 | 4510 |
| J-K Flip-Flop | 703 | ½ 4027 |
| Inverter | 705 | 1/6 4069 |
| Inverter | 707 | 1/6 4069 |

The components of stroke count circuit 521 are interconnected as follows: The output of inverter 705 is connected to the enable input of counter 699. The main output of counter 699 is connected to the enable input of counter 701. The A, B, C inputs of counter 699 and the A, D inputs of counter 701 are connected to $V_{cc}$. The D input and the reset input of counter 699 and the B, C inputs and the reset input of counter 701 are connected to circuit ground. The main output of counter 701 is connected to the input of inverter 707. The output of inverter 707 is connected to the J and to the K inputs of flip-flop 703. The reset input of flip-flop 703 is connected to circuit ground.

External signals are supplied to stroke count circuit 519 as follows: The ACCUMULATOR $\phi$ signal is supplied to the input of inverter 705. The CLOCK A signal, which is provided by the counter/clock control circuit as described infra, is supplied to the clock inputs of counter 699, 701 and the clock input of flip-flop 703. A STROKE COUNT DIRECTION signal, which is supplied by error correction circuit 523 as described infra, is supplied to the up-down inputs of counters 699, 701. The STROKE COUNT signal is LOW during the portion of the error correcting phase of the A mode of a blow sequence in which 40.1 $t_{max}^2$ is subtracted from the accumulating counter, i.e., during the "first portion" of the error correcting phase, and is HIGH at all other times. A STROKE PRESET signal, which is provided by stroke counter load circuit 525 as described infra, is supplied to the load input of counters 699, 701 and to the set input of flip-flop 703. The STROKE PRESET signal includes a positive-going pulse; (1) on every cycle of the CLOCK signal during the reset mode; (2) immediately after such BLOW PULSE (NT); (3) coinciding with each BLOW PULSE (T); (4) immediately after the first portion of the error connecting phase, if any, of the A mode of a blow sequence; and (5) at the end of the error correcting phase, if any, of the A mode of a blow sequence.

Counters 699, 701, inverter 707 and flip-flop 703 constitute the 2½ decade stroke counter with the output of counter 699 providing the least significant digit ("SC-1") of the stroke/average stroke in BCD format, the output of counter 701 providing the intermediate digit ("SC-10")of the stroke/average stroke in BCD format, and the output of flip-flop 703 providing the most significant digit ("SC-100") of the stroke/average stroke as either a 1 or a 0.

The count direction of the stroke counter is controlled by the STROKE COUNT DIRECTION signal such that the stroke counter will count down during the first portion of the error correcting phase, if any, of the A mode of a blow sequence and will count up at all other times. The stroke counter count inputs and load input are wired such that whenever the STROKE PRESET signal provides a positive-going pulse, a count of 197 will be loaded into the stroke counter. In this regard, it should be noted that a count of 197 in a $2\frac{1}{2}$ decade counter set to count up is the equivalent of minus 3. Thus, a count of minus 3 will be loaded into the stroke counter: (1) on every cycle of the CLOCK signal during the reset mode; (2) immediately after every BLOW PULSE (NT); (3) concurrently with each BLOW PULSE (T); (4) immediately after the first portion of an error correcting phase; and (5) at the end of an error correcting phase. The stroke counter is clocked by the CLOCK A signal.

The stroke counter is disabled by the ACCUMULATOR $\phi$ signal when such signal is low; i.e., when the ACCUMULATOR $\phi$ signal is LOW, the stroke counter cannot be clocked and the count of the stroke counter will be held at the count existing when such signal went LOW.

In accordance with the foregoing, stroke count circuit 521 operates as follows:

(1) During the reset mode, the stroke counter is continuously loaded with a count of 197, i.e., minus 3.

(2) After the BLOW PULSE (NT) corresponding to the initiating blow pulse, the B mode will begin and the stroke counter will be loaded with a count of 197, i.e., minus 3. The stroke counter will then count up by one on every negative-going transition of the CALCULATION OUT signal until one of the following events occurs: (a) another BLOW PULSE (NT); (b) a BLOW PULSE (T); or (c) an error detection. In accordance with the description of calculation circuit 513 which provides the CALCULATION OUT signal, the count of the stroke counter at the time of such event, regardless of its nature, will be $40.1t^2-3$ where t is the time, in seconds, between such BLOW PULSE (NT) corresponding to the initiating blow pulse and such event. As indicated supra, where such event is another BLOW PULSE (NT) or a BLOW PULSE (T), such count is approximately equal to the stroke, in tenths of feet, of the blow corresponding to such other BLOW PULSE (NT) or such BLOW PULSE (T). Where such event is an error detection, such count is $t_{max}$ or, in the preferred embodiment, 199. The operation of stroke count circuit 521 after such event is dependent on the nature of the event.

If such event is another BLOW PULSE (NT), the operation is the same as for the BLOW PULSE (NT) corresponding to the initiating blow pulse. Thus, immediately after such other BLOW PULSE (NT), the stroke counter will be loaded with a count of 197 and will then count up by one on every negative-going transition of the CALCULATION OUT signal until one of the events (a), (b) or (c) occurs.

If such event is a BLOW PULSE (T), the DIVIDING signal will go HIGH and the MODE signal will go LOW and the dividing phase of the A mode will begin. Operation of stroke count circuit 521 during the dividing phase of the A mode is described infra.

If such event is an error detection, the MODE signal will go LOW but the DIVIDIING signal will remain LOW and the error correcting phase of the A mode will begin. Operation of stroke count circuit 521 during such an error correcting phase is described infra.

(3) During the dividing phase of the A mode, the stroke counter will count up by one on every negative-going transition of the DIVIDER OUT signal. In accordance with the description of divider circuit 517, supra, the number of negative-going transitions of the DIVIDER OUT signal during a dividing phase of a blow sequence is:

$$[\sum_{i=1}^{i=n} 40.1t_i^2]/n$$

Thus, the count in the stroke counter at the end of the dividing phase will be:

$$[8\sum_{i=1}^{i=n} 40.1ti^2]/n] - 3$$

This count can be alternately expressed as:

$$[\sum_{i=1}^{i=n} 40.1t_i^2 - 3]/n$$

which, in accordance with the functional description of the computing circuit, is the average stroke in units of tenths of feet for the blow sequence that includes such dividing phase. Thus, the count of the stroke counter at the time the stroke counter is disabled by the ACCUMULATOR $\phi$ signal will be the equivalent of the average stroke for the blow sequence terminated by such ACCUMULATOR $\phi$ signal.

(4) During an error correcting phase, the stroke counter initially will count down by one on every positive-going transition of the CLOCK. This will continue until the count of the stroke counter becomes zero, i.e., until the first portion of the error correcting phase ends. Because an error detection occurs whenever a time $t_{max}$ has passed since the last BLOW PULSE (NT), there will have been 40.1 $t_{max2}$ negative-going transitions of the CALCULATION OUT signal since such last BLOW PULSE (NT) whereby, at the time of the error detection, the count of the stroke counter will be 40.1 $t_{max2}-3$. Thus, during the first portion of the error correcting phase, there will be $40.1t_{max2}-3$ positive-going transitions of the CLOCK. The stroke counter will then be loaded with a count of 197 and will count up by one on every positive-going transition of the CLOCK. This will continue until the count of the STROKE COUNTER again becomes zero at which time the error correcting phase will end. Because 197 is the equivalent of minus 3 for a $2\frac{1}{2}$ decade counter, there will be 3 positive-going transitions of the CLOCK during the second portion of the error correcting phase whereby the total number of positive-going transitions of the CLOCK during the error correcting phase will be 40.1 $t_{max2}$. In accordance with the operation of accumulator circuit 515 as described supra, the accumulating counter will count down by one on every positive-going transition of the CLOCK during the error correcting phase. Because, as set forth supra, the count of the accumulating counter at the time of an error detection is $$[\sum_{i=1}^{i=n} 40.1 t_i^2] + 40.1\ t_{max}^2$$

the count of the accumulating counter at the end of the error correcting phase will be $$[\sum_{i=1}^{i=2} 40.1\ t_i^2] + 40.1\ t_{max}^2 - 40.1\ t_{max}^2 = \sum_{i=1}^{i=n} 40.1\ t_i^2$$

Thus, it can be seen that during the error correcting phase, the count of the accumulating counter is corrected to the dividend count. As a result, when the error correcting phase ends, the dividing phase begins and the operation of stroke count circuit 519 proceeds as described supra.

Stroke count circuit 519 further provides (1) a STROKE COUNT 99/0 signal that will be HIGH when SC-1 and SC-10 are both zero and the stroke counter is counting down and when SC-1 and SC-10 are both 9 and the stroke counter is counting up, and will be LOW at all other times, and (2) an INV. SC-100 signal that is the inverse of SC-100. The STROKE COUNT 99/0 signal is provided at the output of inverter 707. The INV. SC-100 signal is provided at the inverted output of flip-flop 703.

(12) Error Correction Circuit

Error correction circuit 521 detects the passage of time $t_{max}$ since the last B mode blow pulse, essentially controls the operation of the remainder of the computing circuit while the count of the accumulating counter is corrected to the dividend count, and then signals the end of the error correcting phase so that the dividing phase can begin. Thus, error correction circuit 521 provides (1) the ERROR DETECTED signal for indicating that a predetermined amount of time has elapsed since the last B mode blow pulse; (2) the ERROR CORRECTED PULSE for indicating that the error correcting phase is completed, i.e., that the count of the accumulating counter has been corrected to the dividend count; (3) the STROKE COUNT DIRECTION signal for controlling the direction of count, up or down, of the stroke counter; and (4) a STROKE $\phi$ signal for separately indicating the ends of each of the portions of an error correcting phase. Specifically, the ERROR DETECTED signal is HIGH during an error correcting phase and is LOW at all other times; the ERROR CORRECTED PULSE is a negative-going pulse occurring at the end of an error correcting phase; the STROKE COUNT DIRECTION signal is LOW during the first portion of an error correcting phase and is HIGH at all other times; and the STROKE $\phi$ signal includes a single negative-going pulse at the end of each portion of an error correcting phase.

Referring to FIG. 22, error correction circuit 523 includes the following components:

| Component Name | Reference Number | Preferred Type or Value |
|---|---|---|
| Monostable Multivibrator | 707 | ½ 4098 |
| D-Type Flip-Flop | 709 | ½ 4013 |
| 4-Input NAND Gate | 711 | ½ 4012 |
| 3-Input NAND Gate | 713 | ⅓ 4023 |

-continued

| Component Name | Reference Number | Preferred Type or Value |
|---|---|---|
| 2-Input NAND Gate | 715 | ¼ 4011 |
| 2-Input NAND Gate | 717 | ¼ 4011 |
| 2-Input NAND Gate | 719 | ¼ 4011 |
| 4-Input NOR Gate | 721 | ½ 4002 |
| 2-Input NOR Gate | 723 | ¼ 4001 |
| Inverter | 725 | 1/6 4069 |
| Inverter | 727 | 1/6 4069 |
| Capacitor | 729 | 470 mfd. |
| Capacitor | 731 | 4700 pfd. |
| Resistor | 733 | 22 Kohm |

The components of error correction circuit 521 are interconnected as follows: The output of gate 711 is connected to one side of capacitor 729 and to one input of gate 715. The other side of capacitor 729 is connected to circuit ground. The output of gate 715 is connected to one input of gate 713. The output of gate 713 is connected to the other input of gate 713, the reset input of flip-flop 709, the input of inverter 727 and one input of gate 721. The output of inverter 727 is connected to one input of gate 719. The output of gate 719 is connected to one input of gate 723. The output of gate 723 is connected to one input of gate 721. The output of gate 721 is connected to the positive trigger input of multivibrator 707. The negative trigger input and the reset input of multivibrator 707 are connected to $V_{cc}$. One side of capacitor 731 is connected to pin 1 of multivibrator 707 and the other side of capacitor 731 is connected to pin 2 of multivibrator 707 and to one end of resistor 733. The other end of resistor 733 is connected to $V_{cc}$. The output of multivibrator 707 is connected to the input of inverter 725 and to one input of gate 717. The output of inverter 725 is connected to the clock input of flip-flop 709. The data input of flip-flop 709 is connected to $V_{cc}$. The set input of flip-flop 709 is connected to circuit ground. The output of flip-flop 709 is connected to the other input of gate 717. The inverted output of flip-flop 709 is connected to the other input of gate 719.

External signals are supplied to error correction circuit as follows: The INV. BLOW PULSE 1 signal is supplied to one input of gate 711 and the INV. BLOW PULSE 2 signal is supplied to another input of gate 711. The STROKE COUNT 100 signal is supplied to one input of gate 711 and to one input of gate 721. The STROKE COUNT 99/0 signal is supplied to the remaining input of gate 711 and to the remaining input of gate 723. The CLOCK A signal is supplied to the remaining input of gate 721. The INV. DIVIDING signal is supplied to one input of gate 713. An ERROR RESET signal, which is provided by stroke counter load circuit 525 as described infra, is supplied to the remaining input of gate 713. The ERROR RESET signal goes LOW at the beginning of the reset mode of each blow sequence, stays LOW until the end of the BLOW PULSE (NT) corresponding to the initiating blow pulse, and is HIGH at all other times.

The detection of the passage of time $t_{max}$ since the last B mode blow pulse is accomplished by gate 711. In this regard, it should be noted that after the passage of time $t_{max}$, the count of the stroke counter will be 40.1 $t_{max2}-3$. Thus, gate 711 is connected to the stroke counter such that when the count of the stroke counter is 40.1 $t_{max2}-3$, the output of gate 711 goes LOW and is HIGH for all other counts of the stroke counter. It has been found that a count of 199 in the stroke counter ordinarily corresponding to an excessively large passage of time since the last B mode blow pulse. Therefore, in the preferred embodiment gate 711 is connected to the stroke counter such that when the stroke counter is counting up (as it will be during the B mode) and the count of the stroke counter reaches 199, the output of gate 711 will go LOW.

INV. BLOW PULSE 2 disables gate 711 for a period of time after each blow pulse so that the stroke counter can count up from its preloaded count of 197, i.e., minus 3, past 199 without causing the output of gate 711 to go LOW. INV. BLOW PULSE 1 disables gate 711 in order to prevent triggering an error correcting phase at the same time the blow counter is incremented. This prevents the calculation of an invalid average due to an incorrect sequence blow count. Instead, the stroke of such blow will be included in the average. Capacitor 729 at the output of gate 711 prevents race condition between the 199 detection and INV. BLOW PULSE 1.

Gates 713, 715 are wired as an error detection flip-flop having an output at the output of gate 715 and an inverted output at the output of gate 713. Thus, the error detection flip-flop is set when the output of gate 711 goes LOW and is reset when the INV. DIVIDING signal goes LOW, i.e., when the dividing phase begins, or when the ERROR RESET signal goes LOW, i.e., when each reset mode begins.

Multivibrator 707 has an astable period having a length less than the period of the CLOCK.

In accordance with the foregoing, error correcting circuit 521 operates as follows:

(1) During the reset mode, the error detection flip-flop will be held reset by the ERROR RESET signal and the entire error correcting circuit will be in a stable condition wherein (a) the inverted output of the error detection flip-flop will be HIGH, (b) the ERROR DETECTED signal will be LOW, (c) the STROKE COUNT DIRECTION signal will be HIGH (so that the stroke counter is set to count up), (d) the output of gate 721 will be low, (e) multivibrator 707 will be in its stable condition, i.e., the output of multivibrator 707 will be LOW, (f) the STROKE $\phi$ signal will be HIGH, (g) the output and inverted output of flip-flop 709 will be LOW and HIGH, respectively, and (h) the ERROR CORRECTED signal will be HIGH.

(2) During the B mode, the ERROR RESET signal and the INV. DIVIDING signal will be HIGH whereby the error detection flip-flop will be enable, i.e., the error detection flip-flop will be set when the output of gate 711 goes LOW. Unless the output of gate 711 goes LOW during such B mode, the error correcting circuit will remain in the stable condition existing during the reset mode throughout such B mode.

(3) If the B mode is terminated by a terminating blow pulse, i.e., there is no error detection, the INV. AVERAGING signal will go LOW immediately after such B mode thus disabling the error detection flip-flop and holding the error correcting circuit in the stable condition existing during the reset mode. Thus, the error correcting circuit remains in a stable condition throughout a blow sequence having no error detection. As a result, there is no error correcting phase of the A mode of such a blow sequence.

(4) If, during the B mode, the time $t_{max}$ passes since the last BLOW PULSE (NT), i.e., if the count of the stroke counter becomes 199 while the stroke counter is counting up at some time greater than the width of the INV. BLOW PULSE 2 since the last BLOW PULSE (NT), the output of gate 711 will go LOW whereby the error detection flip-flop will go HIGH. Thus, the reset will be removed from flip-flop 709, gate 721 will be enabled, and the ERROR DETECTED signal will go HIGH thus indicating an error detection, causing the MODE signal to go HIGH and initiating the A mode of the blow sequence. The STROKE COUNT DIRECTION will go LOW thus causing the stroke counter to count down as described supra. When the count of the stroke counter reaches 100, the STROKE COUNT 99/0 will go HIGH and the output of gate 723 will go LOW. Because the STROKE COUNT 100 signal is still HIGH, the output of gate 721 will remain LOW and multivibrator 707 will remain in its stable state. When the count of the stroke counter reaches zero, however, both the STROKE COUNT 100 and the STROKE COUNT 99/0 signals will go LOW and, on the following negative-going transition of the CLOCK A signal (which, during the error correcting phase, will correspond to a negative-going transition of the CLOCK), the output of gate 721 will go HIGH. As a result, there will be positive-going pulse at the output of multivibrator 707 and a negative-going pulse at the output of inverter 725. Thus, the STROKE $\phi$ signal will have a negative-going pulse. Flip-flop 709 will be set at the end of such negative-going pulse. Because flip-flop 709 is not set until the end of such pulse, the output of multivibrator 707 will be LOW when the output of flip-flop 709 goes HIGH whereby the ERROR CORRECTED signal provided at the output of gate 717 will remain HIGH. The negative-going pulse of the STROKE $\phi$ signal will cause the stroke counter to be reloaded with a count of 197 as described supra and the LOW at the inverted output of flip-flop 709 will cause the STROKE COUNT DIRECTION signal to go HIGH. The 197 count of the stroke counter will cause the output of gate 721 to go LOW. The stroke counter will then count up as described supra until a count of zero is reached at which time the output of gate 721 will go HIGH. As a result, a positive-going pulse will be produced at the output of multivibrator 707 and both the STROKE $\phi$ signal and the ERROR CORRECTED signal will have negative-going pulses. The negative-going pulse of the STROKE $\phi$ signal will load the stroke counter with a count of 197 in preparation for the dividing phase and the negative-going pulse of the ERROR CORRECTED signal will cause the DIVIDING signal to go HIGH thus beginning the dividing phase. Furthermore, the INV. DIVIDING signal will go LOW thus resetting the error detection flip-flop and placing the error correcting circuit in its stable state.

(13) Stroke Counter Load Circuit

Stroke counter load command circuit 527 provides positive-going pulses in a STROKE PRESET signal for loading the stroke counter at various times during a blow sequence as indicated in the description of stroke counter circuit 519, supra. Stroke counter load command circuit also provides an ERROR RESET signal for holding the error detection flip-flop of the error correcting circuit in reset during the reset period.

Referring to FIG. 23, stroke counter load command circuit 525 includes the following components:

| Component Name | Reference Number | Preferred Type or Value |
|---|---|---|
| D-Type Flip-Flop | 748 | ½ 4013 |
| 3-Input NAND Gate | 749 | ⅓ 4023 |
| 2-Input NAND Gate | 750 | ¼ 4011 |

The components of stroke counter load command circuit 527 are interconnected as follows: The set input of flip-flop 748 is connected to circuit ground. The inverted output of flip-flop 748 is connected to one input of gate 750. The output of gate 750 is connected to one input of gate 749.

External signals are supplied to stroke counter load command circuit 527 as follows: The BLOW PULSE (NT) signal is supplied to the data input of flip-flop 748. The CLOCK signal is supplied to the clock input of flip-flop 748. The RESET 3 signal is supplied to the reset input of flip-flop 748. The INV. CLOCK signal is supplied to the remaining input of gate 750. The BLOW PULSE (T) signal is supplied to one input of gate 749. The STROKE $\phi$ signal is supplied to the remaining input of gate 749.

In stroke counter load command circuit 527 as shown in FIG. 23, the STROKE PRESET signal is provided at the output of gate 749 and the ERROR RESET signal is provided at the Q output of flip-flop 748. During a blow sequence, such circuit operates as follows:

(1) During the reset mode, flip-flop 748 is held in reset whereby the ERROR RESET signal is LOW and gate 750 is enabled. Thus, the output of gate 750 will be the inverse of the INV. CLOCK. Because there will be no STROKE $\phi$ pulse or GATED "A" PULSE during the reset mode, the STROKE PRESET signal will be the same as the INV. CLOCK signal.

(2) During the B mode, flip-flop 748 will be reset at the end of each BLOW PULSE (NT) and will be set on the next positive-going transition of the CLOCK signal after the end of such BLOW PULSE (NT). In this regard, it should be noted that the end of a BLOW PULSE (NT) corresponds to a positive-going transition of the CLOCK signal, but is delayed by gates 630, 627 of the mode control circuit 511 whereby there will be a positive-going transition of the CLOCK signal slightly prior to the end of the BLOW PULSE (NT). Thus, the ERROR RESET signal will go LOW for one period of the CLOCK. On the next positive-going transition of the INV. CLOCK signal after the BLOW PULSE (NT), the output of gate 750 will go LOW whereby there will be a positive-going pulse at the STROKE PRESET signal. Thus, during the B mode, there will be a positive-going pulse of the STROKE PRESET signal approximately one-half period of the CLOCK after each BLOW PULSE (NT). Furthermore, during the B mode, there will be a positive-going pulse of the STROKE PRESET signal corresponding to the BLOW PULSE (T), if any, at the end of the "B" mode.

(3) During the A mode, the MODE signal will be LOW whereby there will be no BLOW PULSE (NT) or BLOW PULSE (T). As a result, the ERROR RESET will be HIGH throughout the A mode and the STROKE PRESET signal will go HIGH only when the STROKE $\phi$ signal goes LOW. In accordance with the operation of error correcting circuit 521 as described supra, STROKE $\phi$ will include a single negative-going pulse at the end of the first portion and at the end of the second portion of the error correcting phase of the A mode. Thus, during the A mode, the STROKE $\phi$ will include a positive-going pulse at the end of each of the portions of the error correcting phase, if any.

(14) Display Control Circuit

Display control circuit 529 includes the circuitry for initiating and terminating a display mode and for delivering latch commands in accordance with the display latching format whenever the computing circuit is in a display mode. Thus, display control circuit 529 includes the display command switches, i.e., the A switch for simultaneously initiating a display mode and delivering an average command, and the B switch for initiating a display mode. Display control circuit 529 provides the AVERAGE COMMAND signal for indicating that an average command has been delivered and a LATCH COMMAND signal for latching the counts of the stroke and blow counters into the stroke and blow count displays, respectively. Display control circuit 529 further provides (1) an "A" ON signal for controlling the display of the letter A adjacent the stroke display whenever the readout of the stroke display is the average stroke of a blow sequence; (2) a LIMIT ENABLE signal for enabling the limit circuit warning during the display mode; and (3) a LIMIT LATCH signal for latching the limit warning, if any, into the display. The significance of the LIMIT ENABLE and LIMIT LATCH signals will be made clear in the separate description of limit circuit 531.

Referring to FIG. 24, display control circuit 529 includes the following components:

| Component Name | Reference Number | Preferred Type or Value |
|---|---|---|
| D-Type Flip-Flop | 751 | ½ 4013 |
| J-K Flip-Flop | 752 | ½ 4027 |
| J-K Flip-Flop | 753 | ½ 4027 |
| 2-Input Nand Schmitt Trigger Circuit | 754 | ¼ 4093 |
| 2-Input Nand Schmitt Trigger Circuit | 755 | ¼ 4093 |
| 3-Input NAND Gate | 756 | ⅓ 4023 |
| 2-Input NAND Gate | 757 | ¼ 4011 |
| 2-Input NOR Gate | 758 | ¼ 4001 |
| 2-Input NOR Gate | 759 | ¼ 4001 |
| 2-Input NOR Gate | 760 | ¼ 4001 |
| Inverter | 761 | 1/6 4069 |
| Capacitor | 762 | 0.05 mfd. |
| Capacitor | 763 | 0.05 mfd. |
| Resistor | 764 | 10 Kohm |
| Resistor | 764A | 1 Mohm |
| Resistor | 765 | 10 Kohm |
| Resistor | 765A | 1 Mohm |

Display control circuit 529 of the preferred embodiment of the apparatus of the invention further includes momentary, normally-open, single-pole, single throw switches 766, 766A.

The components of display control circuit 529 are interconnected as follows: one terminal of switch 766 is connected to circuit ground. The other terminal of switch 766 is connected to one end of resistor 764 and to one end of resistor 764A. The other end of resistor 764 is connected to $V_{cc}$. The other end of resistor 764A is connected to both inuts of trigger circuit 754 and to one side of capacitor 762. The other side of capacitor 762 is connected to circuit ground. The output of trigger circuit 754 is connected to the clock input of flip-flop 751. The data input of flip-flop 751 is connected to $V_{cc}$. The set input of flip-flop 751 is connected to circuit ground. The output and inverted output of flip-flop 751 are connected to the J and K inputs, respectively, of flip-flop 752. The set input of flip-flop 752 is connected to circuit ground. The output of flip-flop 752 is connected to one input of gate 758. One terminal of switch 766A is connected to circuit ground. The other terminal of switch 766 is connected to one end of resistor 765 and to one end of resistor 765A. The other end of resistor 765 is connected to $V_{cc}$. The other end of resistor 765 is connected to $V_{cc}$. The other end of resistor 765A is connected to one input of trigger circuit 755 and to one side of capacitor 763. The other side of capacitor 763 is connected to circuit ground. The output of trigger circuit 755 is connected to the J input of flip-flop 753. The set input and the K input of flip-flop 753 are connected to circuit ground. The output of flip-flop 753 is connected to one input of gate 760 and to the remaining input of gate 758. The output of gate 758 is connected to one input of gate 759. The output of gate 759 is connected to the input of gate 757. The output of gate 757 is connected to the input of inverter 761. The output of gate 756 is connected to the remaining input of gate 757.

External signals are supplied to display control circuit 529 as follows: The RESET 3 signal is supplied to the reset input of flip-flop 751. The RESET 2 signal is supplied to the reset inputs of flip-flops 752, 753. The RESET 1 signal is supplied to the remaining input of trigger circuit 755. The CLOCK signal is supplied to the remaining input of gate 759. The BLOW PULSE 2 signal is supplied to the remaining input of gate 760. The ACCUMULATOR $\phi$ signal, the BLOW PULSE (NT) signal and the INV. RESET 3 signal are supplied to the inputs of gate 756.

In order to understand the operation of display control circuit 529, it will be understood initially that the computing circuit will be in the display mode when, and only when, the output of gate 758 is LOW. Thus, a display mode can be initiated by setting either or both flip-flop 752 or flip-flop 753 and terminated by resetting both flip-flop 752 and flip-flop 753.

Flip-flop 752 is set by operation of switch 766 as follows: Closure of switch 766 will cause the output of trigger circuit 754 to go HIGH. The RC network associated with switch 766 serves as a contact bounce filter so that a chain of pulses is not produced at the output of trigger circuit 754 for a single closure. Such RC network also protects the inputs of trigger circuit 754 from static change. If such closure occurs during the A or B mode of a blow sequence, the positive-going pulse at the output of trigger circuit 754 will set flip-flop 751. On the next positive-going transition of the INV. CLOCK signal after such closure, flip-flop 752 will be set and the computing circuit will be placed in the display mode. If, however, such closure occurs during the reset mode of a blow sequence, the positive-going pulse at the output of trigger circuit 754 will not set flip-flop 752 since flip-flop 751 is held in reset by the RESET 3 signal. Furthermore, because flip-flop 751 is edge-triggered, the closure of switch 766 must occur during the A or B mode of a blow sequence in order to set flip-flop 752; i.e., a display mode cannot be initiated by closing switch 766 during the reset mode of a blow sequence and holding it closed until the B mode of such blow sequence.

The AVERAGE COMMAND signal is provided by the inverted output of flip-flop 752. As indicated supra in the description of blow pulse gating circuit 509, an average command is delivered when the AVERAGE COMMAND signal is LOW. As a result, closure of switch 766 during the A or B mode of a blow sequence simultaneously initiates a display mode and delivers an average command. Thus, switch 766 constitutes the A switch of the computing circuit.

Flip-flop 753 is set either by operation of switch 766A or by turning the power on as follows: When the power is turned on, the RESET 1 signal will be LOW whereby the output of trigger circuit 755 will go HIGH. Thus, on the first positive-going transition of the INV. CLOCK signal after the power is turned on, flip-flop 753 will be set. Similarly, closure of switch 766A will cause one input of trigger circuit 755 to go LOW whereby the output of trigger circuit 755 will go HIGH. Thus, on the first positive-going transition of the INV. CLOCK signal after switch 766A is closed, flip-flop 753 will be set. The RC network associated with switch 766A serves as a contact bounce filter so that a chain of pulses is not produced at the output of trigger circuit 754 for a single closure. Such RC network also protects the inputs of trigger circuit 754 from static charges.

The only effect of closing switch 766A is to set flip-flop 753 and initiate a display mode. Thus, switch 766A is the B switch of the computing circuit. It should be noted that closure of switch 766A is effective in initiating a display mode except during the portion of each blow sequence that the RESET 2 signal is HIGH. Because flip-flop 753 is level-triggered, a display mode can be initiated by closing switch 766A while RESET 2 is HIGH and holding it closed until RESET 2 goes LOW. In this way, the computing circuit will be in the display mode throughout the blow sequence.

Flip-flops 752, 753 are reset when, and only when, the RESET 2 signal goes HIGH; i.e., immediately after the completion of the average stroke calculation of an A mode. Thus, regardless of how a display mode is initiated, it will be terminated upon, and only upon, the completion of the first average stroke calculation following the initiation of such display mode.

During each display mode, i.e., during the time that the output of gate 758 is LOW, the output of gate 759, which provides the LIMIT ENABLE signal, will go HIGH every time the CLOCK signal goes LOW. Thus, during each display mode, the output of gate 759 and the LIMIT ENABLE signal will be the inverse of the CLOCK signal. At all other times, i.e., when the computing circuit is not in the display mode, the output of gate 759 and the LIMIT ENABLE signal will be LOW.

The LATCH COMMAND signal is provided by the output of inverter 761, which is the inverse of the output of gate 757. Because the output of gate 759 is LOW when the computing circuit is not in the display mode, the LATCH COMMAND signal will be LOW when the computing circuit is not in the display mode. During the display mode, the LATCH COMMAND signal will be HIGH, i.e., a latch command will be deviated, whenever (1) the CLOCK signal is LOW and (2) the output of gate 756 is HIGH. The output of gate 756 will be HIGH (1) when the INV. RESET 3 signal is LOW, i.e., during the reset mode or (2) when the BLOW PULSE (NT) signal is LOW or (3) when the ACCUMULATOR $\phi$ signal is LOW. Thus, during a display mode there will be a latch command, in the form of a positive-going pulse, periodically during the reset mode, upon the occurrence of a BLOW PULSE (NT), and upon the completion of an average stroke calculation while the stroke counter is disabled.

The LIMIT LATCH signal is provided at the output of gate 757 and, therefore, will be the inverse of the LATCH COMMAND signal. Thus, whenever the computing circuit is not in the display mode, the LIMIT LATCH signal will be HIGH. During a display mode, the LIMIT LATCH signal will include a negative-going pulse periodically during the reset mode, upon the occurrence of a BLOW PULSE (NT) and upon the completion of an average stroke calculation.

The "A" ON SIGNAL is provided at the output of gate 760. Thus, the "A" ON signal will be HIGH whenever both the output of flip-flop 753 and the BLOW PULSE 2 signal are LOW and will be LOW at all other times. Thus, during the time that flip-flop 753 is not set, the "A" ON signal will normally be HIGH but will include negative-going pulses of approximately 0.8 second width occurring substantially simultaneously with each valid blow pulse provided by the detection circuit. Throughout the time that flip-flop 753 is set, the "A" ON signal will be LOW.

(15) Display Circuit

Display circuit 529 displays the strokes, average strokes, blow counts, indication that an average stroke is displayed and limit warning in accordance with the format of the display mode, described supra, and the limit circuit, described infra. In particular, display circuit 529 includes (1) a stroke display for displaying the count of the stroke counter, divided by ten, whenever a latch command is delivered; (2) a blow count display for displaying the count of the blow counter whenever a latch command is delivered; (3) an "A" display for displaying the letter "A" whenever the "A" ON signal is HIGH; and (4) a limit display for displaying colons and decimal points whenever the LIMIT OUT signal, as described infra, is HIGH.

Referring to FIG. 25, display circuit 529 includes the following components:

| Component Name | Reference Number | Preferred Type or Value |
|---|---|---|
| D-Type Flip-Flop | 767 | ½ 4013 |
| D-Type Flip-Flop | 769 | ½ 4013 |
| BCD-to-7-Segment Latch/Decoder/Driver | 771 | 4056 |
| BCD-to-7-Segment Latch/Decoder/Driver | 772 | 4056 |
| BCD-to-7-Segment Latch/Decoder/Driver | 773 | 4056 |
| BCD-to-7-Segment Latch/Decoder/Driver | 774 | 4056 |
| BCD-to-7-Segment Latch/Decoder/Driver | 775 | 4056 |
| 3½ Digit Liquid Crystal Display ("LCD") | 777 | XTAL Model 1654 |
| 3½ Digit Liquid Crystal Display ("LCD") | 779 | XTAL Model 1654 |
| Exclusive-OR Gate | 781 | ¼ 4030 |

-continued

| Component Name | Reference Number | Preferred Type or Value |
|---|---|---|
| Exclusive-OR Gate | 783 | ¼ 4030 |
| Exclusive-OR Gate | 785 | ¼ 4030 |
| Inverter | 787 | 1/6 4069 |
| Inverter | 789 | 1/6 4069 |
| Inverter | 791 | 1/6 4069 |
| Capacitor | 793 | 4700 pfd. |
| Resistor | 795 | 2.2 Mohm |
| Resistor | 796 | 1 Mohm |

The components of display circuit 531 are interconnected as follows: The output of inverter 791 is connected to one end of resistor 796 and to the input of inverter 789. The other end of resistor 796 is connected to one side of capacitor 793 and to one end of resistor 795. The other end of resistor 795 is connected to the input of inverter 791. The output of inverter 789 is connected to the other side of capacitor 793 and to the clock input of flip-flop 769. The data input of flip-flop 769 is connected to the inverted output of flip-flop 769 and to pin 12 of display 777. The output of flip-flop 769 is connected to the DF inputs of latch/decoder/drivers 771-775, to one input of each of gates 781, 783, 785, to pins 1, 18, 40 of display 777, and to pins 1, 40 of display 779. The output of gate 781 is connected to pin 3 of display 777. The output of gate 783 is connected to pins 17, 19, 20, 21, 22, and 23 of display 777. the output of gate 785 is connected to pin 28 of display 777 and to pins 8, 12 and 16 of display 779. The output of inverter 787 is connected to the clock input of flip-flop 767. The set and reset inputs of flip-flop 767 are connected to circuit ground. The output of flip-flop 767 is connected to the remaining input of gate 781. Pins 7 and 8 of each of latch/decoder/drivers 771-775 are connected to circuit ground. Pin 16 of each of latch/decoder/drivers 771-775 are connected to $V_{cc}$. The A, B, C, D, E, F, G outputs of latch/decoder/driver 771 are connected to pins 30, 29, 11, 10, 9, 31, 32, respectively of display 777. The A, B, C, D, E, F, G outputs of latch/decoder/-driver 772 are connected to pins 25, 24, 15, 14, 13, 26, 27, respectively, of display 777. The A, B, C, D, E, F, G outputs of latch/decoder/driver 773 are connected to pins 30, 21, 11, 10, 9, 31, 32, respectively of display 779. The A, B, C, D, E, F, G outputs of latch/decoder/-driver 774 are connected to pins 25, 24, 15, 14, 13, 26, 27, respectively, of display 779. The A, B, C, D, E, F, G outputs of latch/decoder/driver 775 are connected pins 21, 20, 19, 18, 17, 22, 23, respectively, of display 779.

External signals are supplied to display circuit 531 as follows: The LATCH COMMAND signal is supplied to the input of inverter 787 and to the latch inputs of each of latch/decoder/drivers 771, 775. The INV. SC-100 signal is supplied to the k input of flip-flop 767. The SC-100 signal is supplied to the j input of flip-flop 767. SC-10 is connected in parallel to the A, B, C, D inputs of latch/decoder/driver 771. SC-1 is connected to the A, B, C, D inputs of latch/decoder/driver 772. BC-100 is connected in parallel to the A, B, C, D inputs of latch/decoder/driver 773. BC-10 is connected in parallel to the A, B, C, D inputs of latch/decoder/driver 773. BC-1 is connected in parallel to the A, B, C, D inputs of latch/decoder/driver 775. The "A" ON signal is supplied to the remaining input of gate 783. The LIMIT OUT signal, which is provided by limit circuit 531 as described infra, is supplied to the remaining input of gate 785.

Display circuit 529 is wired for AC drive of the LCD's in order to prevent damage from polarization. In this regard it should be noted that each display component, such as a decimal or segment of a digit or colon, has a corresponding pin. Whenever the polarity of the pin corresponding to a display component is opposite that of pins 1 and 40 of an LCD unit, such component will be illuminated. Whenever such polarities are the same, such component will not be illuminated. Thus, in order for an LCD to be AC driven, an AC signal must be applied to pins 1 and 40 with corresponding AC signals applied to the pins corresponding to the display components.

The AC signal is provided by flip-flop 769 as follows: Inverters 789, 791, capacitor 793 and resistors 795, 796 operate as a standard astable multivibrator with the output of inverter 789 constituting the output of the multivibrator. Using the component values indicated above for capacitor 793 and resistors 795, 796, the multivibrator has a period of about 100 Hz. Flip-flop 769 acts as a divide-by-two counter for the output of the multivibrator whereby a square-wave of about 50 Hz period will be provided at the output of flip-flops 769. A square wave 180 degrees out-of-phase from that provided at the output of flip-flops 769 is provided at the inverted output of flip-flop 769.

Drivers 771, 772 and LCD 777 are connected together and to the output of flip-flop 769 such that the digits latched into drivers 771, 772 will be displayed as the second and third digits, respectively, of LCD 777. Drivers 773, 774, 775 and LCD 779 are connected together and to the output of flip-flop 769 such that the digits latched into drivers 773, 774, 775 will be displayed as the second, third and fourth digits, respectively, of LCD 779. Flip-flop 767 is connected to LCD 777 through gate 781 and LCD 777 and gate 781 are connected to the output of flip-flop 769 such that when, and only when, the output of flip-flop 767 is HIGH, the first digit of LCD 777, which will always be a "1", will be illuminated. The "A" ON signal is connected to LCD 777 through gate 783 and LCD 777 and gate 783 are connected to the output of flip-flop 769 such that the letter "A" will be illuminated as the fourth digit of LCD 777 when, and only when, the "A" ON signal is HIGH. The LIMIT OUT signal is connected to LCDs 777, 779 through gate 785 and LCDs 777, 779 and gate 785 are connected to the output of flip-flop 769 such that the colon between the second and third digits of LCD 777 and all the decimal points of LCD 779 will be illuminated when, and only when, the LIMIT OUT signal is HIGH. The pin corresponding to the decimal point to the right of the second digit of LCD 777, i.e., pin 12, is connected to the inverted output of flip-flop 769 whereby such decimal point will always be illuminated.

Display circuit 529 is connected to the stroke counter and the blow counter such that whenever there is a latch command, i.e., a positive-going pulse of the LATCH COMMAND signal, the values of SC-100, SC-10 and SC-1 at the time of such latch command will be latched into flip-flop 761 and drivers 771, 772, respectively, and the values of BC-100, BC-10 and BC-1 at the time of such latch command will be latched into drivers 773, 774, 775, respectively.

In accordance with the foregoing, whenever a latch command is delivered, the count of the stroke counter at the time of such latch command will be displayed as the first, second and third digits of LCD 777 whereby such digits of LCD 777 constitute the stroke display. Because of decimal point to the right of the second digit is illuminated, the number displayed will appear as the count of the stroke counter divided by ten. Where the latch command is delivered during the reset mode of a blow sequence, the count of the stroke counter during the reset mode divided by ten, i.e., 19.7, will be displayed. Where the latch command corresponds to a BLOW PULSE (NT), the number displayed in the stroke display will represent the stroke, in feet, of the blow corresponding to such BLOW PULSE (NT). Where the latch command is the result of the ACCUMULATOR $\phi$ signal going LOW, the number displayed will be the count of the stroke counter, divided by ten, at the time the ACCUMULATOR $\phi$ signal goes LOW, i.e., the average stroke in feet of the blows occurring during the preceding B mode.

Similarly, the count of the blow counter at the time of such latch command will be displayed as the second, third and fourth digits of LCD 779. Thus, such digits of LCD 779 constitute the blow count display. Where the latch command is delivered during the reset mode, the blow count displayed will be zero. Where the latch command corresponds to a BLOW PULSE (NT), the blow count displayed will be the sequential number in the B mode of the blow corresponding to such BLOW PULSE (NT). Where the latch command corresponds to the ACCUMULATOR $\phi$ signal going LOW, the blow count displayed will be the sequence blow count.

Thus, whenever the stroke of an individual blow is displayed by the stroke display, the blow count display will simultaneously display the sequential number of such blow in the blow count display. Whenever the average stroke of the blows of a blow sequence is displayed in the stroke display, the blow count display will simultaneously display the sequence blow count of such sequence.

In accordance with the operation of display control circuit 527 as described supra, once an average stroke and sequence blow count are displayed, the displays will not change until either the A or the B switch is closed. If the A switch is closed, the next latch command will correspond to the ACCUMULATOR$\phi$ signal going LOW and a new average stroke and a new sequence blow count will be displayed. If the B switch is closed, individual strokes and corresponding blow counts will be displayed until a new average stroke and sequence blow count is displayed. Thus, during all times that flip-flop 753 of display control circuit 527 is not set, the displays will display an average stroke and a sequence blow count. Furthermore, during substantially all times that flip-flop 753 is set, the stroke and sequential number for an individual blow will be displayed.

Because the "A" ON signal is normally HIGH when flip-flop 753 is not set and LOW when flip-flop 753 is set, and because the fourth digit of LCD 777 will be illuminated as the letter "A" whenever the "A" ON signal is HIGH, the fourth digit of LCD 777 will be illuminated as an "A" whenever an average stroke and sequence blow count is displayed and will be off at all other times.

(16) Limit Circuit

Limit circuit 531 provides a LIMIT OUT signal that is HIGH (1) during the time that the stroke of an individual blow is shown on the stroke display and such stroke differs from that of the immediately preceding blow of the same blow sequence, if such stroke was calculated by at least a predetermined amount x, and (2) during the time that an average stroke is displayed and the stroke of one of the blows included in such average differs from the stroke of the immediately preceding blow of the same blow sequence, if such stroke was calculated, by at least the predetermined amount x. The LIMIT OUT signal is LOW at all other times. For the purposes of this description, a stroke of a blow that differs from that of the immediately preceding blow of the same blow sequence, if calculated, by at least the amount x will be referred to as a "limit-exceeding stroke", and an average that includes at least one limit-exceeding stroke will be referred to as a "limit-exceeding average". The amount x will be referred to as the "limit". It should be noted that although a stroke is calculated for the first B-mode blow of a blow sequence, no stroke is calculated for the immediately preceding blow, i.e., the initiating blow. Thus, the stroke of the first B-mode blow of a blow sequence can never be a limit-exceeding stroke.

In order to understand the method by which the limit circuit of the preferred embodiment determines whether a stroke is a limit-exceeding stroke, it should be noted that for consecutive blows $B_{n-1}$, $B_n$ of a blow sequence having strokes $S_{n-1}$, $S_n$, respectively, $S_n$ is a limit-exceeding stroke if:

$$|(40.1\ t_n^2-0.3)-(40.1\ t_{n-1}^2-0.3)| \geqq x$$

where $t_n$ is the time period between $B_n$ and $B_{n-1}$, and $t_{n-1}$ is the time period between $B_{n-1}$ and the immediately preceding blow ($B_{n-2}$). This relation can be restated as:

$$|40.1\ t_n^2-4.01\ t_{n-1}^2| \geqq 10x$$

In accordance with the description of calculation circuit 513, supra, approximately $40.1t_n2$ squaring pulses will be produced between the blow pulse corresponding to $B_n$ ($BP_n$) and that corresponding to $B_{n-1}$ ($BP_{n-1}$); and approximately $40.1t_{n-1}2$ squaring pulses will be produced between the blow pulse corresponding to $B_{n-1}$ ($BP_{n-1}$) and that corresponding to $B_{n-2}$ ($BP_{n-2}$). Thus, in the preferred embodiment, the limit circuit will provide an indication that Sn is a limit-exceeding stroke, i.e., a "limit indication", whenever the number of squaring pulses produced between $BP_n$ and $BP_{n-1}$ exceeds the number of squaring pulses produced between $BP_{n-1}$ and $BP_{n-2}$ by at least 10x and whenever the number of squaring pulses produced between $BP_{n-1}$ and $BP_{n-1}$ exceeds the number of squaring pulses produced between $BP_n$ and $BP_{n-1}$ by at least 10x.

In order to provide such a limit indication, the limit circuit of the preferred embodiment includes three counters: a limit up counter, a limit down counter and a limit constant counter. At some time after each blow pulse and before the first squaring pulse produced after such blow pulse, a limit load sequence occurs wherein the limit down counter is loaded with the count of the limit up counter, and then the limit up counter is cleared and the limit constant counter is loaded with a count of 10x. After such limit load sequence, the limit up counter counts up by one on each squaring pulse until the next blow pulse. Thus, at the time of a blow pulse $BP_{n-1}$ that is not an initiating blow pulse, the count of the limit up counter will be $40.1\ t_{n-1}2$ where $t_{n-1}$ is the time between $BP_{n-1}$ and the immediately preceding blow pulse $BP_{n-2}$; and, at the end of the limit load sequence, following $BP_{n-1}$ the count of the limit up counter will be zero and the count of the limit down counter will be $40.1\ t_{n-1}2$.

Furthermore, after each limit load sequence, the limit down counter will count down by one on each squaring pulse. Thus, if the number of squaring pulses produced between $BP_{n-1}$ and the next following blow pulse $BP_n$ exceeds the number of blow pulses produced between $BP_{n-1}$ and $BP_{n-2}$, the count of the limit down counter will become zero before $BP_n$ occurs. In such a case, immediately after the count of the limit down counter becomes zero, the limit constant counter will begin to count down by one on each squaring pulse. If the count of the limit constant counter becomes zero before $BP_n$, the number of squaring pulses produced between $BP_n$ and $BP_{n-1}$ will exceed the number of squaring pulses produced between $BP_{n-1}$ and $BP_{n-2}$ by at least 10x and a limit indication will be produced.

If, however, the number of squaring pulses produced between $BP_{n-1}$, and $BP_{n-2}$ exceeds the number of squaring pulses produced between $BP_n$ and $BP_{n-1}$, $BP_n$ will occur before the count of the limit down counter becomes equal to zero. In such a case, immediately after $BP_n$ occurs and before the limit load sequence following $BP_n$ occurs, the limit down counter and the limit constant counter are simultaneously clocked down. If the count of the limit constant counter becomes zero at the same time as or before the count of the limit down counter becomes zero, the number of squaring pulses produced between $BP_{n-1}$ and $BP_{n-2}$ exceeds the number of squaring pulses produced between $BP_n$ and $BP_{n-1}$ by at least 10x and a limit indication will be produced.

In all other cases, no limit indication will be produced. Whether or not a limit indication is produced for the stroke of a blow pulse, if, after such blow pulse, the computing circuit is still in the B-mode, a limit load sequence will occur and the counters of the limit circuit will count up and down as described. It should be noted that when the number of squaring pulses produced between $BP_{n-1}$ and $BP_{n-2}$ exceeds the number of squaring pulses produced between $BP_n$ and $BP_{n-1}$, the determination of whether $S_n$ is a limit-exceeding stroke is made after $BP_n$. As a result, limit circuit 531 includes load prevent means for preventing the initiation of a limit load sequence until after such a determination has been made. Furthermore, because no stroke is calculated for an initiating blow, limit circuit 531 includes limit indication prevent means for preventing a limit indication for the stroke of the first B-mode blow of a blow sequence.

If the computing circuit is in the display mode, the LIMIT OUT signal will go HIGH at about the time of the limit load sequence following $BP_n$ if a limit indication was given for $S_n$. If a limit indication is given for stroke $S_{n+1}$ of the next blow $BP_{n+1}$, the LIMIT OUT signal will remain HIGH at the time of the limit load sequence following $BP_{n+1}$. If no such limit indication is given for $S_{n+2}$, the LIMIT OUT signal will go LOW at the time of the limit load sequence following $BP_{n+1}$.

If a limit indication occurs at any time during a blow sequence, a sequence limit indication will be given and will be held until after the average computation of such blow sequence. If the computing circuit is in the display mode at the end of an average computation, i.e., the average stroke of such blow sequence is displayed, and a sequence limit indication exists at such time, the LIMIT OUT signal will go HIGH and will remain HIGH until a new display mode is initiated.

Referring to FIG. 26, limit circuit 531 for performing the foregoing functions includes the following components:

| Component Name | Reference Number | Preferred Type or Value |
|---|---|---|
| D-Type Flip-Flop | 797 | ½ 4013 |
| D-Type Flip-Flop | 799 | ½ 4013 |
| D-Type Flip-Flop | 801 | ½ 4013 |
| D-Type Flip-Flop | 803 | ½ 4013 |
| D-Type Flip-Flop | 805 | ½ 4013 |
| D-Type Flip-Flop | 807 | ½ 4013 |
| Binary Up/Down Counter | 809 | 4516 |
| Binary Up/Down Counter | 811 | 4516 |
| Binary Counter | 813 | 4520 |
| Binary Counter | 815 | 4520 |
| Binary Up/Down Counter | 817 | 4516 |
| 2-Input Exclusive OR Gate | 819 | ¼ 4030 |
| 2-Input NOR Gate | 821 | ¼ 4001 |
| 2-Input NOR Gate | 823 | ¼ 4001 |
| 2-Input NOR Gate | 825 | ¼ 4001 |
| 2-Input NOR Gate | 827 | ¼ 4001 |
| 2-Input NOR Gate | 829 | ¼ 4001 |
| 2-Input NAND Gate | 831 | ¼ 4011 |
| 2-Input NAND Gate | 833 | ¼ 4011 |
| 2-Input NAND Gate | 835 | ¼ 4011 |
| 2-Input NAND Gate | 837 | ¼ 4011 |
| 2-Input NAND Gate | 839 | ¼ 4011 |
| 2-Input NAND Gate | 841 | ¼ 4011 |
| Inverter | 843 | 1/6 4069 |
| Diode | 845 | IN914 |
| Capacitor | 847 | 220 pfd. |
| Resistor | 849 | 2.2 Mohm |
| Capacitor | 851 | 4700 pfd. |

Limit circuit 531 further includes jumper wire terminal points 855-866 and jumer wires 867-870.

The components of limit circuit 531 are interconnected as follows: The data input of flip-flop 797 is connected to $V_{cc}$. The set input of flip-flop 797 is connected to circuit ground. The output of flip-flop 797 is connected to data input of flip-flop 799, to one input of gate 821 and to one of gate 819. The output of flip-flop 799 is connected to the data input of flip-flop 801, to the reset input of flip-flop 797, to one input of gate 831, and to the load inputs of each of counters 809, 811. The set and reset inputs of flip-flop 801 are connected to circuit ground. The inverted output of flip-flop 801 is connected to one input of gate 825 and to the clock input of flip-flop 803. The data input of flip-flop 803 is connected to $V_{cc}$. The set input of flip-flop 803 is connected to circuit ground. The reset input of flip-flop 803 is connected to the anode of diode 845, to one end of resistor 849 and to one side of capacitor 847. The other end of resistor 849 and the other side of capacitor 847 are connected to circuit ground. The output of flip-flop 803 is connected to one end of gate 833. The inverted output of flip-flop 803 is connected to the reset input of flip-flop 807. The output of gate 833 is connected to the data input of flip-flop 805 and to the clock input of flip-flop 807. The output of gate 831 is connected to the clock input of flip-flop 805. The set input of flip-flop 805 is connected to circuit ground. The data input of flip-flop 807 is connected to $V_{cc}$. The set input of flip-flop 807 is connected to circuit ground. The inverted output of flip-flop 807 is connected to one input of gate 827. The output of gate 827 is connected to the reset input of flip-flop 805. The output of gate 821 is connected to one input of gate 823. The output of gate 823 is connected to the clock inputs of each of counters 809, 811, 817. The enable input, up/down input and reset input of counter 809 and the up/down input and reset input of counter 811 are all connected to circuit ground. The master output of counter 809 is connected to the enable input of counter 811. The count outputs of counter 809 are connected in parallel to the count input of counter 813. The count output of counter 811 is connected in parallel to the count input of counter 815. The enable input of counter 813 is connected to $V_{cc}$. The D output of counter 813 is connected to the enable input of counter 815. The master output of counter 811 is connected to one side of capacitor 851 and to one input of gate 835. The other side of capacitor 851 is connected to circuit ground. The output of gate 825 is connected to the reset inputs of each of counters 813, 815, to the load input of counter 817 and to the input of inverter 843. The output of inverter 843 is connected to one input of gate 837 and to one input of gate 841. The output of gate 835 is connected to the remaining input of gate 837, to the remaining input of gate 819 and to one input of gate 829. The output of gate 837 is connected to the remaining input of gate 835. The output of gate 819 is connected to the enable input of counter 817. The up/down input and the reset input of counter 817 are connected to circuit ground. The A, B, C, D inputs of counter 817 are connected to jumper terminal points 855, 856, 857, 858, respectively. Jumper terminal points 859 through 862 are connected to circuit ground. Jumper terminal points 863 through 866 are connected to $V_{cc}$. Jumper wire 867 is connected between terminal point 855 and terminal point 863. Jumper wire 868 is connected between terminal point 856 and terminal point 860. Jumper wire 869 is connected between terminal point 857 and terminal point 865. Jumper wire 870 is connected between terminal point 858 and terminal point 862. The master output of counter 817 is connected to one input of gate 839. The output of gate 839 is connected to the remaining input of gate 829, to the remaining input of gate 841 and to the remaining input of gate 833. The output of gate 841 is connected to the remaining input of gate 839. The output of gate 829 is connected to the reset input of flip-flop 799.

External signals are supplied to limit circuit 533 as follows: The CLOCK signal is supplied to the clock inputs of flip-flops 799, 801, to the remaining input of gate 825 and to the remaining input of gate 821. The CLOCK A signal is supplied to the clock input of counter 813. The CLOCK B signal is supplied to the remaining input of gate 823. The RESET 3 signal is connected to the set input of flip-flop 799. The LIMIT TRIGGER signal is supplied to the clock input of flip-flop 797. The LIMIT ENABLE signal is supplied to the remaining input of gate 831. The LIMIT LATCH signal is supplied to the remaining input of gate 827.

In accordance with the operation of limit circuit 531 of FIG. 26, counters 813, 815 constitute the limit up counter; counters 809, 811 constitute the limit down counter; and counter 817 constitutes the limit constant counter.

Consecutive load pulses for loading, first, the limit down counter and, second, the limit up counter and limit constant counters are provided by flip-flops 799, 801. Such consecutive pulses will occur whenever the computing is not in a reset mode (flip-flop 799 is held set during the reset mode by RESET 3 so that the counters are held to their preload counts during each reset mode) at some time after flip-flop 797 is set by a pulse of the LIMIT TRIGGER signal which corresponds substantially to the inverse of a BLOW PULSE 1. When the stroke of the blow generating such BLOW PULSE 1 is greater than that of the preceding blow, such load pulses will be generated immediately after such BLOW PULSE 1. If, however, the stroke of the blow generating such blow is less than that of the preceding blow, such load pulses will be delayed by gate 829 (the "load prevent gate") which holds flip-flop 799 in reset until the count of either the limit up counter or the limit constant counter becomes zero. In this regard, gates 835, 837 are connected as a flip-flop (the "down counter flip-flop") which is set when the count of the limit down counter becomes zero, and gates 839, 841 are connected as a flip-flop (the "constant counter flip-flop") which is set when the count of the limit constant counter becomes zero. Both the down counter flip-flop and the constant counter flip-flop are reset by the second load pulse of the limit load sequence.

The limit indication is given as a LOW at the output of gate 833. Gate 833 is enabled, i.e., can provide a LOW at its output, only when flip-flop 803 is set. Because capacitor 847 is charged substantially instantaneously at the beginning of the reset period through diode 845, flip-flop 803 will be held reset until some time after the end of each reset period, such time being dependent on the RC time constant of capacitor 845 and resistor 847. The values of capacitor 845 and resistor 847 are selected so that they will be held reset for slightly more than three periods of the CLOCK signal after the end of each reset period. In this way, flip-flop 803 will not be set until after the second load pulse following the blow pulse corresponding to the first B-mode blow of each blow sequence whereby no limit indication can be given until after such time. In the preferred embodiment, the constant counter is preloaded with a count of 10 whereby x=1 foot.

The limit up counter is clocked by the CLOCK A signal. During the time between the end of a BLOW PULSE 1 and the first load pulse, i.e., when flip-flop 797 is set, the limit down counter is clocked by the CLOCK signal; at all other times the limit down counter is clocked by the inverse of the CLOCK B signal, i.e., the squaring pulses. The limit constant counter is clocked by the same signal clocking the limit down counter, but is enabled only when (1) the down counter flip-flop is set and flip-flop 797 is not set, i.e., the count of the limit down counter becomes zero before a blow pulse occurs, or (2) the down counter flip-flop is not set and flip-flop 797 is set, i.e., a blow pulse occurs before the count of the limit down counter becomes zero. Thus, when the limit constant counter is enabled by event (1) of the preceding sentence, the constant counter will count down by one on each squaring pulse. If the count of the limit constant counter becomes zero before flip-flop 797 is set by a blow pulse, the constant counter flip-flop will be set and a limit indication will be given as a LOW at the output of gate 833 if flip-flop 803 is set. If flip-flop 797 is set before the count of constant counter becomes zero, the constant counter will be disabled by gate 819 before the count of such counter becomes zero, the constant counter flip-flop will not be set and no limit indication will be given. When the limit constant counter is enabled by event (2) as set forth supra, this paragraph, the limit down counter and the limit constant counter will be simultaneously clocked down by the CLOCK signal. If the count of the limit constant counter becomes zero before that of the limit down counter becomes zero, the constant counter flip-flop will be set and a limit indication will be given if flip-flop 803 is set. If the count of the limit down counter becomes zero before that of the limit constant counter becomes zero, the constant counter will be disabled by gate 819 before the count of such counter becomes zero. As a result, no limit indication will be noted.

It should be noted that the time each particular limit indication is given, i.e., the time that the output of gate 833 is LOW, is controlled by the constant counter flip-flop. Thus, each limit indication will begin when the count of the constant counter goes to zero and will end when at the beginning of the second load pulse next following the beginning of such limit indication.

Flip-flop 807, which, in accordance with the operation of flip-flop 803 and gate 833 as described supra, will be reset at least from the end of the reset period of each blow sequence at least until the end of the limit load sequence following the first B-mode blow of such blow sequence, provides the sequence limit indication as a LOW at its inverted output. Thus, if a limit indication is given at the output of gate 833 during a blow sequence, a sequence limit indication will be given at the end of such limit indication. This sequence limitation will remain stored in flip-flop 807 until the beginning of the reset period of the next blow sequence.

The LIMIT OUT signal is provided by the inverted output of flip-flop 805. Thus, the LIMIT OUT signal (1) will go HIGH if there is a limit indication when there is a positive-going transition at the output of gate 831 and (2) will go LOW if there is no limit indication when there is a positive-going transition at the output of gate 831. A positive-going transition will occur at the output of gate 831 during the limit load sequence prior to the end of the first load pulse if the computing circuit is in the display mode. Thus, the LIMIT OUT signal will go HIGH, if not already HIGH, slightly after the blow pulse of a blow having a limit-exceeding stroke and will go LOW, if not already LOW, slightly after the blow pulse of a blow for which the stroke is not a limit-exceeding stroke. Because (1) in accordance with the operation of flip-flop 803 and gate 833, there can be no limit indication until after the second load pulse following the blow pulse corresponding to the first B-mode blow of each blow sequence and (2) there can be a positive-going transition at the output only during the limit load sequence prior to the end of the first load pulse, the LIMIT OUT signal cannot go HIGH until after the second B-mode blow of a blow sequence.

The LIMIT OUT signal will also go HIGH whenever there is a sequence limit indication and the LIMIT LATCH signal goes LOW. In accordance with the operation of display control circuit 527 as described supra, the LIMIT LATCH signal will go LOW during the display mode on every BLOW PULSE (NT) and whenever the ACCUMULATOR $\phi$ signal goes low. Thus, during a display mode, after there is a sequence limit indication in a blow sequence, the LIMIT OUT signal will go HIGH on every BLOW PULSE (NT) for the remainder of the blow sequence and when the ACCUMULATOR $\phi$ signal goes LOW at the end of the blow sequence. Because there will be a positive-going transition of the output of gate 831 less than fifteen periods of the CLOCK signal after each BLOW PULSE (NT), if there is not limit latch at the time of such positive-going transition at the output of gate 831, the LIMIT OUT signal will again go LOW. Thus, even though the LIMIT OUT signal may go HIGH after a blow pulse having a stroke that is not a limit-exceeding stroke, the LIMIT OUT signal will return to LOW sufficiently fast (less than 30 microseconds in the preferred embodiment) to prevent any visible illumination of the decimals and colons on the displays. If, however, the LIMIT OUT signal goes HIGH when the ACCUMULATOR $\phi$ signal goes LOW, there will not be another positive-going transition of the output of gate 831 until a new display mode is initiated. As a result, the LIMIT OUT signal will remain HIGH for as long as the average stroke calculated during the A mode terminated when the ACCUMULATOR $\phi$ signal goes LOW remains displayed.

It should be noted that a limit indication may occur during the period between an error detection and the limit load sequence preceding such error detection. Because the error detection will cause the MODE signal to go LOW, there will be no positive-going transition of the LIMIT TRIGGER signal between the time of such error detection and the end of the average calculation resulting from such error detection. As a result, neither flip-flop 805 nor flip-flop 807 will be clocked for the remainder of the blow sequence. Thus, any limit indication occurring during the period between an error detection and the limit load sequence preceding such error detection, will not cause the LIMIT OUT signal to go HIGH nor cause a sequence limit indication. This result is desirable in view of the fact that no stroke calculation corresponds to such a limit indication.

5. Determination of Blow Rate

The stroke calculated by the apparatus of the invention is valid as a stroke only for hammers having both upward and downward free fall motion, e.g., open-ended diesel hammers. The stroke calculated, however, can be used to determine the blow rate BR of other types of hammers, in blows per minute, by using the following equation:

$$BR = 60.\sqrt{\frac{4.01}{S + 0.3}}$$

where S is the reading of the stroke display. It should be noted that where the reading on the stroke display is the result of a calcula-based on a single time differentiation (which, in the case of an open-ended diesel hammer, would be the stroke of an individual blow), a calculation of blow rate based on such reading is valid only for a single blow. Where the reading is the result of an average calculation, however, a calculation of blow rate based on such reading will give the average blow rate over the blow sequence for which the average calculation was made.

6. Determination of Stroke in Battered Pile Driving

The equation set forth in the Introduction to this description was derived for a vertically-operating hammer. Driving battered piles causes increased ram friction and a gravity that is reduced in the axial direction. Thus, if a(f) is the angle of friction and a(b) is the angle of batter measured from the vertical, the stroke S(b) for a battered pile can be determined from the equation:

$$S(b)=4.01\ (\Delta T)^2\ [\Delta \cos a(b)-(\tan a(f))(\sin a(b))]-[0.30/\cos a(b)]$$

In accordance with the operation of the apparatus, $$\Delta T^2=(S+0.3)/4.01$$

where S is the reading on the stroke display. Thus, S(b) can be determined based on such reading by the equation:

$$S(b)=[S=0.3][\cos a(b)-(\tan a(f))\ (\sin a(b))]-[0.3/\cos a(b)]$$

7. Summary

Although the apparatus described in detail supra has been found to be most satisfactory and preferred, many variations in structure are possible. Because many varying and different embodiments may be made within the scope of the inventive concept herein taught, and because many variations may be made in the embodiment herein detailed in accordance with the descriptive requirements of the law, it should be understood that the details herein are to be interpreted as illustrative and not in a limiting sense.

What is claimed as inventive is:

1. An apparatus for providing a digital indication of the stroke of the second of two consecutive blows delivered by a pile driving hammer where each of such consecutive blows produces a discrete sound, the apparatus comprising:

detection means for converting the sound produced by the first of such consecutive blows into a first electrical pulse and for converting the sound produced by the second of such consecutive blows into a second electrical pulse such that the time differential between said first and second electrical pulses is substantially equal to the time differential between the first of such consecutive blows and the second of such consecutive blows, said detection means including an output at which said first and second electrical pulses are provided;

computing means for calculating the value of x where $$x=4.01\ t^2-0.3$$

and where t is the time differential in seconds between the first electrical pulse and the second electrical pulse, said computing means including (i) input means for receiving the first and second electrical pulses from the output of said detector means and (ii) indicator means for providing a digital indication of x.

2. The apparatus of claim 1 wherein said detection means includes transducing means for converting the sound of the environment of the pile driving hammer, including the sound produced by the blows of such hammer, into a continuous electrical signal and discrimination means for discriminating the component of the continuous electrical signal corresponding to the sound produced by such consecutive blows from the remaining components of such electrical signal.

3. The apparatus of claim 2 wherein said discrimination means includes a bandpass amplifier having a center frequency substantially equal to the fundamental frequency of the sound produced by such consecutive blows.

4. The apparatus of claim 3 wherein said discrimination means includes envelope detection means for detecting the envelope of the signal at the output of said bandpass amplifier and pulse generation means for producing an electrical pulse for each positive-going transition of the signal at the output of said envelope detection means through a constant voltage level.

5. The apparatus of claim 4 wherein said bandpass amplifier has variable gain and said discrimination means includes adjustment means for automatically adjusting the gain of said bandpass amplifier in response to the average level of the sound in the environment of such hammer such that the gain of said bandpass amplifier is decreased as such average level increases.

6. The apparatus of claim 5 wherein said adjustment means decreases the gain of said bandpass amplifier in response to a pulse at the output of said envelope detection means for a period of time following such pulse at the output of said envelope detection means.

7. The apparatus of claim 6 wherein said adjustment means includes period variation means for varying the length of the period of time after a pulse at the output of said envelope detection means that the gain of said bandpass amplifier is decreased.

8. The apparatus of claim 1 wherein said computing means includes:

squaring pulse generation means for generating a quantity of squaring pulses after said first electrical pulse, said quantity of pulses generated at time t(a) after said first electrical pulse and prior to said second electrical pulse being approximately equal to $40.1\ t(a)^2$ where t(a) is measured in seconds; and stroke counting means for counting the squaring pulses generated by said squaring pulse generation means, said stroke counting means including a counter that is preloaded with a count of minus 3.

9. The apparatus of claim 8 wherein said indicator means of said computing means includes digital display means for providing a visible digital display of said digital indication of x, said digital display means including latch means for latching the count of said stroke counting means at approximately the time of said second electrical pulse.

10. The apparatus of claim 8 wherein said squaring pulse generation means includes:

reference pulse generation means for generating reference pulses at a reference pulse frequency;

dividend pulse generation means for generating a quantity of dividend pulses substantially equal to the square of the number of reference pulses generated since the occurrence of the first electrical pulse;

dividing means for generating a single squaring pulse for every k dividend pulses generated by said dividend pulse generation means, k being equal to $$1/(40.1(t(1))^2)$$

where t(1) is the inverse of the reference pulse frequency.

11. The apparatus of claim 10 wherein said dividend pulse generation means generates $2i+1$ dividend pulses after each reference pulse where i is less than the sequential number of the reference pulse with reference to the first electrical pulse.

* * * * *

UNITED STATES PATENT AND TRADEMARK OFFICE

CERTIFICATE OF CORRECTION

PATENT NO. : 4,271,475

DATED : June 2, 1981

INVENTOR(S) : Steven L. Sahajkak

It is certified that error appears in the above-identified patent and that said Letters Patent is hereby corrected as shown below:

Column 2, line 30, delete "for", insert --of--.

Column 15, line 23, after "319", insert -- and the arm of potentiometer 319--.

Column 15, line 35, change "oridinarily" to -- ordinarily --.

Column 26, line 8, change "43" to -- 543 --.

Column 26, line 20, change "("Q")" to -- ("$\overline{Q}$") --.

Column 27, line 10, change "AND" to -- NAND --.

Column 34, line 27, change "(5)" to -- (6) --.

Column 35, line 13, change "beset" to -- be set --.

Column 36, line 36, delete "a".

UNITED STATES PATENT AND TRADEMARK OFFICE

CERTIFICATE OF CORRECTION

PATENT NO. : 4,271,475

DATED : June 2, 1981

INVENTOR(S) : Steven L. Sahajkak

It is certified that error appears in the above—identified patent and that said Letters Patent is hereby corrected as shown below:

Column 39, line 66, change "if" to -- of --.

Column 40, line 24, change "PULSe" to -- PULSE --.

Column 40, line 28, change "40.1 tz2 to -- 40.1tz2 --.

Column 46, line 35, change "counter" to -- counters --.

Column 46, line 50, delete "such" and insert -- each --.

Column 47, line 17, change "low" to -- LOW --.

Column 48, line 17, change " 8____" to -- ____ --.

Column 58, line 30, change "the" to -- The --.

Column 58, line 51, after "connected" insert -- to --.

Column 63, line 32, change "220 pfd." to - 2200 pfd.--.

UNITED STATES PATENT AND TRADEMARK OFFICE

CERTIFICATE OF CORRECTION

PATENT NO. : 4,271,475

DATED : June 2, 1981

INVENTOR(S) : Steven L. Sahajkak

It is certified that error appears in the above—identified patent and that said Letters Patent is hereby corrected as shown below:

Column 63, line 37, change "jumer" to -- jumper --.

Column 66, line 68, change "not" to -- no --.

Column 68, line 26, change "inventive" to -- invention --.

Signed and Sealed this

*Eighth* Day of *December 1981*

[SEAL]

*Attest:*

GERALD J. MOSSINGHOFF

*Attesting Officer* *Commissioner of Patents and Trademarks*